US009328300B2

(12) United States Patent
Ferrara

(10) Patent No.: US 9,328,300 B2
(45) Date of Patent: May 3, 2016

(54) METHOD, APPARATUS AND CHEMICAL PRODUCTS FOR TREATING PETROLEUM EQUIPMENT

(71) Applicant: Marcello Ferrara, Syracuse (IT)

(72) Inventor: Marcello Ferrara, Syracuse (IT)

( * ) Notice: Subject to any disclaimer, the term of this patent is extended or adjusted under 35 U.S.C. 154(b) by 228 days.

(21) Appl. No.: 13/836,857

(22) Filed: Mar. 15, 2013

(65) Prior Publication Data

US 2013/0270157 A1 Oct. 17, 2013

Related U.S. Application Data

(60) Provisional application No. 61/624,629, filed on Apr. 16, 2012.

(30) Foreign Application Priority Data

Apr. 16, 2012 (IT) ..... ITRM20120162

(51) Int. Cl.

| | |
|---|---|
| ***C10G 75/04*** | (2006.01) |
| ***F24D 17/00*** | (2006.01) |
| ***F24D 17/02*** | (2006.01) |

(52) U.S. Cl.

CPC ..... *C10G 75/04* (2013.01); *F24D 17/0021* (2013.01); *F24D 17/0031* (2013.01); *F24D 17/02* (2013.01); *Y10T 29/49* (2015.01)

(58) Field of Classification Search

CPC ..... C10G 9/16; C10G 75/00; C10G 75/02; C10G 75/04

See application file for complete search history.

(56) References Cited

U.S. PATENT DOCUMENTS

| | | | | |
|---|---|---|---|---|
| 3,677,819 | A | 7/1972 | Thiel | |
| 4,762,958 | A * | 8/1988 | Martens et al. | 585/613 |
| 4,810,397 | A | 3/1989 | Dvoracek | |
| 5,076,856 | A | 12/1991 | Schweiger | |
| 5,266,186 | A * | 11/1993 | Kaplan | 208/48 AA |
| 5,425,814 | A | 6/1995 | Krajicek et al. | |
| 5,540,784 | A | 7/1996 | Ranes | |
| 5,611,869 | A | 3/1997 | Hart | |
| 5,935,276 | A | 8/1999 | DeRosa et al. | |
| 5,972,206 | A | 10/1999 | Lenglet | |
| 6,138,691 | A | 10/2000 | Voloshin et al. | |

(Continued)

FOREIGN PATENT DOCUMENTS

| | | |
|---|---|---|
| DE | 44 20 579 A1 | 12/1995 |
| FR | 2 815 639 | 4/2002 |

(Continued)

OTHER PUBLICATIONS

Search Report for Application No. ITRM20120162 dated Dec. 18, 2012.

(Continued)

*Primary Examiner* — Brian McCaig

(74) *Attorney, Agent, or Firm* — Smith, Gambrell & Russell LLP.

(57) ABSTRACT

The present invention provides a method, an apparatus and chemical products for treating petroleum equipment wherein a fluid is flowing, preferably of the hydrocarbon type, and wherein treating is performed by establishing a closed or semi-closed flow circulation loop, during the normal production operations of the equipment. The treatment can refer to the cleaning of equipment, to yield improvement as compared to normal run conditions and/or to a reduction of coke formation and/or to coke removal on catalysts.

71 Claims, 15 Drawing Sheets

(56) References Cited

U.S. PATENT DOCUMENTS

| | | | | |
|---|---|---|---|---|
| 6,273,102 | B1 | 8/2001 | Kawakami et al. | |
| 6,485,578 | B1 | 11/2002 | Park et al. | |
| 6,858,090 | B2 | 2/2005 | Hebert | |
| 7,682,460 | B2 | 3/2010 | Ferrara | |
| 7,998,281 | B2 | 8/2011 | McCoy et al. | |
| 2005/0263437 | A1 * | 12/2005 | Howdeshell ..... | 208/48 AA |
| 2009/0266742 | A1 | 10/2009 | Newman et al. | |
| 2011/0247967 | A1 | 10/2011 | Sundaram et al. | |

FOREIGN PATENT DOCUMENTS

| | | | |
|---|---|---|---|
| GB | 2 361 282 | A | 10/2011 |
| KR | 20010092131 | | 10/2001 |
| WO | 96/20255 | A1 | 7/1996 |
| WO | 03/103863 | A1 | 12/2003 |
| WO | 2008/070299 | A1 | 6/2008 |
| WO | 2011/126880 | A2 | 10/2011 |

OTHER PUBLICATIONS

Written Opinion of the International Searching Authority (Form IT237) dated Dec. 18, 2012 for Application NO. ITRM20120162 including partial English language translation of Opinion.

* cited by examiner

METHOD, APPARATUS AND CHEMICAL PRODUCTS FOR TREATING PETROLEUM EQUIPMENT

CROSS REFERENCE TO RELATED APPLICATIONS

This application claims benefit of U.S. Provisional Application No. 61/624,629 filed Apr. 16, 2012 as well as Italian Application No. ITRM20120162 filed on Apr. 16, 2012. These priority applications are incorporated herein by reference.

BACKGROUND OF THE INVENTION

The present invention is inclusive of a method, an apparatus and chemical products for cleaning petroleum equipment, preferably of the hydrocarbon processing type, wherein cleaning is performed by establishing a closed or semi-closed flow circulation loop, during the normal production operations of said equipment.

The present invention is further inclusive of a method, an apparatus and chemical products for increasing distillation yields of a petroleum plant.

The present invention is also inclusive of a monitoring system to verify the cleaning status during execution of the claimed method.

The present invention is still further inclusive of a method, an apparatus and chemical products for cleaning, degassing and decontamination of petroleum equipment, before maintenance.

The present invention realizes the cleaning of the equipment during the normal run of the plant it is a part of, without the need of excluding it from the production cycle and/or without the need of stopping production and/or the flow of the fluid which is normally flowing in said equipment. This is an improvement over the current state of the art.

By cleaning petroleum equipment with a closed or semi-closed flow circulation loop, the present invention realizes, among others (e.g., when compared to common mechanical cleaning systems), the following improvements: i) elimination of equipment decommissioning and/or opening and/or out of service; ii) cleaning time reduction; iii) recovery and reuse of fouling product; iv) achieving simultaneous cleaning of multiple equipment pieces; v) reduction of production loss arising from equipment being out of service.

The present invention also realizes a new design/engineering method to dimension petroleum equipment, wherein said dimensioning can be done without taking into account performance reduction due to fouling.

Other techniques are available in the state of the art which realize equipment cleaning on a closed flow circulation loop (none of these operate with a semi-closed flow circulation loop), but such techniques imply, the equipment and/or the plant they are part of, to be excluded from the production cycle or even the entire plant to be out of production. The present invention improves the state of the art by realizing the cleaning of the equipment and/or of the plant they are part of, without stopping the production cycle, during normal plant run.

The present invention also provides a yield increase and/or coke formation reduction or coke removal on catalysts in a petroleum plant.

STATE OF THE ART

Generally speaking, fouling of process equipment arises from deposition of heavy compounds. For the purposes of the present invention the term "heavy compounds" means chemical compounds, alone or mixtures thereof, having a boiling point >100° C. Such heavy compounds generally show up as a deposit inside said equipment, with related equipment malfunctioning, and generally result from degradation of fluids which are part of the process. Sometimes degradation can even lead to coke and coke-like deposits. In some processes, especially the petrochemical ones, such heavy compounds show up as polymeric compounds. It is therefore necessary to remove said heavy compounds from the equipment to recover its normal performance.

Petroleum plants suffer from fouling of equipment. As used in the present invention the terms "petroleum plant" or "plant" refer to any industrial plant wherein there is processed a crude oil or any crude oil derivative, direct or indirect, that is derived from the processing of one or more derivative(s) of the crude oil. It is to be considered, even crude oil just as extracted gives rise to fouling problems within the industrial plant arising from heavy compounds precipitation inside production equipment. For example, oil-gas separators, stabilization/distillation columns, heat exchangers, and filters are subject to such fouling. Once the crude oil is processed in refining plants, these refining plants also experience heavy compound fouling. Fouling generally increases by increasing process temperature and/or by having a heavier plant feed and/or a feed made up of residues of the preceding plants. Among the equipment which experiences fouling, there can be mentioned, as explanatory but not limiting examples: distillation columns (including their internals), furnaces, reactors (including their catalysts), filters, pumps, lines and heat exchangers. All of the hydrocarbon processing industry is experiencing this problem from oil fields to refining and petrochemical plants, as well as fine chemicals production. Among the refining plants subject to fouling there can be mentioned, e.g.: Topping (CDU), Vacuum (VDU), Visbreaking (VBU), Fluid Catalytic Cracking (FCC), Resid Catalytic Cracking, Hydrotreating, Hydrofining, Unionfining, Reforming, Coking, Hydrocracking, Thermal Cracking, Deasphalting, Alkylation, Isomerization, Demetallization, Dewaxing, Flexicoking, Flexicracking, GO-Fining, Isocracking, LC-Fining, Magnaforming, Lube and wax processing, Lube Isocracking, Lube oil dewaxing, Platforming, Resid Oil Supercritical Extraction (ROSE), Residfining, Residue thermal cracking, Selective Yield Delayed Coking (SYDEC), Solvahl Solvent Deasphalting, Unicracking, Continuous Catalytic Reforming (CCR), Aromatics extractive distillation, Asphalt oxidation, Gasification, Desulfurization, Hydrodesulfurization, Olefins recovery, Spent oil lube rerefining; and generally all of the plants which are part of a petroleum refinery and/or related sites.

In the petrochemical plants, fouling from heavy compounds show up, besides from the heavy compounds themselves, also as polymeric compounds which plug equipment. Such a phenomenon is particularly strong in the plants which produce raw materials for the polymer/rubber industry or which directly produce polymer/rubber. Among the petrochemical plants subject to fouling there can be mentioned, e.g.: Ethylene, Butadiene, Phenol, Cumene, Alpha Olefins, BTX aromatics, Alkylbenzene, Caprolactam, Dimethyl terephthalate, Polyethylene, Polypropilene, Polystyrene, PVC, Styrene, Vinyl Chloride Monomer, Xylene Isomerization, Styrene-Butadiene Rubber (SBR), Nitrilic-Butadiene Rubber (NBR), Acrylonitrile, Acrylonitrile-Styrene-Butadiene (ABS), Toluendiisocyanate (TDI), Normal Paraffin, ISO-SIV; and generally all of the petrochemical plants.

In all of the above exemplary cases, fouling reduces plant performance and makes it necessary for equipment shutdown, placement out of service, decommissioning, cleaning and subsequent commissioning and then getting it back on-stream. In any case, fouling associated costs imply: i) energy costs, as it is more difficult to supply or exchange heat when the equipment is fouled, with related increase in fuel consumption; ii) production loss costs, as fouling limits throughput and/or plant yields or can lead to an anticipated shutdown; iii) maintenance costs, such as a specialized company mechanically cleaning the equipment; iv) environmental costs, as waste is generated, and needs to be disposed of, (with related waste disposal costs); environmental burdens, together with waste disposal, generation of emissions of airborne pollutants, included those related to increased fuel consumption. The above costs are almost inevitable with current technologies. Embodiments of the present invention are suited for avoiding or at least lessening to some extent all or some of the above noted problems.

The state of the art of equipment cleaning implies a tailor made cleaning for each piece of equipment. Heat exchangers are generally cleaned by bundle extraction and washing with high pressure water jetting (with pressures even >600 bar), generally in a different place with respect to the place where the equipment is located. Distillation columns are cleaned by manual cleaning (e.g., scratching) and/or washing with high pressure water jetting. Filters and pumps are cleaned by decommissioning and manual cleaning. In a furnace, coke is removed, e.g., by means of flowing an air/steam mixture or by inserting and running a pig in the coils. In a catalyst, coke is removed after dumping the catalyst from the reactor and by ex situ controlled coke combustion. To perform such an operation the catalyst is sent to a specific regeneration plant of a specialized company.

The above operations, besides having the mentioned drawbacks, can also cause damage to the equipment to be cleaned. For heat exchanger bundles to be extracted, e.g., their lifting by means of crane and slings or an extractor is required: this causes bundle bending and in turn damage to tubes and boring; furthermore, removal and re-assembling of floating heads might lead to potential leaking when the gasket is not perfectly placed. Air/steam decoking of furnaces, besides prolonged downtime, might lead to carburation of coils which might cause tube rupture. Finally, in a petroleum plant, cleaning of equipment is performed for each single piece of equipment, with different timing, and is a labor intensive job.

Upon performing cleaning of equipment on a closed or semi-closed system, during plant run, there is avoided opening of said equipment and/or there is avoided potential damages arising from current techniques, and/or there is provided a reduction in waste generation, and/or airborne emissions, and/or there is provided for the cleaning of more pieces of equipment simultaneously, and, hence, an improvement over the current state of the art can be achieved. Whenever said closed or semi-closed system cleaning is performed without stopping production and/or the flow of the fluid which passes through said equipment and/or the plant wherein said equipment is part of, an additional improvement over the current state of the art can be achieved.

The present invention realizes an improvement over the current state of the art by achieving the cleaning of the equipment and/or of the petroleum plant by means of a closed or semi-closed circulation loop inside the equipment and/or the petroleum plant to be cleaned and by introducing a first and/or second hydrocarbon fluid in said closed or semi-closed circulation loop, during the normal run of the equipment and/or of the petroleum plant, without stopping the plant and/or without removing the fluid which passes through said equipment and/or said petroleum plant.

In the state of the art many chemical products are available which are used to prevent fouling of petroleum equipment. Said chemical products are introduced in small amount (e.g., maximum 100 ppm) in the feed during the normal run of the plant, with the plant in the production mode and with the produced products completely exiting the plant (without any closed or semi-closed circulation loop which introduces said chemical products inside the petroleum plant). Said chemical products are normally injected on a continuous basis, 365 days a year. Furthermore their dosage rate is normally constant and does not depend in any case on injection time. In no case are said chemical products injected during a closed or semi-closed circulation phase, wherein a distillate is reintroduced in the petroleum plant in order to clean one or more pieces of equipment and/or to increase distillation yield and/or to reduce coke formation on catalysts and/or to remove coke from catalysts. Finally said chemical products fail to clean fouled equipment, and thus are used instead to prevent equipment from fouling. As a matter of fact, notwithstanding the injection of said chemical products, the equipment treated with said chemical products do foul anyway; as proof of that, the treated equipment is mechanically cleaned both during normal plant run or during plant shutdown. Generally speaking, plant shutdown is mostly dictated by the need of mechanical cleaning of fouled equipment. U.S. Pat. No. 5,076,856 describes a system to clean heat exchangers wherein a solvent flows for about 15 minutes, followed by a flushing with compressed air; the system operates as an open circuit. U.S. Pat. No. 5,425,814 describes an embodiment featuring a closed loop decontamination method, which uses chemical products to be dissolved in water; the water and the chemical products are circulated in the equipment while being excluded from the production cycle. U.S. Pat. No. 6,273,102 describes a method for downloading a catalyst, which uses chemical products for safely softening/wetting/downloading a catalyst from a reactor during plant shutdown; i.e., when the reactor is excluded from the production cycle and the plant is shutdown.

The state of the art is also inclusive of the following references WO2008/070299; U.S. Pat. No. 7,682,460; US2009/0266742; WO2011/126880; WO96/20255; U.S. Pat. No. 6,485,578.

The state of the art of equipment cleaning includes therefore the exclusion from the production cycle of the equipment to be cleaned and eventually the plant shutdown or the shutdown of individual pieces of equipment. This is a serious technical problem because cleaning implies reduced/stopped production of the plant and/or of said equipment. Moreover, in the state of the art the circulation of a plant is performed on a closed loop basis only, generally during shutdown operations before maintenance and in no case during plant run. In no case is a semi-closed circulation performed.

Under the present invention, the term "semi-closed loop circulation" defines a process wherein a hydrocarbon fluid produced in a petroleum plant, which is therefore a portion of the normal production, is: i) partially exiting the petroleum plant (as per normal production process) and, ii) partially withdrawn from one or more plant locations and introduced in one or more plant locations, preferably upstream of the equipment to be cleaned; and in a preferred embodiment said hydrocarbon fluid will be thereafter distilled and, re-withdrawn and re-introduced, thereby continuing the cycle.

During a plant run the equipment is indeed actively included in the production cycle and the process fluid fully passes through it as per design conditions. A plant run implies the introduction at a plant's inlet of a feed, specific for that plant, and the submission of the various equipment at process conditions, in particular temperature and pressure (e.g., a normal operation state or normal run), such as to produce specific products at the plant's outlet. As used in the present invention "normal operation state" or "normal run", and the like, defines, relative to embodiments of the invention, a condition of the plant wherein distillate(s) meet one or more pre-established criteria or specifications as to render said distillate(s) suited for plant output. For example, in a Crude Distillation Unit (CDU or Topping), crude oil is introduced at a plant inlet and at the outlet are produced LPG, gasoline, naphtha, kerosene, gas oil, atmospheric residue; feed rate normally depends upon production needs of the CDU and/or of the refinery. The throughput of the products at a plant outlet ("distillation yield", "plant yield" or "conversion yield) depends upon many factors, but it is the same for the same feed at the same operating conditions. Plant shutdown or feed reduction are a penalty for the plant owner.

In the state of the art, during the cleaning of one or more pieces of equipment, normal run conditions are missing in that, in order to perform the cleaning, said equipment is excluded from the production cycle and the process fluid does not pass through it, as opposite to design conditions, and/or the plant itself is shutdown or its throughput is reduced in order to allow said exclusion (obviously, by missing one or more pieces of the plant designed for an on-line state or for normal plant usage, the same cannot run at the same throughput). In the state of the art, the main technical problem which hampers the cleaning of the equipment during a plant run is attributable to the stoppage of plant production and/or the stoppage of the normal flow which passes through said equipment in order to clean it.

In the state of the art it was not thinkable to achieve the equipment cleaning during plant run because all of the existing techniques implied the stoppage of the normal flow which passes through said equipment. In the state of the art it was not thinkable to realize an internal circulation of distillates, by means of a closed or semi-closed loop, because in all of the existing petroleum plants the distillates are completely removed from said plant, or from the equipment wherein they pass through, once they are produced. In the state of the art it was finally not thinkable to circulate a distillate upstream of the equipment to be cleaned by "self-producing" said distillate by means of a variation of feed rate, because the feed rate is exclusively defined by production needs (market demand) and it is in no way bound to plant cleaning needs (besides the throughput limitations related to fouling, which impose a throughput reduction and is one of the technical limits which are addressed by the present invention). No person skilled in the art would therefore think to clean equipment during the plant run because, with the current techniques, this would imply: i) production loss of said plant; ii) the modification of all the state of the art on plant design/engineering and/or on plant production processes.

Unexpectedly, by applying an operating method under the present invention, not used in the state of the art, together with an apparatus in accordance with the present invention, in order to create a closed or semi-closed loop during plant run, and by introducing a first and/or second hydrocarbon fluid, the cleaning of equipment during plant run can be realized, without stopping the plant and/or without excluding said equipment and/or without stopping the flow which normally passes through the same.

Still unexpectedly, by applying an operating method under the present invention, not used in the state of the art, together with an apparatus in accordance with the present invention, in order to create a closed or semi-closed loop during plant run, and by introducing a first and/or second hydrocarbon fluid, a distillation yield increase and/or the reduction of coke formation on catalysts and/or the removal of coke on catalysts are realized.

SUMMARY OF THE INVENTION

In one preferential embodiment, the present invention relates to a method, an apparatus, one or more chemical product(s) and a monitoring system to clean, in a closed or semi-closed loop, during plant run, one or more pieces of petroleum equipment which have been fouled up by heavy organic compounds, as defined by the present invention.

In another preferential embodiment, the present invention relates to a method, an apparatus and chemical product(s) to clean during the plant run of a petroleum plant.

In still another preferential embodiment, the present invention relates to a method, an apparatus and chemical product(s) to increase distillation yield of a petroleum plant.

In a further preferential embodiment, the present invention relates to a method, an apparatus and chemical product(s) to simultaneously realize the cleaning and the increase of distillation yield of a petroleum plant.

In still a further preferential embodiment, the present invention relates to a method for monitoring closed or semi-closed cleaning operations and/or distillation yield increase under the present invention.

In another preferential embodiment, the present invention relates to a method, an apparatus and chemical product(s) to reduce coke formation on catalysts.

In still another preferential embodiment, the present invention relates to a method, an apparatus and chemical product(s) to remove coke on catalysts.

In still a further preferential embodiment, the present invention relates to a method, an apparatus and chemical product(s) to simultaneously realize the cleaning and the increase of distillation yield of a petroleum plant and/or the reduction of coke formation on catalysts.

In another preferential embodiment, the present invention relates to a method, an apparatus and chemical product(s) to clean and to achieve gas-free conditions and/or to achieve safe entry conditions of equipment in a petroleum plant.

An embodiment features a method for treating a petroleum plant or equipment of the petroleum plant during a running of the petroleum plant that comprising maintaining, during a treatment period, the petroleum plant under a production operating condition, typical of the plant itself, while providing fresh feed to the petroleum plant. Also, while maintaining the petroleum plant under the production operating condition, there is carried out one or both of a) and b): with a) being introducing in the petroleum plant, during the treatment period, a hydrocarbon-based treatment fluid; b) being varying an established feed rate, present at initiation of the treatment of the petroleum plant or equipment of the petroleum plant, which established feed rate ranges from a maximum operation rate for the petroleum plant, which is inclusive of a design rate for the petroleum plant, to a minimum operation rate which is set at a level for satisfying a minimum production operating state in the petroleum plant. Said introduction of a hydrocarbon-based treatment fluid and/or said variation to the treatment feed rate is inclusive of the providing of an additional source or sources for distallation with respect to the amount provided by the established rate. There is also the distillation of said additional source or sources for distillation for the purpose of plant treatment.

An embodiment includes the additional source or sources of distillate as being that which is generated by the variation to the treatment feed rate to he fed into the plant (e.g., into the current fresh feed of the plant) as the introduction source "a)" or as a supplement to an alternate introduction source "a)" (e.g., an introduction being a re-introduction of distillate to another point in the plant from the distillate source's output such as by use of a closed or semi-closed loop associated with the plant) to the plant (e.g., as supplement to an external source or another plant source).

An embodiment includes, for varying the established rate, an adjustment of the established rate to a treatment feed rate either by an increase in the established feed rate when the established feed rate falls below the treatment feed rate or a reduction in the established feed rate when the established feed rate falls above the treatment feed rate.

An embodiment includes, for setting the established feed rate, an adjustment of the established feed rate in association with an introduction of the hydrocarbon-based treatment fluid at least partly derived from an external source and wherein said first externally derived hydrocarbon-based treatment fluid is introduced into a closed or semi-closed loop at least partly formed by said plant.

An embodiment of the invention further comprises adding equipment to an existing plant to form the closed or semi-closed loop and wherein a majority of the closed or semi-closed loop is represented by equipment previously existing in the plant for normal run usage.

An embodiment includes having the hydrocarbon-based fluid being one that is a fluid that cleans a heavy deposit in the plant by removal of the heavy deposit from a source location in the plant and passing the removed heavy deposit with the cleaning hydrocarbon-based fluid to an outlet of the plant.

An embodiment includes, for varying the established feed rate, an increase adjustment in the plant fresh feed rate from said established feed rate to a level above the established feed rate as to generate an additional quantity of distillates relative to a quantity generated at the established feed rate, and drawing off at least some of an overall quantity of distillate generated from the increased plant feed rate and introducing the drawn off distillate into a treatment region of said plant. An embodiment further comprises passing the drawn off distillate through a closed or semi-closed loop forming at least a portion of said plant and extending through the treatment region; with, for example, the closed or semi-closed loop of the plant being configured such that drawn off distillate is re-introduced into a distillation device of the plant which is a source of the initially drawn off distillate and drawing off a recirculation output of distillate from the distillation device following receipt of the re-introduced drawn off distillate and passing the recirculation output of distillate to the treatment region.

An embodiment further comprises introducing the drawn off distillate to one or more fresh feed rate passageways of the plant and a lowering of a current fresh feed rate to the plant such that upon introduction into a loop of the plant there is provided a source or a supplement for the introduction of the hydrocarbon based treatment fluid to the treatment feed rate and such that the lowered fresh feed rate plus the additional drawn off distillate passing though one or more common passages in the plant sum to conform with plus or minus 60% of the established rate, alternatively one that has the sum to conform at plus or minus 30% of the established rate, or, even further alternatively, one that is essentially at the established rate.

An embodiment further comprises introducing an increasing amount of the drawn off distillate to one or more fresh feed passageways of the plant and a coordinated lowering of a current fresh feed rate to the plant such that the lowered fresh feed rate plus the additional drawn off distillate is summed together to a desired treatment feed rate and wherein a controller is configured as to monitor and adjust the fresh feed rate to the plant based on a (e.g., sensed) current input level of the drawn off distillate being received in said one or more fresh feed passageways, a current fresh feed to the plant, and a set desired treatment feed rate in the plant.

An embodiment further includes having the drawn off distillate introduced into a fresh feed passageway of the plant and wherein introduction of the hydrocarbon-based fluid includes introduction (or re-introduction) of a first and/or second hydrocarbon-based fluid, and varying the established feed rate is carried out by an introduction of the first and/or second hydrocarbon treatment fluids, with the introduction of the first and/or second hydrocarbon treatment fluids including both the drawn off distillate plus an external source of said first and/or second hydrocarbons placed into combination with the drawn off distillate so as to establish desired treatment feed rate.

An embodiment further includes introducing into a closed or semi-closed loop of the petroleum plant, during the treatment period, the hydrocarbon-based fluid, with the hydrocarbon-based fluid being derived from either an external source of the hydrocarbon-based fluid, an internal plant source of the hydrocarbon-based fluid or both.

An embodiment further includes having the introduction of the hydrocarbon-based fluid comprised of the introduction of a first and/or second hydrocarbon based fluid, with the first hydrocarbon based fluid being introduced in a ratio comprised between 0% and 100% with respect to a current fresh feed in the plant; and, if a second hydrocarbon-based fluid is introduced introducing it in a ratio comprised between 0.01% and 50% with respect to a current fresh feed in the plant (with a provision in this embodiment being that, when the additional portion of distillates is 0%, the amount of the first hydrocarbon based fluid is higher than 0%).

An embodiment includes passing one or more distillates and/or products of the plant from a non-treatment, normal, plant operation mode passage route to a treatment mode passage route by feeding at least a portion of the one or more distillates and/or products into a closed or semi-closed circulation loop (at least partially passing inside the plant and that passes the one or more distillates and/or products of the plant) to a different location in the plant than when directed in the non-treatment mode. For example, the different location in the plant can be a location positioned upstream of plant equipment to be treated (as in an input location in a passage or communication line that extends between an equipment piece being treated that is immediately downstream from another piece of equipment on the same passage line not being treated).

An embodiment features circulating in the closed or semi-closed loop one or both of a first hydrocarbon-based fluid and a second hydrocarbon-based fluid inside the equipment to be treated as part of the introduction of hydrocarbon-based fluids in the plant, such that a portion of the products distilling during said circulation are re-introduced in said closed or semi-closed loop, whereas another portion of the distillates makes up the petroleum plant production and/or the normal distillate flow stream.

There is also an embodiment featuring an adjustment in plant configuration to include the closed or semi-closed loop (with one embodiment including the addition of a distillation generation device that is added into the loop for treatment purposes and in one embodiment is not part of the non-treatment or normal run portion of the plant).

An embodiment includes a method wherein there is circulated in the closed or semi-closed loop one or both of the first hydrocarbon-based fluid and a second hydrocarbon-based fluid inside the equipment to be treated, for a time of at least 20 minutes, at a temperature comprised between 100° C. and 900° C. and at a pressure comprised between 1 bar and 400 bar An embodiment includes a method wherein a monitoring criteria associated with a running of said plant is monitored, and wherein the introduction of the hydrocarbon based fluid includes the circulation within a closed or semi-closed loop of the first hydrocarbon-based fluid or the first and second hydrocarbon based fluids, and which circulation is carried out in repeated fashion until the monitoring criteria is deemed satisfactory.

An embodiment includes a method wherein the plant operating running conditions during treatment are such that there is continued distillation of fresh feed source material.

An embodiment includes a method wherein the petroleum plant runs at increased feed or at the design feed rate (or higher), so as to produce a major amount of distillates, thereafter progressively reducing the fresh feed rate, such that the increased amount of produced distillates, with respect to the amount of distillates produced with the pre-existing fresh feed rate, be circulated in parts of the plant to be treated.

An embodiment includes a method wherein setting the feed rate includes, a reduction in the established feed rate of the plant to a value comprised between 40% and below 100% with respect to the design feed rate, followed by the introduction of the hydrocarbon-based fluid which comprises an introduction of first and/or the second hydrocarbon-based fluid(s) in an amount as to compensate up to the difference among the rate at which the plant is running and its design feed rate, and so as to manage up to the maximum allowable plant distillate flow rate or in any case the distillate flow rate applicable prior to the introduction of the first and/or the second hydrocarbon-based fluid(s), such as to run the plant at the flow rate resulting from the sum: [flow rate of reduced fresh feed]+[flow rate of the first and/or the second hydrocarbon-based fluid(s)], and wherein said flow rate is equal to or higher to the one prior to the reduction in feed rate.

An embodiment includes a method wherein the introduction of the hydrocarbon based fluid comprises introduction in the plant of a first and a second hydrocarbon-based fluid from separate sources, and which second hydrocarbon-based fluid joins and passes together with the first hydrocarbon-based fluid to a common treatment introduction point of the petroleum plant.

An embodiment includes a method wherein the treatment is carried out in a plant with a furnace and wherein the treatment increases a value setting for a furnace inlet temperature of the furnace existing at the point of initiation of the treatment (e.g., a final state before a treatment effect is applicable).

An embodiment includes a method wherein the treatment increases the plant distillation yield in a manner beyond the quantity derivable from an equal overall feed amount to the plant distillation source(s) at a point of treatment initiation.

An embodiment includes a method wherein the treatment reduces plant catalysts agglomeration and/or reduces coke formation on plant catalysts and/or reduces heavy compounds deposits, including coke, on plant catalysts and/or reduces differential pressure in a plant reactor containing a catalyst.

An embodiment includes a method wherein the hydrocarbon-based fluid used for the treatment is recovered or reused in a way selected from the group consisting of: i) routing as a blend component of a fuel/heavy oil; ii) routing to a crude tank; iii) routing to slop; iv) routing inside the petroleum plant containing the equipment which has (have) been treated; v) routing to another petroleum plant; and (vi) any combination or subcombination of (i) to (v).

An embodiment includes a method wherein the introduction of the hydrocarbon based fluid includes the introduction of one or both of a first hydrocarbon-based fluid and a second hydrocarbon fluid that is or are capable of solubilizing the deposits in said equipment to be cleaned essentially under near critical or supercritical conditions at the operating conditions of the plant.

An embodiment includes a method wherein the first hydrocarbon-based fluid contains one or more chemical products and said first hydrocarbon-based fluid and said chemical products are mixed in a proportion designed in order to be utilized in a solution form, and wherein said first hydrocarbon-based fluid forms the solvent of said chemical products.

An embodiment includes a method wherein, in the ratio solvent/chemical products varies in the range: solvent 70%-99.99%, chemical products 0.01%-30%.

An embodiment includes a method wherein the solvent coincides with the first hydrocarbon fluid and is "self-produced" and circulated inside the petroleum plant.

An embodiment includes a method wherein the treatment is carried out according to one of: i) once-through continuous injection of the first hydrocarbon fluid introduced in any part of the plant; ii) injection of the first hydrocarbon fluid introduced from outside of the plant and further introduced in any part of the plant, upstream a distillation column, which is thereafter distilled and introduced in any part of the plant; iii) self-production of the first hydrocarbon fluid produced by distillation at a certain feed rate, followed by the variation of fresh feed rate, the withdrawal of said hydrocarbon fluid from any part of the plant and the introduction of said distillate in any part of the plant; iv) introduction of the first hydrocarbon fluid according to one or more of the above points i), ii) and iii), and v) the introduction according to (iv) together with a second hydrocarbon fluid which is introduced simultaneously or subsequently said first hydrocarbon fluid.

An embodiment includes a method wherein the introduction of the hydrocarbon based fluid comprises the introduction of a first hydrocarbon fluid or the first and a second hydrocarbon fluid, and which first and/or second hydrocarbon fluid is or are selected from a group consisting of distillation products from crude oil originating from the petroleum plant and/or being anyway present in the petroleum plant, by being finished products, blending components of finished products, intermediate products or feed to the petroleum plant and are selected from the group consisting of: gasoline, diesel, gas oil, virgin naphtha, kerosene, reformed gasoline, pyrolysis gasoline, pyrolysis gas oil, light cycle oil from FCCU, decant oil from FCCU, methyl-tert-butyl-ether (MTBE), benzene, toluene, xylenes, cumene, methanol, cyclohexane, cyclohexanone, ethylbenzene, linear alkylbenzene (LAB), dimethylterephthalate, phtalic anhydride, styrene, tert-amyl-methyl-ether (TAME), ethanol, dimethylformamide (DMF), dioctylphthalate, isopropyl alcohol, butyl alcohol, allyl alcohol, butylglycol, methylglycol, ethyl-tert-buthyl-ether (ETBE), ethanolamines, acetone, octyl alcohol, methyl-ethyl-ketone (MEK), methyl-isobutyl-ketone (MIBK), crude oil, fuel oil, quench oil from Ethylene Unit, aromatic gasoline from Reforming Unit, benzene/toluene/xylenes (BTX) as produced by an Aromatic Extraction Unit (inclusive. of the Sulfolane, Furfural, Glycols or Formylmorpholine type), the gasoline and/or the gas oil produced in an Ethylene Unit (pyrolysis gasoline/gas oil).

An embodiment includes a method wherein the first and/or the second hydrocarbon fluid is or are used in combination with one or more compounds, as a standalone or mixture thereof, selected from the group consisting of: polymetacrylates, polyisobutylene succinimmides, polyisobutylene succinates; laurylacrylate/hydroxyethylmetacrylate copolymer; alkylarylsulfonates, alcanolamine-alkylarylsulfonates and alkylarylsulfonic acids; substituted amines, where the substituent is an hydrocarbon containing at least 8 carbon atoms; acylated compounds containing nitrogen and having a substituent with at least 10 aliphatic carbon atoms, such substituent being obtained by reaction of an acylant carboxylic acid with at least an aminic compound containing at least a group—NH—, said acylant agent being joined to said aminic compound by way of a imido, amido, amidine or acyloxyammonium bridge; nitrogen containing condensated compounds of a phenol, an aldehyde or an aminic compound, having at least a group —NH—; esters of a substituted carboxylic acid; hydrocarbyl substituted phenols; alcoxylated derivatives of an alcohol, a phenol or an amine; phthalates; organic phosphates; oleic acids esters; diethylhydroxylamine; glycols and/or their derivatives, said glycols and/or their derivatives being not in a polymeric form, in the sense that they are molecules of single compounds, also in an adduct form, and not molecules constituted by a chain where a single monomer is repeated, e.g.: tetraethyleneglycol; mono- and di-ethers, mono- and di-esters, ether-esters and thioethers of single glycols; glycol of general formula CH2OH—(CH)nOHn-CH2OH where n=0-10; glycol ethers of general formula R1-O—CH2-CH2-O—R2 where R1 is an hydrocarbyl substituent C1-C20 and R2 is H atom or an hydrocarbyl substituent C1-C20; glycol esters of general formula R1-O—O—CH2-CH2-O—O—R2 where R1 is an hydrocarbyl substituent C1-C20 and R2 is H atom or an hydrocarbyl substituent C1-C20; thioglycols of general formula HO—R1-S—R2-OH where R1 is an hydrocarbyl substituent C1-C10 and R2 is H atom or an hydrocarbyl substituent C1-C10; glycol ethers-esters of general formula R1-O—CH2-CH2-O—O—R2 where R1 and R2 are an hydrocarbyl substituent C1-C20; ethers of general formula R1-O—R2 where R1 or R2 is an hydrocarbyl substituent C1-C20; substituted benzenes of general formula where n=1-6 and R can be indifferently H atom, —OH group, —COOH group, —CHO group, —NH2 group, —HSO3 group, the same or different hydrocarbyl substituent C1-C30; ketons of general formula R1-CO—R2 where R1 or R2 is an hydrocarbyl substituent C1-C20; anhydrides of general formula R1-CO—O—CO—R2, included those where R1 and R2 are bound together to form cyclic anhydrides, where R1 or R2 is an hydrocarbyl substituent C1-C20; amides of general formula where R, R1, R2 are indifferently H atom or an hydrocarbyl substituent C1-C20; heterocyclic compounds, preferably of the hydrogenated type, containing from 0 to 3 hydrocarbyl substituent C1-C20; heterocyclic compounds selected from the group consisting of: furans, pyrrols, imidazoles, triazoles, oxazoles, thiazoles, oxadiazoles, pyranes, pyridine, pyridazine, pyrimidine, pyrazine, pyperazine, piperidine, triazines, oxadiazines, morpholine, indane, indenes, benzofuranes, benzothiophenes, indoles, indazole, indoxazine, benzoxazole, anthranile, benzopyrane, coumarines, quinolines, benzopyrones, cinnoline, quinazoline, naphthyridine, pyrido-pyridine, benzoxazines, carbazole, xanthene, acrydine, purine, benzopyrroles, benzothiazoles, cyclic amides, benzoquinolines, benzocarbazoles, indoline, benzotriazoles; including all the possible compounds configurations, including the iso-form: e.g. the term "dithiols" is meant to include 1,2 dithiol and 1,3 dithiol, "quinolines" is mean to include quinoline and isoquinoline; the term "hydrocarbyl substituent" refers to a group having a carbon atom directly attached to the rest of the molecule and having a hydrocarbon or predominantly hydrocarbon character, as e.g. the hydrocarbon groups, including aliphatic, (e.g. alkyl or alkenyl), alicyclic (e.g. cycloalkyl or cycloalkenyl), aromatic, aliphatic- and/or alicyclic-substituted aromatic, condensated aromatic; aliphatic groups are preferably saturated, as e.g.: methyl, ethyl, propyl, butyl, isobutyl, pentyl, hexyl, octyl, decyl, octadecyl, cyclohexyl, phenyl, said groups may also contain non-hydrocarbon sustituents provided they do not alter the predominantly hydrocarbon character of the group, e.g. the groups selected from: keto, hydroxy, nitro, alkoxy, acyl, sulphonic, sulphoxid, sulphur, amino, said groups may also or alternatively contain atoms other than carbon in a chain or ring otherwise composed of carbon atoms, e.g. hetheroatoms selected from the group of: nitrogen, oxygen and sulfur. An embodiment of the method features the introduction of the hydrocarbon based treatment fluid by way of the introduction in the petroleum plant of a first hydrocarbon-based fluid in a ratio comprised between 0.1% and 100% with respect to current plant fresh feed and a second hydrocarbon-based fluid in a ratio comprised between 0.01% and 50% with respect to a curret plant fresh feed; and wherein the second hydrocarbon fluid is selected from the group consisting of: methanol, ethanol, propanol, isopropanol, butanol, isobutanol, methylglycol monomethylether, butylglycol monobutylether, toluene, aliphatic amines C8<+> ethoxylated with at least 6 moles ethylene oxide, arylsulfonates, benzene, diphenyl, phenanthrene, nonylphenol, 1-methyl-2-pyrrolidinone, diethyl ether, dimethylformamide (DMF), tetrahydrofuran (THF), ethylenediamine, diethylamine, triethylamine, trimethylamine, propylamine, 1-(3-aminopropyl)-2-pyrrolidone, 1-(3-aminopropyl)imidazole, N-hydroxyethyl-imidazolidinone, N-aminoethyl-imidazolidinone, 2-(2-aminoethylamino) ethanol, isopropylamine, cumene, 1, 3, 5 trimethylbenzene, 1, 2, 4 trimethylbenzene, maleic anhydride, p-toluidine, o-toluidine, dipropylamine, diphenyl ether, hexamethylbenzene, propylbenzene, cyclohexylamine, 1-isopropyl-4-methyl-benzene, 1, 2, 3, 5 tetramethylbenzene, hexanol, morpholine, o-xylene, m-xylene, p-xylene, butylamine, methylamine, mesitylene, examine, succinic anhydride, decahydronaphthalene, ethylbenzene, 1, 2 dimethylnaphthalene, 1, 6 dimethylnaphthalene, p-cymene, ethyl ether, isopropyl ether, etoxybenzene, phenyl ether, acetophenone, monoethanolamine (MEA), diethanolamine (DEA), triethanolamine (TEA), diethyleneglycol, triethyleneglycol, tetraethyleneglycol, hexyl glycol, dodecylbenzene, lauryl alcohol, myristyl alcohol, thiodiglycol, dioctylphthalate, diisooctylphthalate, didecylphthalate, diisodecylphthalate, dibutylphthalate, dinonylphthalate, methylethylketone (MEK), methylisobutylketone (MIBK), methyl-tert-butyl-ether (MTBE), cyclohexane, cyclohexanone, methyl- or ethyl-esters of fatty acids achieved by esterification of vegetal and/or animal oils (biodiesel); dimethylamine, ethylamine, ethyl formate, methyl acetate, dimethylformamide (DMF), propanol, propylamine, isopropylamine, trimethylamine, tetrahydrofuran (THF), ethyl vinyl ether, ethyl acetate, propyl formate, butanol, methyl propanol, diethyl ether, methyl propyl ether, isopropyl methyl ether, diethyl sulfide, butylamine, isobutylamine, diethylamine, diethylhydroxylamine, cyclopentanol, 2-methyltetrahydrofuran, tetrahydropyran, pentanal, isobutyl formate, propyl acetate, pentanoic acid, butyl methyl ether, tert-butyl methyl ether, ethyl propyl ether, methylpyridines, methylcyclopentane, cyclohexanol, hexanal, pentyl formate, isobutyl acetate, 2-ethoxyethyl acetate, methyl pentyl ether, dipropyl ether, diisopropyl ether, hexanol, methyl pentanols, triethylamine, dipropylamine, diisopropylamine, benzaldehyde, toluene, cresols, benzyl alcohol, methylanilines, dimethylpyridines, furfural, pyridine, methylcyclohexane, heptanol, acetophenone, ethylbenzene, xylenes, ethylphenols, xylenols, anilines, dimethylaniline, ethylaniline, octanenitrile, ethyl propanoate, methyl butanoate, methyl isobutanoate, propyl propanoate, ethyl 2-methyl propanoate, methyl pentanoate, heptanoic acid, octanoic acid, 2-ethylhexanoic acid, propyl 3-methylbutanoate, octanoles, 4-methyl-3-heptanol, 5-methyl-3-heptanol, 2-ethyl-1-hexanol, dibutyl ether, di-tert-butyl ether, dibutylamine, diisobutylamine, quinoline, isoquinoline, indane, cumene, propylbenzene, 1,2,3-trimethylbenzene, 1,2,4,-trimethylbenzene, mesitylene, o-toluidine, N,N-dimethyl-o-toluidine, nonanoic acid, nonanols, naphthalene, butylbenzene, isobutylbenzene, cymenes, p-diethylbenzene, 1,2,4,5-tetramethylbenzene, decahydronaphthalene, decanoic acid, decanol, 1-methylnaphthalene, carbazole, diphenyl, hexamethylbenzene, dodecanols, diphenylmethane, tridecanols, tetradecanols, hexadecanols, heptadecanols, terphenyls, octadecanols, eicosanols; fatty amines and their mixtures, p-toluidine, toluene, dipropylamine, diisobutyl acetate, propyl acetate, propyl-ethyl-ether, triethylamine, ethylbenzene, propylbenzene, butylbenzene, cumene, para-xylene, hexamethylbenzene, triethanolamine, diphenylmethane, MTBE, dioctylphthalate, diisodecylphthalate, diisoctylphthalate, nonylether, methyloleate, dioctylether; the compounds named in plural refer to all possible isomers of said compound: e.g. the term "xylenes" indicated o-xylene, m-xylene, p-xylene; said compounds can also be used under supercritical conditions.

An embodiment features the second hydrocarbon fluid as comprising one or more compound(s) working as swelling agent selected from those forming hydrogen bonds and those not forming hydrogen bonds, wherein the swelling agents not forming hydrogen bonds are selected from the group consisting of: benzene, toluene, cyclohexane, naphthalene, diphenyl, xylene, tetraline, methylcyclohexane; and wherein the swelling agents forming hydrogen bonds are selected from the group consisting of: pyridine, methanol, ethanol, ethylenediamine, propanol, 1,4-dioxane, acetone, formamide, aniline, tetrahydrofuran, N,N-dimethylaniline, diethylether, dimethylsulphoxyde, acetophenone, dimethylformamide, ethyl acetate, methyl acetate, methylethylketone, 1-methyl-2-pyrrolidone, quinoline.

An embodiment features the introduction of the hydrocarbon based treatment fluid as including the introduction in the petroleum plant of a first hydrocarbon-based fluid in a ratio comprised between 0.1% and 100% with respect to current plant fresh feed and a second hydrocarbon-based fluid in a ratio comprised between 0.01% and 50% with respect to a current plant fresh feed; and wherein the second hydrocarbon fluid comprises one or more compound(s) having a boiling temperature >150° C. selected from the group selected of: anthraquinone, eicosanol, benzalacetophenone, benzanthracene, hydroquinone, dodecylbenzene, hexaethylbenzene, hexamethylbenzene, nonylbenzene, 1,2,3-triaminobenzene, 1,2,3-trihydroxybenzene, 1,3,5-triphenylbenzene, diphenylmethanol, p-benzidine, benzil, 2-benzoylbenzofurane, benzoic anhydride, 2-benzoyl-methyl benzoate, benzyl benzoate, 4-tolyl benzoate, benzophenone, 4,4'-bis (dimethylamino) benzophenone, 2,2'-dihydroxybenzophenone, 2,2'-dimethylbenzophenone, 4,4'-dimethylbenzophenone, methylbenzophenone, 2-amino benzyl alcohol, 3-hydroxy benzyl alcohol, a-1-naphthyl benzyl alcohol, benzyl-ethyl-phenyl-amine, benzylaniline, benzyl ether, phenylacetophenone, 2-acetamide diphenyl, 2-amino diphenyl, 4,4'-bis(dimethylamino) diphenyl, biphenol, butyl-bis(2-hydroxyethyl)amine, butylphenylamine, butylphenylketone, carbazole, diphenylcarbonate, cetyl alcohol, cetylamine, benzylcinnamate, coumarin, lindane, dibenzofuran, dibenzylamine, diethylene glycol dibenzyl ether, diethylene glycol monolaurate, diethylene glycol (2-hydroxypropyl) ether, diethylenetriamine, di-α-naphthylamine, di-β-naphthylamine, dioctylamine, diphenylamine, diphenylmethane, 4,4'-diamino diphenyl, 4,4'-dimethylamino diphenyl, 4-hydroxy diphenyl, diphenylmethanol, diphenylethylamine, di-(α-phenylethyl)amine, di-iso-propanolamine, di-2-tolylamine, eicosanol, 1,1,2 triphenylethane, ethylene glycol 1,2 diphenyl, ethyl-di-benzylamine, ethylene glycol monobenzyl ether, ethylene glycol monophenyl ether, N,N-diphenylformamide, phenylformamide, tolylformamide, 2-benzoylfurane, 2,5 diphenylfurane, glycerine and related esters, heptadecylamine, heptadecanol, cetyl alcohol, hexadecanamine, cethylic alcohol, hydroxyethyl-2-tolylamine, triethanolamine, cyclohexanone, imidazole, methylimidazole, phenylimidazole, 5-amino-indane, 5-hexyl-indane, 1-phenyl-1,3,3-trimethyl-indane, 2,3 diphenyl-indene, indo le, 2,3 dimethyl-indole, tryptamine, 2-phenyl-indole, isocoumarin, diethyl-isophthalate, isoquinoline, benzyl laurate, phenyl laurate, lauryl alcohol, lauryl amine, lauryl sulphate, diethyl-benzyl-malonate, melamine, diphenylmethane, triphenylmethane, 4-benzyl-morpholine, 4-phenyl-morpholine, 4-(4-tolyl)-morpholine, myristic alcohol, 9,10-dihydronaphthacene, acethyl-naphthalene, benzyl-naphthalene, butyl-naphthalene, dihydro-naphthalene, dihydroxy-naphthalene, methyl-naphthalene, phenyl-naphthalene, naphthol, naphthlamine, methyl-naphthylamine, naphthylphenyl amine, α-naphthyl-2-tolyl-ketone, nonacosanol, octadecanol, octyl-phenyl-ether, pentadecylamine, pentadecanol, 3-hydroxyacetophenone, tyramine, 4-hydroxyphenylacetonitrile, o-phenylenediamine, N-phenyl-phenylenediamine, 4-methyl-phenylenediamine, diphenylether, bis-(2-phenylethyl)amine, phosphine derivatives as phenyl, triphenyl and oxide, triphenylphosphite, dibutyl phthalate, dibenzyl phthalate, diethyl phthalate, dioctyl phthalate, diisoctyl phthalate, didecyl phthalate, diphenyl phthalate, phthalic anhydride, N-benzoylpiperidine, 1,3-diphenoxypropane, N-(2-tolyl) propionamide, 1-methyl-3-phenyl-pyrazoline, pyridine derivatives as 3-acetamido, 3-benzyl, 4-hydroxy, 2-phenyl, phenylsuccinic anhydride, succinimide, N-benzylsuccinimide, N-phenylsuccinimide, o-terphenyl, m-terphenyl, 1,14 tetradecanediol, tetradecanol, tetraethyleneglycol, tetraethylenepentamine, 2,5-diaminotoluene, 3,5-dihydroxytoluene, 4-phenyltoluene, p-toluenesulfonic acid and related methyl and propyl esters, o-toluic acid and related anhydride, N-benzyl-toluidine (o-, m-e p-), tribenzylamine, tributylamine, triethanolamine, tryethyleneglycol and related monobutylether, triheptylamine, trioctylamine, triphenylamine, tritane, tritanol, 2-pyrrolidone, xanthene, xanthone, xylidine.

An embodiment of the method of the invention further comprises monitoring treatment level and wherein the monitoring is performed with one or more analysis method selected from the group consisting of: viscosity (e.g. ASTM D 445); density (e.g. ASTM D1298); atmospheric or vacuum distillation (e.g. ASTM D86, D1160); carbon residue (e.g. ASTM D4530, D 189); sediments by hot filtration (e.g. IP 375, 390); sediments by extraction (e.g. ASTM D473); sedimenti by filtration (e.g. ASTM 4807); ash (e.g. ASTM D482, EN6245); asphaltene (e.g. IP143), color (e.g. ASTM D1500), water and sediments (e.g. ASTM D2709, D1796); or an analysis method of the physical type, selected from the group consisting of: i) evalutation of the fouling factor, defined as the ratio among the heat transfer coefficient of clean equipment and the heat transfer coefficient of the equipment at the time when the value is recorded; ii) evalutation of pressure in various points of the plant; iii) evalutation of temperature in various points of the plant.

An embodiment of the invention includes a method and means for carrying out the additional following steps to achieve gas free/safe entry conditions:

a) suspension of feed introduction;

b) optional circulation in a closed or semi-closed loop of the first and/or second hydrocarbon fluid inside the equipment to be treated, for a time of at least 20 minutes, at a temperature comprised between 100° C. and 900° C. and at a pressure comprised between 1 bar and 400 bar;

c) cooling of the equipment/plant;

d) emptying of the equipment/plant from all of the hydrocarbons;

e) introduction of water inside the equipment/plant;

f) implementing a closed circulation loop encompassing the equipment/plant;

g) introduction in the closed circulation loop of one or more chemical washing/cleaning products and their mixtures;

h) setting up the temperature and the pressure inside the closed circulation loop at values comprised between 60° C. and 350° C. and between 1 bar and 50 bar;

i) circulation of the water solution of the chemical product(s) inside the closed circulation loop under conditions of temperature and pressure comprised between 60° C. and 350° C. and between 1 and 50 bar, for a time comprised between 20 minutes and 60 days;

j) cooling (including the eventual introduction of fresh water in the loop) and emptying of the loop from the water solution;

k) optional routing of the water solution to the oily water treatment plant;

l) optional repeating of the steps from e) to k).

An embodiment of the invention features a method and suitable means for carrying the method that is represented by replacing the steps from e) to k) by the steps:

m) introduction inside of the apparatus/plant of steam at a pressure comprised between 1.5 bar and 100 bar;

n) introduction in said steam of one or more washing/cleaning chemical product(s) including their mixtures;

o) introduction inside of the equipment/plant of the mixture steam/chemical product(s) according to present invention, for a time of at least 20 minutes, p) optional circulation of condensed steam, containing a chemical product according to present invention;

q) emptying of condenses from the equipment/plant;

r) optional routing of condenses to the oily water treatment plant;

An embodiment of the invention features a method wherein the chemical product used for washing/clearing under any of the above described compatible method techniques is selected from the group consisting of: non-ionic surfactants, anionic surfactants, terpenes derivatives, emulsifiers, hydrogen sulphide scavengers, mercury scavengers and their mixtures in any proportion, including their aqueous solutions.

An embodiment of the invention further features, relative to, for example, any of the above described compatible techniques, anionic and non-ionic surfactants that are selected from the group consisting of: alkyl-, aryl-, or alkylaryl-benzensulphonates of general formula $RC_6H_4SO_3M$ wherein R is an hydrocarbyl substituent $C_8$-$C_{20}$ and M is the ion H, Na, Ca, ammonium, triethanolammonium, isopropylammonium; dialkylsulfosuccinates of general formula $RO_2CCH_2CH(SO_3Na)CO_2R$ wherein R is an hydrocarbyl substituent $C_2$-$C_{20}$; alkylsulfates of general formula $ROSO_3M$ wherein R is an hydrocarbyl substituent $C_5$-$C_{20}$ and M is the ion sodium, ammonium, triethanolammonium; ethoxylated and sulphated alcohols of general formula $R—(—OCH_2CH_2)_n—OSO_3M$ wherein R is an hydrocarbyl substituent $C_5$-$C_{20}$, n=1-5 and M is the ion sodium, ammonium, triethanolammonium; ethoxylated and sulphated alkyphenols of general formula $RC_6H_6—(—OCH_2CH_2—)_n—OSO_3M$ wherein R is an hydrocarbyl substituent $C_5$-$C_{20}$, n=1-5 and M is the ion sodium, ammonium, triethanolammonium; ethoxylated alcohols of general formula $R—(—O—CH_2CH_2—)_n—OH$ wherein R is an hydrocarbyl substituent $C_5$-$C_{30}$, n=1-30; ethoxylated alkyl phenols of general formula $RC_6H_4(OCH_2CH_2—)_n—OH$ wherein R is an hydrocarbyl substituent $C_5$-$C_{30}$, n=1-40; mono- and di-fatty acids glyceric esters wherein acid contains an hydrocarbyl substituent $C_{10}$-$C_{40}$; mono- and di-polyoxyethylene esters of oils and fatty acids of general formula $RCO—(—OC_2H_4—)_n—OH$ and $RCO—(—OC_2H_4—)_n—OOCR$ wherein the oil is of the "tall oil" or "rosin oil" type, n=1-40 and the acid contains and hydrocarbyl substituent $C_{10}$-$C_{40}$; ethoxylated "castor oils" (castor oil is a triglyceride abundant in ricinoleic esters) containing a number of polyethoxylated ethylene oxide groups variable between 5 and 200; mono- and di-ethanolamides of fatty acids of general formula $RCONHC_2H_4OOCR$ and $RCON(C_2H_4OH)C_2H_4OOCR$ wherein R is an hydrocarbyl substituent $C_{10}$-$C_{40}$; surfactants of poly(oxyethylene-co-oxypropylene), also known as block polymer, having molecular weight of 50-10000; mono-, di- and poly-aliphatic amines derived from fatty acids, such as $RNHCH_2CH_2CH_2NH_2$ wherein R is an hydrocarbyl substituent $C_{10}$-$C_{40}$; N-alkyltrimethylendiamines of general formula

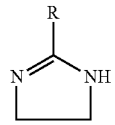

wherein R is an hydrocarbyl substituent $C_{10}$-$C_{40}$; 2-alkyl-2-imidazolines of general formula

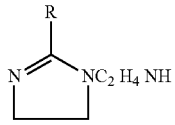

wherein R is an hydrocarbyl substituent $C_{10}$-$C_{40}$; amine oxides of general formula $RNO(CH_3)_2$ and $RNO(C_2H_4OH)_2$ wherein R is an hydrocarbyl substituent $C_1$-$C_{20}$; ethoxylated alkylamines of general formula

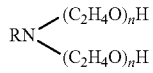

wherein m+n=2-40; 2-alkyl-1-(2-hydroxyethyl)-2-imidazolines of general formula

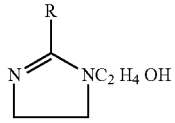

wherein R is an hydrocarbyl substituent $C_{10}$-$C_{40}$; alkoxylated ethylendiamines of general formula

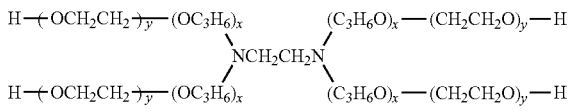

wherein x and y=4-100;

terpenic products derivatives are selected from the group consisting of: limonene, pinene, canfor, menthol, eucalipthol, eugenhol, geraniol, thymol; emulsifiers are selected from the group consisting of: Tween 60, Tween 80, nonyl phenol polyethylene glicol ether, oleates, sorbitan oleates, glycerol monostearate, nonyl phenol ethoxylates, iso-propyl palmitate, polyglycerol esters of fatty acids, tridecyl alcohol ethoxylates, fatty alcohol ethoxylates, linear alkyl benzene sulphonic acid, dioctyl phthalate, sodium tripolyphosphate, citric acid, soybean oleic acid, trisodium phosphate, sodium dodecyl sulfate, didecyl dimethyl ammonium chloride, oleic acid diethanolamine, dodecyl dimethyl benzil ammonium chloride, sodium acetate, oleamide, polyethylen glycol, lanolin, ethoxylated (E20) sorbitan monooleate, sorbitan monooleate, sulfosuccinammates; $H_2S$ scavengers are selected from the group consisting of: diethanolamine, monoethanolamine, methyl-diethanolamine, diisopropylamine, formaldehyde, maleimides, amidines, polyamidines, glyoxal, sodium nitrite, reaction products of polyamide-formaldehyde, triazines, carboxamides, alkylcarboxyl-azo compounds, cumine-peroxide compounds, bisoxazolidines, glycidyl ethers, potassium formate; mercury scavenger are selected from the group consisting of: thiourea, caustic soda, sodium carbonate, trimercapto-s-triazine trisodium salt.

An embodiment includes a petroleum plant apparatus to perform a method according to any one or more of the compatible method embodiments described above, comprising: i) withdrawal means from one or more point(s) in the petroleum plant of one or more hydrocarbon fluid(s); ii) introduction means of said one or more hydrocarbon fluid(s) as above withdrawn into one or more point(s) of the petroleum plant; iii) distillation means of said one or more hydrocarbon fluid(s) as above introduced into one or more point(s) of the petroleum plant; iv) re-withdrawal and re-introduction means of said one or more hydrocarbon fluid(s) as above distilled to re-withdraw said distilled fluid(s) and re-introduce it (them) into one or more point(s) of the petroleum plant, wherein said re-withdrawal and re-introduction means can be the same withdrawal and introduction means as above; v) connection means in order to form a closed or semi-closed loop, encompassing the equipment to be treated, wherein said one or more hydrocarbon fluid(s) will be continuously distilled, withdrawn and introduced; vi) a discharge system of the hydrocarbon fluid(s), to allow their removal from the closed or semi-closed loop; vii) control means, to control or regulate temperature and/or pressure and/or flowrate; viii) optional filtration means.

An apparatus embodiment inclusive of set ups for the above described apparatus embodiment and compatible method technique features:

one or more withdrawal point(s) of a distillate or mixtures of distillates;

one or more introduction point(s) of a distillate or mixtures of distillates, as previously withdrawn;

one or more introduction point(s) of a first and/or second hydrocarbon fluid;

one or more pump(s) connected to said withdrawal point(s) of distillate(s) and/or of the product(s) exiting the plant, having sufficient characteristics to introduce said distillate(s) and/or said product(s) exiting the plant in the closed or semi-closed circulation loop and/or in one or more selected point(s) of the plant, said pump(s) being already part of said petroleum or chemical plant, or installed on purpose, or in mobile and/or temporary execution;

an inlet system of a hydrocarbon fluid or mixtures of hydrocarbon fluids, to allow the introduction of said hydrocarbon fluid(s) in the closed or semi-closed loop;

one or more lines and/or connection systems to close the closed or semi-closed loop comprising the withdrawal point(s) and/or introduction point(s) of the distillate(s), the pump(s) and the equipment, having sufficient characteristics to circulate said distillate(s) and/or said product exiting the plant inside the closed or semi-closed loop and/or in one or more selected point(s) in the plant, said lines and/or connections being already part of said petroleum or chemical plant, or installed on purpose, or in mobile and/or temporary execution;

a discharge system of the fluids, to allow their removal from the closed or semi-closed loop; gauges and/or controllers of temperature, pressure, flow rate; and valves and/or sectioning and/or non-return systems.

In an embodiment the withdrawal means is configured to withdraw one or more hydrocarbon fluid(s) having the following intervals of boiling points: a) up to 75° C.; b) from 75° C. to 175° C.; c) from 175° C. to 350° C.; d) above 350° C.; and wherein introduction means introduce it (them) in any one or more point(s) of the plant.

An embodiment of a petroleum plant apparatus that is suited (but not limited to) enabling the performance of one or more of the above described, compatible method embodiments, features a distillate source wherein a distillate from said distillate source is withdrawn from a point within a closed or semi-closed loop forming at least a portion of said plant, and an entry point wherein there is introduced upstream of equipment to be treated the drawn off distillate and then redistilled to be thereafter re-withdrawn from the same point and re-introduced in the same equipment to be treated for a time necessary to treat said equipment.

An embodiment of a petroleum plant apparatus that is suited (but not limited to) enabling the performance of one or more of the above described, compatible method embodiments, features withdrawal means that are located in one or more point(s) of the plant that is(are) selected from the group consisting of:

- suction/discharge of the produced gasoline pump;
- suction/discharge of the overhead reflux pump;
- suction/discharge of one or more bottom/middle/top pumparound pump(s);
- suction/discharge of the produced kerosene pump;
- suction/discharge of the produced gas oil pump;
- suction/discharge of any distilled hydrocarbon pump;
- hydrocarbon line exiting any petroleum apparatus;
- suction/discharge of the crude oil booster pump at desalter outlet;

wherein introduction means are located in one or more point(s) of the plant selected from the group consisting of:

- suction/discharge of the plant feed pump;
- suction/discharge of the crude oil booster pump at desalter outlet;
- suction/discharge of a column bottom pump;
- suction/discharge of the heavy gas oil pump;
- inlet of the preheat train;
- inlet of the equipment to be treated;
- distillation residue line, upstream/downstream of any heat exchanger;
- column bottom;

in a pump external of the plant, being part of another plant or installed on purpose, in temporary or permanent execution;

wherein distillation means are located in one or more point(s) of the petroleum plant selected from the group consisting of:
atmospheric distillation column;
vacuum distillation column;
extractive distillation column;
and wherein the withdrawal point(s) and the introduction point(s) of said one or more hydrocarbon fluid(s) are connected to form a closed or semi-closed loop.

An embodiment of the invention includes a method of designing a plant that is suited (but not limited to) providing the performance of one or more of the above described, compatible treatment method embodiments, and features a plant design wherein plant equipment that is subject to treatment is designed under not conservative conditions, wherein there is avoided inputting into the equipment a greater than 20% fouling factor (e.g., having a fouling factor level of 0 to less than 20%) as well as the avoidance of the presentment of any fouling back up equipment in the plant design in the relevant area (e.g., in the closed or semi-closed loop).

An embodiment of the invention includes a method of manufacturing of a plant comprising rendering into a physical plant based on a plant design wherein the equipment subject to treatment is designed under not conservative conditions, wherein there is avoided inputting into the equipment a greater than 20% fouling factor (e.g., having a fouling factor level of 0 to less than 20%) as well as the avoidance of the presentment of any fouling back up equipment in the plant design such as in the relevant treatment area described above.

An embodiment of the invention includes having the treated equipment feature a surface from 0.1% to 100% lower with respect to a non-treated equipment.

An embodiment of the invention features a method for treating a petroleum plant or equipment of the petroleum plant during a running of the petroleum plant, comprising: maintaining, during a treatment period, the petroleum plant under a production operating condition, typical of the plant itself, while providing fresh feed to the petroleum plant; while maintaining the petroleum plant under the production operating condition, introducing in the petroleum plant, during the treatment period, a hydrocarbon-based treatment fluid; and adjusting of the fresh feed by increasing the plant fresh feed rate from an established feed rate to a level above the established feed rate as to generate an additional quantity of distillates relative to a quantity generated at the established feed rate, and drawing off at least some of an overall quantity of distillate generated from the increased plant feed rate and introducing the drawn off distillate into a treatment region of said plant for enabling the cleaning of heavy deposits from one or more pieces of equipment in the treatment region.

An embodiment of the invention further comprises passing drawn off distillate, such as the drawn off or withdrawn distillate described herein, through a closed or semi-closed loop forming at least a portion of said plant and extending through the treatment region, and wherein said closed or semi-closed loop of said plant is configured such that drawn off distillate is re-introduced into a distillation device of the plant which is a source of the initially drawn off distillate and drawing off a recirculation output of distillate from said distillation device following receipt of the re-introduced drawn off distillate and passing the recirculation output of distillate to a treatment region(s).

An embodiment of the invention further comprises a method wherein the petroleum plant runs at increased feed or at the design feed rate (or higher), so as to produce a major amount of distillates, thereafter progressively reducing the fresh feed rate, such that the increased amount of produced distillates, with respect to the amount of distillates produced with the pre-existing fresh feed rate, be circulated in parts of the plant to be treated.

An embodiment of the invention further comprises a method, such as for any of the compatible methods described above, wherein adjusting the feed rate includes an initial reduction in the established feed rate of the plant to a value comprised between 40% and below 100% with respect to the design feed rate, followed by the introduction of the hydrocarbon-based fluid which comprises an introduction of first and/or the second hydrocarbon-based fluid(s) in an amount as to compensate up to the difference among the rate at which the plant is running and its design feed rate, and so as to manage up to the maximum allowable plant distillate flow rate or in any case the distillate flow rate applicable prior to the introduction of the first and/or the second hydrocarbon-based fluid(s), such as to run the plant at the flow rate resulting from the sum: [flow rate of reduced fresh feed]+[flow rate of the first and/or the second hydrocarbon-based fluid(s)], and wherein said flow rate is equal to or higher to the one prior to the reduction in feed rate.

Additional aspects and embodiments will be evident by reading the following invention detailed description.

DETAILED DESCRIPTION OF THE INVENTION

Figure 1:
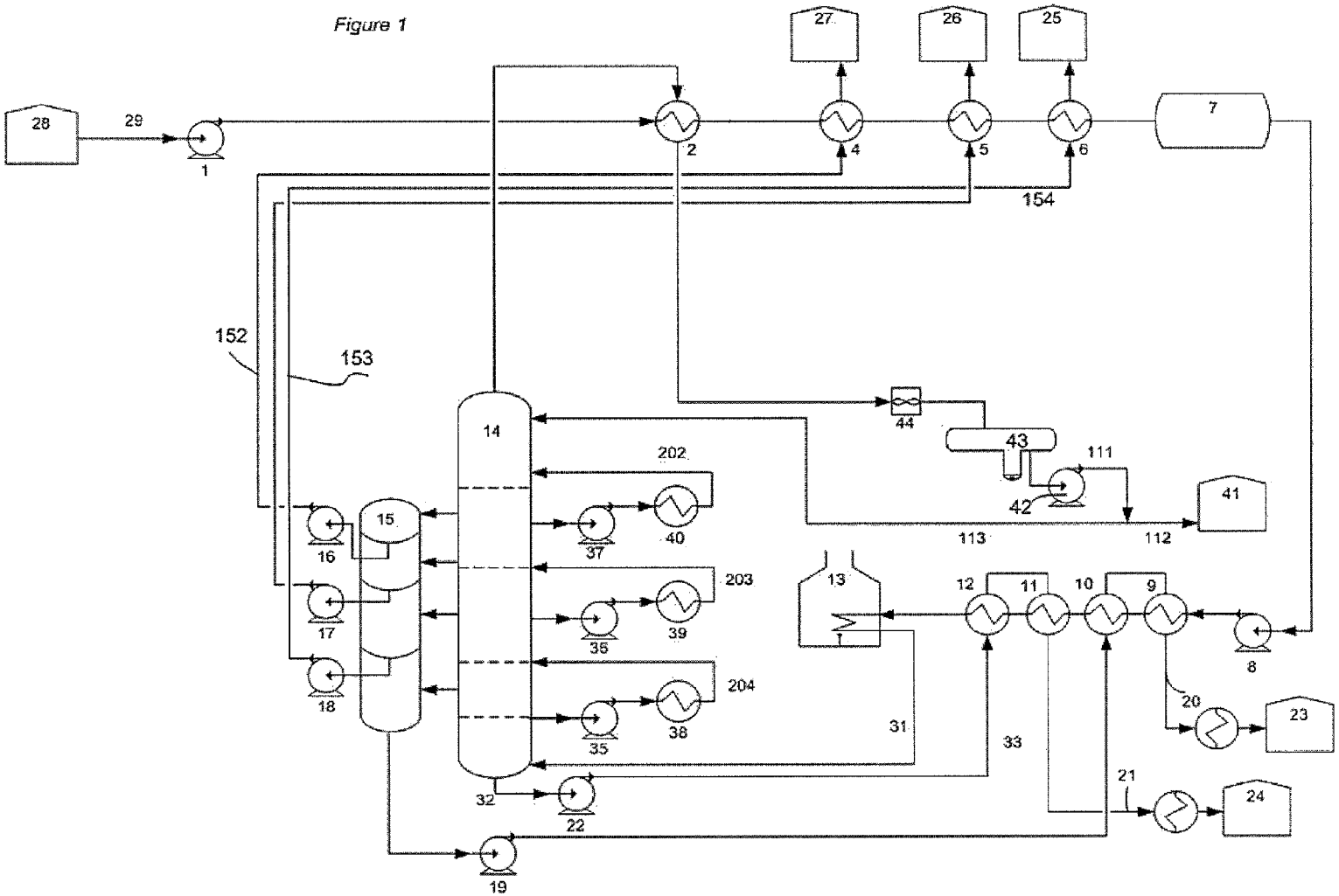
FIG. 1 is an exemplary schematic diagram of a conventional Crude Distillation Unit.

By realizing a closed or semi-closed circulation loop of one or more chemical product(s) admixed with one or more hydrocarbon fluids introduced and/or self-produced in the petroleum plant under the present invention, at temperature and pressure conditions under the present invention, under the method of the present invention, the solubilization or the modification of a not pumpable product (which is fouling the equipment and is originating from a heavy compound) into a pumpable product is realized. Said heavy compound is therefore removed from said equipment by simply pumping out the solution which contains it in a soluble or modified form. In such a way the equipment is cleaned without the need of decommissioning or without the need of stopping its production process, thereby realizing improvements over the state of the art which are addressed by way of the present invention.

In the description that follows, numerous specific details are set forth by way of example for the purposes of explanation and in the furtherance of teaching one skilled in the art to practice the invention. It will, however, be understood that the invention is not limited to the specific embodiments disclosed and discussed herein and that the invention can be practiced without such specific details and/or substitutes therefore. The present invention is limited only by the appended claims and may include various other embodiments which are not particularly described herein which remain within the scope and the spirit of the present invention.

Under the present invention the term "self-produced" defines a hydrocarbon fluid which is introduced and/or distilled in the petroleum plant, hence withdrawn from any plant location and re-introduced in any plant location, preferably upstream of the withdrawal point; subsequent to said re-introduction, said hydrocarbon fluid will, in embodiments of the invention, be distilled and hence withdrawn and re-introduced as above specified, thereby creating an introduction/distillation/withdrawal/re-introduction cycle wherein a "fresh" hydrocarbon fluid will not be introduced, but the same circulating hydrocarbon fluid will be used, as generated during the circulation.

A cleaning (or treating) method of petroleum equipment, being part of any production plant, under an embodiment of the present invention comprises the following steps:

1. keeping the petroleum plant under production operating conditions, typical of the plant itself, with the fresh feed inserted and production of products typical of the plant itself;
2. introducing in said petroleum plant a first hydrocarbon-based fluid in a ratio comprised between 0.1% and 100% with respect to a current fresh feed;
3. optionally introducing in said plant a second hydrocarbon-based fluid in a ratio comprised between 0.01% and 50% with respect to a current fresh feed;
4. optionally implementing a closed or semi-closed circulation loop inside said plant, wherein one or more distillates and/or products exiting the plant can be withdrawn, thereby including the possibility of implementing a tailor made withdrawal system from any point of the petroleum plant, and introducing the same inside the apparatus(es) to be cleaned (treated);
5. optionally circulating in a closed or semi-closed loop the first and/or the second hydrocarbon-based fluid(s) inside the apparatus(es) to be cleaned (treated), such that a portion of the products distilling during said circulation are re-introduced in said closed or semi-closed loop, whereas another portion of the distillates make up the petroleum plant production and/or the normal flow streams;
6. optionally circulating in a closed or semi-closed loop the first and/or the second hydrocarbon-based fluid(s) inside the apparatus(es) to be cleaned (treated), for a time of at least 20 minutes, at a temperature comprised between 100° C. and 900° C. and at a pressure comprised between 1 bar and 400 bar;
7. monitoring the cleaning (treatment) operations according to the method of the present invention;
8. optionally repeating the steps from 2 to 7 (preferably with the conditions of step 1 still met during the one or more repeats);
9. optionally opening the closed or semi-closed loop, such that the fluids of steps from 2 to 7 can be removed from the petroleum plant by utilizing the normal production cycle.

For embodiments of the present invention, non limiting examples of a treatment feed rate represented by a combination of a current fresh feed (utilized in a plant running in a normal mode) as well as added introduced hydrocarbon based treatment fluid can be seen by examples (a) (b), described below (or a combination of the same):

a) current fresh feed plus introduced first and/or second hydrocarbon based fluid(s), such as from an external source inclusive of a source tank in line with the plant, an upstream different plant feed, a downstram different plant feed; a mobile source, etc.; and/or
b) a treatment rate component as in one resulting from an increase in feed rate from an established feed rate existing at initiation of the treatment method to a new "raised-to-rate" level (e.g., one greater than a design feed rate), together with a self-production of distillates which are withdrawn (e.g., drawn off), introduced and circulated, followed, for example, by a reduction in the current "raised to" feed rate to a desired treatment feed rate (inclusive of any current fresh feed rate plus the added introduced distillate(s), with or without input from (a) above) which treatment feed rate can be, for example, lower than the "raised-to-rate" as well as above, at, or below the design feed rate.

Chemical products or mixtures of chemical products making up the hydrocarbon fluids under the present invention can be used as such at any proportion, or can be dissolved at any proportion in an appropriate hydrocarbon solvent, so as to be used as a solution.

As used in the present invention the terms "chemical product" or "chemical products" can refer to either a single chemical product or to a mixture of chemical products under the present invention and/or their solutions in any proportion with an appropriate solvent and/or a hydrocarbon fluid under the present invention.

The recovery or reuse of washing fluids containing the chemical product(s) under the present invention and the solubilized/modified heavy compound, which was originally present in the equipment to be cleaned, can be done in different ways, such as: i) blending with fuel oil/heavy oil; ii) blending with crude; iii) blending with slop oil; iv) reprocessing in the same petroleum plant containing the equipment which has been cleaned; v) reprocessing in another petroleum plant. An additional advantage of the reuse/reprocessing of washing fluids is, besides all the environmental aspects, the ability to reuse the chemical product under the present invention in order to avoid additional equipment fouling arising during the normal run of the petroleum plant (when the present invention is not applied on a continuous basis).

In one preferred embodiment the present invention provides a method, an apparatus, one or more chemical product(s) and a monitoring system for the cleaning of, e.g.; heat exchangers; process furnaces; reactors and/or their catalysts; distillation tower internals, including trays and/or distributors and/or downcomers) and/or packings; lines; filters; vessels (including their internals); process pumps.

In still another preferred embodiment the present invention provides a method, an apparatus, one or more chemical product(s) and a monitoring system to increase the furnace inlet temperature of petroleum plants. As a matter of fact, plant furnaces are generally preceded by heat exchangers which are used to recover process heat and to raise as much as possible the furnace inlet temperature (FIT). When said exchangers (preheat exchangers) are fouled a reduction in FIT will occur, with related energy/economic/environmental losses. The cleaning of heat exchangers under the present invention allows for an increase in the FIT without the need of opening the heat exchangers and without the need of stopping the petroleum plant.

In another preferred embodiment the present invention provides a method, an apparatus, one or more chemical products and a monitoring system to increase the furnace run length of petroleum plants. As a matter of fact, plant furnaces are generally shutdown and decoking operations are performed, following fouling build-up inside the coils which increase the tube metal temperature (TMT) until the design limit is reached. Such fouling appears in the form of coke inside the coils. By cleaning the equipment during the run, the coke precursors, which arise from deposition of fouling material and which thereafter will degrade to coke, will be removed from the coils thereby avoiding coke build-up. The cleaning of one or more heat exchangers upstream of the furnace, under the present invention, also contributes to a lower firing of the furnace and to operations under a lower duty; this in turn will give an additional contribution toward a furnace run length increase.

In still another preferred embodiment the present invention provides a method, an apparatus, one or more chemical products and a monitoring system to clean internals of a petroleum plant. As used in the present invention the term "internals" refers to everything which is present inside the equipment of a petroleum plant and/or of its production process. As an illustrative and non-limitative example, the internals are made up of: catalysts, trays, distributors, packings, demisters, filters, heat exchangers surfaces, lines/piping surfaces, separators, corrugated plates/packings, columns surfaces, vessels surfaces, equipment surfaces, downcomers, feed inlet devices, etc.

In still another preferred embodiment the present invention provides a method, an apparatus, one or more chemical products and a monitoring system to increase distillation yield. As a matter of fact, the introduction of a first and/or a second hydrocarbon fluid causes an increase in distillation of light products (of greater value) in spite of the heavier ones (of lower value). Without being bound to any theory, yield increase can be attributable, to, for example, the following effects or their combination(s): a) better separation of the species contained in the feed, following a reduced entrainment of lighter products in the heavier ones; b) better separation of the species contained in the feed, following a better cleaning status of a distillation column (improved distillation efficiency); c) intrinsic effect of the first and/or second hydrocarbon fluid. Moreover, in the cracking processes (both thermal and catalytic) the action of the first and/or the second hydrocarbon fluid is that of improving the cracking in the same operating conditions, in spite of heavy compounds/coke formation. In such a connection the present invention also provides a method, an apparatus, one or more chemical products and a monitoring system to increase distillation yield in thermal/catalytic cracking processes and to reduce heavy compounds/coke formation on catalysts.

The normal production layout of a petroleum plant implies the introduction of a feed and the outlet of one or more distillation products, which are totally sent to storage and/or external delivery means and/or other petroleum plants for subsequent processing, thereby making up the feed, or a portion of the feed, of downstream plants. In no case are there introduced in a petroleum plant, during its run, any fluids which are different from the ones which normally make up its typical feed. Only and exclusively during the shutdown procedures of a petroleum plant, before setting the equipment out of service to perform subsequent maintenance operations, is "flushing" performed, typically with gas oil (sometimes with water). In such a case, during the flushing, in the plant there is introduced a "flushing oil", e.g., gas oil, which, by coming from a storage tank (not from the inside of the plant), enters the feed line, flows through the equipment and leaves the plant from the residue line. In such flushing operation, the gas oil enters and leaves the plant in the same quantity and no circulation is generally performed; flushing is therefore a once-through operation, which generally lasts 1-4 hours. Far more important, during such flushing no products' distillation occurs, as said operation is performed at a temperature lower than the initial boiling point of the flushing oil (e.g., light gas oil). As a matter of fact, flushing is performed during shutdown procedures in the phase of furnace temperature decrease; after the flushing is completed, the furnace is shut off and the petroleum plant is cooled down to allow subsequent maintenance operations. The flushing is an operation which is performed according to the following steps: a) stopping feed introduction; b) stopping plant production and reducing furnace outlet temperature; c) introducing gas oil and passing it through the equipment; d) a simultaneous download of the gas oil which has been introduced into the plant (once-through operation); e) sending the dirty gas oil to a storage tank; f) shutting off the furnace and cooling down the plant; g) opening the equipment for maintenance.

During flushing normally no circulation is performed inside the plant. In some cases, e.g., in the CDU, flushing is performed with water. Flushing operations have the only purpose of removing the soluble hydrocarbons which are inside the plant when it is shut down and has no effect on the removal of the heavy compounds (which generate fouling) from the equipment. Flushing only eases up emptying the plant before maintenance operations and mainly avoids, some hydrocarbons being left in the plant. When not removed, said hydrocarbons will solidify once the plant is cooled down (when shutting down the plant at ambient temperature), thereby making more difficult and longer both opening operations (e.g., exchangers' bundles extraction would become almost prohibitive) and starting-up operations (in the lines a solid would be left, which is difficult to remove during start-up operations). The final proof of flushing inefficacy on equipment cleaning is, at the end of flushing operations, equipment is opened and mechanically cleaned.

The normal run of a petroleum plant is typically performed at a feed rate equal to or very near the design one. When market conditions are unfavorable, the feed rate is reduced with respect to the design one; generally in such conditions the feed rate is reduced to 80-90% of the design one. The "technical minimum" feed rate is generally 50-60% of the design one. The technical minimum feed rate is the lower feed rate wherein the plant is running under regular conditions, by maintaining production conditions. For a feed rate lower than the technical minimum the plant gets blocked (e.g., all the logic controlling operations and safety systems are calculated for that) and the production is not possible. A plant runs at the technical minimum only under exceptional conditions, because running at the technical minimum is typically a net economic loss for the plant owner. It is worthy of mention, that all the fixed costs are the same, and yet production is lowered by 40-50%.

In an embodiment of the present invention the petroleum plant is already at the technical minimum, or is brought at the technical minimum, or the feed rate is reduced, or the plant is already running at a reduced rate, with respect to the design feed rate, with the precise scope to perform a cleaning operation. As a matter of fact, when running under technical minimum conditions or at a reduced feed rate, more space will be available inside the plant to introduce a major quantity of the first and/or second hydrocarbon fluid(s) under the present invention, thereby raising the cleaning (or treatment) performance. Differently stated, a major quantity and/or a major concentration of cleaning fluids will be inside the petroleum plant, while the plant is continuing production.

In an embodiment of the present invention the petroleum plant feed rate is reduced (or brought) to a value comprised between 40% and 100% with respect to the design feed rate. Preferably, the feed rate is reduced to the technical minimum. The first and/or second hydrocarbon fluid(s) is then introduced preferably at a quantity to compensate the difference among the current feed rate and (up to), for example, the design one, and such as to manage a distillate throughput up to the maximum (normally the design one) or, in any case, to manage a distillate throughput as the one before the feed rate reduction and the insertion of the first and/or second hydrocarbon fluid(s) under the present invention. For example, for an embodiment of the present invention wherein the plant feed rate is reduced (or brought) to a value between 40% and 100% with respect to the design feed rate, the first and/or second hydrocarbon(s) can be introduced in a compensation quantity of 0.1% to 60% (as well, for example, as any of the 0.1% intermediates between 0.1% to 60%) of the design feed rate in order to place the plant's treatment feed rate (with hydrocarbon(s) added) at the design rate (or higher). Alternate embodiments of the invention feature compensation quantities of the first and/or second hydrocarbon(s) that result in the plant's treatment feed rate being +/−60% of the design feed rate, or +/−30% of the design feed rate, or +/−20% of the design feed rate or at the design feed rate. In this embodiment the petroleum plant is therefore run at a rate resulting from the sum: (e.g., reduced fresh feed rate+first and/or second hydrocarbon fluid(s) rate). The equivalent distillates throughput as resulting from fresh feed distillation at the conditions preexisting the application of the present invention will be sent to the downstream plants or to storage; the equivalent distillates throughput as resulting from the distillation of the first and/or second hydrocarbon fluid(s), which have been introduced according to the present invention, will be circulated in the petroleum plant parts which are intended to be cleaned (treated).

In embodiments of the invention, the distillates drawn off under the distillate self production technique described above can be introduced into the plant system at one or more treatment location(s) having no impact on the fresh feed rate entering the plant or can be input so as to have an impact on the plant's fresh feed rate as by the above described supplementation of the fresh feed rate.

As used in the present invention, the term "equivalent throughput" defines the distillates throughput corresponding to the one achieved during plant run before the application of the present invention, or the throughput of the products resulting from the distillation of the first and/or the second hydrocarbon fluid(s), which have been introduced and/or self-produced under the present invention.

An additional embodiment of the invention also features an embodiment wherein the plant, prior to implementation of the present treatment, is running at an established fresh feed rate (e.g., under a normal operation state that is well below the design rate (DR) value (e.g., 60% of DR)) and wherein the set desired treatment fresh feed rate for the treatment process ("treatment fresh feed rate) is a value higher than the established fresh feed rate ("established feed rate" or "established rate") but lower than the DR value to accommodate first and/or second hydrocarbon(s) introduction. Suppose the established fresh feed rate is 60% of DR; if the treatment fresh feed rate (or raised to rate for additional distillate production) is 80% of DR there will be self-produced 20% of DR of first and/or second hydrocarbon, which can be withdrawn, introduced and circulated under the present invention. With this drawn off and reintroduced additional hydrocarbon(s) there can be progressively lowered the current fresh feed rate to offset the newly introduced drawn off hydrocarbon(s) (e.g., dropping down from raised to rate of 80% of DR down to the original 60% of DR fresh feed rate with the supplementing drawn off hydrocarbons bringing it to 80% of DR). There is still room to introduce 20% DR first and/or second hydrocarbon feed to make it 100% of DR, which can be introduced in the plant from an external source into any point or points of the plant. In this case, there would be at least an increase in the desired plant feed rate of 60% DR up to 80% of DR (or equivalent throughput) coupled with the 20% of current feed rate (or equivalent throughput) for the first and/or second hydrocarbons. A more typical scenario however, is one where the plant has an established rate close to or at the DR and there is a reduction in the established rate below the DR rate to the extent of intended first and/or second hydrocarbons. For instance, a 90% of DR treatment plant feed rate following a 10% reduction in the established feed rate (that was set at the DR under normal operation state). In this case, an introduction of 1% to 30% at the first and/or second hydrocarbons provide for the sum amount being put closer toward the DR (plus 1% to 9%) at the DR (plus 10%) or higher than the DR (11% to 30%).

An additional embodiment of the invention also features an embodiment wherein the plant is running at a rate which is higher than the design rate. As a matter of fact, given for granted the existing plants are designed under conservative conditions to take into account the fouling-related limitations, upon eliminating/reducing said limitations, the present invention will make available to the production the portion of the plant which have been over-dimensioned for the purpose. For example, if a preheat train has been designed with a 30% surface increase to take into consideration fouling and said fouling is eliminated by the present invention, said preheat train can be passed through by 30% more feed, by maintaining the same performances. In case the rest of the plant has been dimensioned with a 30% more of surface, it will be easy to increase the feed rate of the plant by 30% over the design rate. In case the rest of the plant has design constraints, the revamping of said rest of the plant can easily overcome such constraints and allow for an increase of feed rate by 30% over the design rate. The revamping will be therefore limited to only a portion of the plant and this will have a tremendous impact on capital expenditure reduction, e.g., for revamping a plant in order to increase its capacity.

Under an embodiment of the present invention, the method for cleaning (treating) a petroleum plant during its run comprises the following steps:

1. keeping the petroleum plant under production operating conditions, typical of the plant itself, with the fresh feed inserted and production of products typical of the plant itself;
2. varying the fresh feed rate, including the possibility to reach the technical minimum;
3. optionally introducing in said petroleum plant a first hydrocarbon-based fluid in a ratio comprised between 0.1% and 100% with respect to the current fresh feed;
4. optionally introducing in said plant a second hydrocarbon-based fluid in a ratio comprised between 0.01% and 50% with respect to the current fresh feed;

5. implementing a closed or semi-closed circulation loop inside said plant, wherein one or more distillates and/or products exiting the plant can be withdrawn, thereby including the possibility of implementing a tailor made withdrawal system from any point of the petroleum plant, and an introduction inside or upstream the equipment to be cleaned (treated);
6. keeping operating run conditions typical of the petroleum plant, such as to allow distillation of products;
7. circulating the distillate products, optionally containing the first and/or the second hydrocarbon fluid(s), in a closed or semi-closed loop comprising the equipment to be cleaned (treated), such that a portion of the products distilling during said circulation are re-introduced in said closed or semi-closed loop, whereas the other portion of the distillates make up the petroleum plant production and/or the normal flow streams;
8. circulating the distillate products, optionally containing the first and/or the second hydrocarbon fluid(s), in a closed or semi-closed loop encompassing the equipment to be cleaned (treated), for a time of at least 20 minutes, at a temperature comprised between 100° C. and 900° C. and at a pressure comprised between 1 bar and 400 bar;
9. monitoring the cleaning (treatment) operations according to the method of the present invention;
10. optionally re-introducing the first and/or the second hydrocarbon fluid;
11. optionally repeating the steps from 2 to 10;
12. optionally opening the closed or semi-closed loop, such that the fluids of steps from 2 to 11 can be removed from the petroleum plant by utilizing the normal production cycle.

The above operations can be modified, e.g., when the concentration of heavy products in the distillates exiting the petroleum plant is too high for their subsequent processing in downstream plants. In such a case, a step will be added, wherein all the produced distillates will exit the petroleum plant, as per normal production cycle, and the step of introducing of the hydrocarbon fluid(s) will be repeated, as well as its (their) circulation in the petroleum plant.

Alternatively, the fresh feed rate of the petroleum plant (with respect to the rate wherein the plant was running before the application of the present invention) can be increased to any value up to the design feed rate (or below or higher as in the aforementioned +/−5%, or +/−30% of the design rate). In an embodiment of the invention, the fresh feed rate will be thereafter progressively reduced, while the increased amount of produced distillates, with respect to the one produced when being at the rate wherein the plant was running before the application of the present invention, will be circulated inside the portions of the petroleum plant which the owner wishes to clean (treat). This is, for example, the case wherein the plant is running at a reduced rate or at the technical minimum for any reason (e.g., market conditions, limitations of other plants, etc.); in this case the feed rate will be increased to produce distillates under the present invention and then brought back at the rate wherein the plant was running before the application of the present invention (or in any case, at a lower rate from the "raised-to-rate"). In this case a contingency will be used to improve the performance of the petroleum plant. This is a particularly useful application of the present invention in that, it is well known in the industry, that petroleum plants do foul more easily when running at a low rate.

The cleaning procedure under the present invention will be terminated when the monitoring system under present invention, as previously defined, gives appropriate indications. At that point, e.g., the heat exchangers, the pums, the lines, the columns, the internals will be essentially free of any heavy compounds. The petroleum plant will continue its run under cleaner conditions, without the need of opening equipment to clean it. Only in case of plant shutdown for maintenance, under the method of the present invention, there will be added some steps in order to achieve gas-free and/or safe entry conditions.

Under an embodiment of the present invention, when there is the need of opening equipment to perform maintenance or inspection jobs, with related entry of operating personnel, in order to achieve gas-free and/or safe entry conditions it will be appropriate to add the optional following steps:

13. stopping the introduction of feed;
14. optionally circulating in a closed or semi-closed loop of the first and/or second hydrocarbon fluid(s) inside the equipment to be cleaned (treated), for a time of at least 20 minutes, at a temperature comprised between 100° C. and 900° C. and at a pressure comprised between 1 bar and 400 bar;
15. cooling of the equipment/plant;
16. optionally emptying the equipment/plant from all of the hydrocarbons;
17. introducing water inside the equipment/plant;
18. implementing a closed circulation loop encompassing the equipment/plant;
19. introducing in the closed circulation loop a chemical product under the present invention (one or more chemical washing/cleaning products and their mixtures);
20. setting up the temperature and the pressure inside the closed circulation loop at values comprised between ambient temperature and 350° C. and between 1 bar and 50 bar;
21. circulating the water solution of the chemical product(s) inside the closed circulation loop under conditions of temperature and pressure comprised between ambient temperature and 350° C. and between 1 and 50 bar, for a time of at least 20 minutes;
22. cooling, if required, (including the eventual introduction of fresh water in the loop) and emptying of the loop from the water solution;
23. optionally routing of the water solution to the oily water treatment plant;
24. optionally repeating of the steps from 17) to 23).

Under the present invention, as an alternative to the above described steps, the achievement of gas-free and/or safe entry conditions can also be realized as follows:

13'. stopping the introduction of feed;
14'. optionally circulating in a closed or semi-closed loop of the first and/or second hydrocarbon fluid inside the equipment to be cleaned (treated), for a time of at least 20 minutes, at a temperature comprised between 100° C. and 900° C. and at a pressure comprised between 1 bar and 400 bar;
15'. cooling of the equipment/plant;
16'. optionally emptying of the equipment/plant from all of the hydrocarbons;
17'. introducing inside of the equipment/plant steam at a pressure comprised between 1.5 bar and 100 bar;
18'. introducing in the steam of point 17' of a chemical product under the present invention (one or more chemical washing/cleaning products and their mixtures);
19'. introducing inside of the equipment/plant of the mixture steam/chemical product(s) according to present invention, for a time of at least 20 minutes;
20'. optionally circulating condensed steam, containing a chemical product(s) according to present invention;
21'. emptying of condensates from the equipment/plant;

22'. optionally routing of condensates to the oily water treatment plant;

23'. cooling, if needed, (including the eventual introduction of fresh water in the loop) and emptying of the equipment.

For purposes of the present invention any steam of any characteristics (temperature and pressure) can be utilized, preferably with a pressure >3 bar. Obviously, before any personnel entry, the equipment will be appropriately cooled (e.g., with water or nitrogen) and aerated. The examples 1, 2 and 10 are supplied to better clarify the application of the present invention.

In the normal operating conditions of a petroleum plant circulation of distilled product is not performed, nor is there introduced any chemical product, as defined under the present invention, under the method of the present invention, to perform the effective cleaning (treatment) of equipment during a plant run.

In all of the illustrative examples hereinafter reported, the introduction of the chemical product under the present invention can occur in any point or points of the closed or semi-closed loop implemented as described hereinbefore. It is also evident, any combination of the illustrative examples hereinafter reported falls among the scopes of the present invention. Any of the examples reported in the present description is to be interpreted only as an illustrative example and it is not intended to limit the present invention in anyway.

In one additional preferred embodiment, the present invention introduces one or more hydrocarbon fluid(s) which speed up and/or make more efficient the dissolution of heavy deposits which are present in the petroleum plant. Such hydrocarbon fluid(s) can be, for example, introduced as a second fluid, introducing it in the fluid which is distilled and hence re-introduced in the plant, or directly in the feed of the plant. The introduction of said second fluid can occur in any point or points of the petroleum plant, preferably upstream of the equipment to be cleaned, simultaneously or subsequently to the introduction of the first hydrocarbon fluid. The introduction of said second hydrocarbon fluid can occur either in the case where the first hydrocarbon fluid is to be distilled and circulated in the petroleum plant, or in the case where the first hydrocarbon fluid is to be passed once-through in the petroleum plant.

When introduced as a second hydrocarbon fluid, said hydrocarbon fluid will be introduced at a dosage comprised between 0.01% and 100% with respect to the quantity of the first hydrocarbon fluid, for a time of, for example, at least 1 hour. The time of introduction and/or circulation of said second hydrocarbon fluid can vary with respect to the dosage, by being lower for a greater quantity introduced in said first hydrocarbon fluid. Alternatively, said second hydrocarbon fluid can be introduced continuously during the petroleum plant run, as a first hydrocarbon fluid, by introducing it upstream of the equipment to be cleaned (treated). When introduced as a first hydrocarbon fluid, said hydrocarbon fluid will be introduced at a dosage comprised between 0.01% and 50% with respect to the quantity of the current fresh feed of the petroleum plant, for a time of at least 1 hour. The time of introduction and/or circulation of said hydrocarbon fluid can vary with respect to the dosage, by being lower for a greater quantity introduced.

The present invention can be therefore realized; e.g., in the following ways: i) by continuous injection once-through of a hydrocarbon fluid introduced in any part of the petroleum plant, preferably upstream of the equipment to be cleaned (treated); ii) by injection of a hydrocarbon fluid introduced externally of the petroleum plant and injected in any part or parts of said plant, preferably upstream of the equipment to be cleaned (treated); iii) by self-producing a hydrocarbon fluid produced by distillation at a certain feed rate, followed by the variation of the fresh feed rate of the petroleum plant, the withdrawal of said hydrocarbon fluid from any one or more points of the petroleum plant and the introduction of said distillate in any one or more points of the petroleum plant, preferably upstream of the equipment to be cleaned (treated); iv) by injection of a first hydrocarbon fluid as per the preceding points i), ii), iii) into which a second hydrocarbon fluid is introduced simultaneously or subsequently relative to said first hydrocarbon fluid.

The hydrocarbon fluid (e.g., the first and/or second hydrocarbon fluid) introduced under the present invention comprises chemical product(s) or mixtures thereof able to solubilize deposits inside the equipment to be cleaned. Preferably it is able to solubilize and/or stabilize asphaltenes. Most preferably, it is under near critical or supercritical conditions at the operating conditions of the petroleum plant under the present invention.

The present invention allows the cleaning of the equipment without any penalty in terms of production loss and therefore at economic conditions much more favourable with reference to the current state of the art.

For the scopes of the present invention, the chemical product(s) utilized, as such or mixtures thereof, under the method of the present invention, are selected from the following group: polymetacrylates, polyisobutylene succinimmides, polyisobutylene succinates; laurylacrylate/hydroxyethylmetacrylate copolymer; alkylarylsulfonates, alcanolamine-alkylarylsulfonates and alkylarylsulfonic acids; substituted amines, where the substituent is an hydrocarbon containing at least 8 carbon atoms; acylated compounds containing nitrogen and having a substituent with at least 10 aliphatic carbon atoms, such substituent being obtained by reaction of an acylant carboxylic acid with at least an aminic compound containing at least a group-NH—, said acylant agent being joined to said aminic compound by way of an imido, amido, amidine or acyloxyammonium bridge; nitrogen containing condensated compounds of a phenol, an aldehyde or an aminic compound, having at least a group —NH—; esters of a substituted carboxylic acid; hydrocarbyl substituted phenols; alcoxylated derivatives of an alcohol, a phenol or an amine; phthalates; organic phosphates; oleic acids esters; diethylhydroxylamine.

For the scopes of the present invention, the chemical product(s) utilized, as such or mixtures thereof, under the method of the present invention, are also selected from the following group: glycols and/or their derivatives, said glycols and/or their derivatives being not in a polymeric form, in the sense that they are molecules of single compounds, also in an adduct form, and not molecules constituted by a chain where a single monomer is repeated; for the scopes of the present invention there can be considered as glycol examples: tetraethyleneglycol; mono- and di-ethers, mono- and di-esters, ether-esters and thioethers of single glycols; glycol of general formula $CH_2OH—(CH)_nOH_n—CH_2OH$ where n=0-10; glycol ethers of general formula $R_1—O—CH_2—CH_2—O—R_2$ where $R_1$ is an hydrocarbyl substituent $C_1$-$C_{20}$ and $R_2$ is H atom or an hydrocarbyl substituent $C_1$-$C_{20}$; glycol esters of general formula $R_1—O—O—CH_2—CH_2—O—O—R_2$ where $R_1$ is an hydrocarbyl substituent $C_1$-$C_{20}$ and $R_2$ is H atom or an hydrocarbyl substituent $C_1$-$C_{20}$; thioglycols of general formula $HO—R_1—S—R_2—OH$ where $R_1$ is an hydrocarbyl substituent $C_1$-$C_{10}$ and $R_2$ is H atom or an hydrocarbyl substituent $C_1$-$C_{10}$; glycol ethers-esters of general formula $R_1—O—CH_2—CH_2—O—O—R_2$ where $R_1$ and $R_2$ are an hydrocarbyl substituent $C_1$-$C_{20}$.

For the scopes of the present invention the chemical product(s) utilized, as such or mixtures thereof, under the method of the present invention, are also additionally selected from the following group: ethers of general formula $R_1$—O—$R_2$ where $R_1$ or $R_2$ is hydrocarbyl substituent $C_1$-$C_{20}$; substituted benzenes of general formula

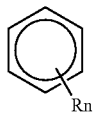

where n=1-6 and R can be indifferently H atom, —OH group, —COOH group, —CHO group, —$NH_2$ group, —$HSO_3$ group, the same or different hydrocarbyl substituent $C_1$-$C_{30}$; ketons of general formula $R_1$—CO—$R_2$ where $R_1$ or $R_2$ is hydrocarbyl substituent $C_1$-$C_{20}$; anhydrides of general formula $R_1$—CO—O—CO—$R_2$; included those where $R_1$ and $R_2$ are bound together to form cyclic anhydrides, where $R_1$ or $R_2$ is a hydrocarbyl substituent $C_1$-$C_{20}$; amides of general formula

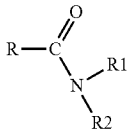

where R, $R_1$, $R_2$ are indifferently H atom or hydrocarbyl substituent $C_1$-$C_{20}$; heterocyclic compounds, preferably of the hydrogenated type, containing from 0 to 3 hydrocarbyl substituent $C_1$-$C_{20}$.

For the scopes of the present invention the chemical product(s) utilized, as such or mixtures thereof, under the method of the present invention, are also heterocyclic compounds selected from the group consisting of: furans, pyrrols, imidazoles, triazoles, oxazoles, thiazoles, oxadiazoles, pyranes, pyridine, pyridazine, pyrimidine, pyrazine, pyperazine, piperidine, triazines, oxadiazines, morpholine, indane, indenes, benzofuranes, benzothiophenes, indoles, indazole, indoxazine, benzoxazole, anthranile, benzopyrane, coumarines, quinolines, benzopyrones, cinnoline, quinazoline, naphthyridine, pyrido-pyridine, benzoxazines, carbazole, xanthene, acrydine, purine, benzopyrroles, benzothiazoles, cyclic amides, benzoquinolines, benzocarbazoles, indoline, benzotriazoles.

In the description of the above group, the plural is to be intended as including all the possible compounds configurations, including the iso-form: e.g., the term "dithiols" is meant to include 1,2 dithiol and 1,3 dithiol, "quinolines" is mean to include quinoline and isoquinoline. As used in the present invention, the term "hydrocarbyl substituent" refers to a group having a carbon atom directly attached to the rest of the molecule and having a hydrocarbon or predominantly hydrocarbon character. Among these mention is made of the hydrocarbon groups, including aliphatic, (e.g., alkyl or alkenyl), alicyclic (e.g., cycloalkyl or cycloalkenyl), aromatic, aliphatic- and/or alicyclic-substituted aromatic, condensated aromatic; aliphatic groups that are preferably saturated. Examples of the above include the following groups: methyl, ethyl, propyl, butyl, isobutyl, pentyl, hexyl, octyl, decyl, octadecyl, cyclohexyl, phenyl. Said groups may also contain non-hydrocarbon substituents provided they do not alter the predominantly hydrocarbon character of the group, e.g., the groups selected from: keto, hydroxy, nitro, alkoxy, acyl, sulphonic, sulphoxid, sulphur, amino. Said groups may also or alternatively contain atoms other than carbon, such atoms being in a hydrocarbon chain or ring otherwise composed of carbon atoms. Hetheroatoms of this type are selected from the group of: nitrogen, oxygen and sulfur.

Among the abovementioned compounds are to be preferred the ones selected from the group consisting of: methanol, ethanol, propanol, isopropanol, butanol, isobutanol, methylglycol monomethylether, butylglycol monobutylether, toluene, aliphatic amines $C_8$ ethoxylated with at least 6 moles ethylene oxide, arylsulfonates, benzene, diphenyl, phenanthrene, nonylphenol, 1-methyl-2-pyrrolidinone, diethyl ether, dimethylformamide (DMF), tetrahydrofuran (THF), ethylenediamine, diethylamine, triethylamine, trimethylamine, propylamine, 1-(3-aminopropyl)-2-pyrrolidone, 1-(3-aminopropyl) imidazole, N-hydroxyethyl-imidazolidinone, N-aminoethyl-imidazolidinone, 2-(2-aminoethylamino) ethanol, isopropylamine, cumene, 1, 3, 5 trimethylbenzene, 1, 2, 4 trimethylbenzene, maleic anhydride, p-toluidine, o-toluidine, dipropylamine, diphenyl ether, hexamethylbenzene, propylbenzene, cyclohexylamine, 1-isopropyl-4-methyl-benzene, 1, 2, 3, 5 tetramethylbenzene, hexanol, morpholine, o-xylene, m-xylene, p-xylene, butylamine, methylamine, mesitylene, examine, succinic anhydride, decahydronaphthalene, ethylbenzene, 1, 2 dimethylnaphthalene, 1, 6 dimethylnaphthalene, p-cymene, ethyl ether, isopropyl ether, etoxybenzene, phenyl ether, acetophenone, monoethanolamine (MEA), diethanolamine (DEA), triethanolamine (TEA), diethyleneglycol, triethyleneglycol, tetraethyleneglycol, hexyl glycol, dodecylbenzene, lauryl alcohol, myristyl alcohol, thiodiglycol, dioctylphthalate, diisooctylphthalate, didecylphthalate, diisodecylphthalate, dibutylphthalate, dinonylphthalate, methylethylketone (MEK), methylisobutylketone (MIBK), methyl-tert-butyl-ether (MTBE), cyclohexane, cyclohexanone, methyl- or ethyl-esters of fatty acids achieved by esterification of vegetal and/or animal oils (biodiesel).

It should also be noted that under embodiments of the present invention, and when compatible, there can be utilized one or more options from one group together with one or more options from an alternate group (or groups).

In still another preferred embodiment of the present invention the chemical compounds hereinabove defined preferably reach near critical or supercritical conditions at the petroleum plant's operating conditions. As a matter of fact, it is known that, supercritical fluids are capable to solubilize coke. However, their use has never been proposed for the cleaning of equipment during the run of petroleum plant(s), wherein said petroleum plant(s) are producing products, as well as it has never been proposed an apparatus suitable for the scope, wherein the equipment cleaning is performed by circulation of chemical product(s) dissolved in a hydrocarbon fluid "self-produced" by the petroleum plant and introduced in a closed or semi-closed loop inside said petroleum plant and/or wherein there is added a second hydrocarbon fluid under the present invention. The present invention should be therefore considered as an improvement of the state of the art.

A list of chemical compounds which can be in supercritical conditions under present invention can be found in the Handbook of Chemistry and Physics 74th Edition—CRC Press—page 6-54 through page 6-65 (which pages are incorporated herein by reference). Among these compounds are to be preferred under the present invention those selected from the following group: dimethylamine, ethylamine, ethyl formate, methyl acetate, dimethylformamide (DMF), propanol, propylamine, isopropylamine, trimethylamine, tetrahydrofuran (THF), ethyl vinyl ether, ethyl acetate, propyl formate, butanol, methyl propanol, diethyl ether, methyl propyl ether, isopropyl methyl ether, diethyl sulfide, butylamine, isobutylamine, diethylamine, diethylhydroxylamine, cyclopentanol, 2-methyltetrahydrofuran, tetrahydropyran, pentanal, isobutyl formate, propyl acetate, pentanoic acid, butyl methyl ether, tert-butyl methyl ether, ethyl propyl ether, methylpyridines, cyclohexanone, cyclohexane, methylcyclopentane, cyclohexanol, hexanal, pentyl formate, isobutyl acetate, 2-ethoxyethyl acetate, methyl pentyl ether, dipropyl ether, diisopropyl ether, hexanol, methyl pentanols, triethylamine, dipropylamine, diisopropylamine, benzaldehyde, toluene, cresols, benzyl alcohol, methylanilines, dimethylpyridines, furfural, pyridine, methylcyclohexane, heptanol, acetophenone, ethylbenzene, xylenes, ethylphenols, xylenols, anilines, dimethylaniline, ethylaniline, octanenitrile, ethyl propanoate, methyl butanoate, methyl isobutanoate, propyl propanoate, ethyl 2-methyl propanoate, methyl pentanoate, eptanoic acid, octanoic acid, 2-ethylhexanoic acid, propyl 3-methylbutanoate, octanoles, 4-methyl-3-heptanol, 5-methyl-3-heptanol, 2-ethyl-1-hexanol, dibutyl ether, di-tert-butyl ether, dibutylamine, diisobutylamine, quinoline, isoquinoline, indan, cumene, propylbenzene, 1,2,3-trimethylbenzene, 1,2,4-trimethylbenzene, mesitylene, o-toluidine, N,N-dimethyl-o-toluidine, nonanoic acid, nonanols, naphthalene, butylbenzene, isobutylbenzene, cymenes, p-diethylbenzene, 1,2,4,5-tetramethylbenzene, decahydronaphthalene, decanoic acid, decanol, 1-methylnaphthalene, carbazole, diphenyl, hexamethylbenzene, dodecanols, diphenylmethane, tridecanols, tetradecanols, hexadecanols, heptadecanols, terphenyls, octadecanols, eicosanols. The compounds named in plural refer to all the possible isomers of said compound: e.g., the term "xylenes" indicates o-xylene, m-xylene and p-xylene.

A particular note is deserved to fatty amines and mixtures thereof: as it is well known, critical pressure decreases with the increasing of the aliphatic chain, the fatty amines and mixtures thereof will likely have a low critical pressure (Pc) and could effectively be used also in such connection. The same applies to commercial products containing fatty amines and mixtures thereof.

Of particular interest are those compounds having a critical pressure (Pc)<5 MPa, preferably those with a Pc <3.5 MPa. A list of compounds, useful under the present invention, with their relative critical constants is exemplary reported in Table 1:

TABLE 1

| Compound | Critical temperature (° C.) | Critical pressure (bar) |
|---|---|---|
| p-Toluidine | 394 | 23 |
| Ethyl butyrate | 293 | 30 |
| Dipropylamine | 277 | 31 |
| Isobutyl acetate | 288 | 31 |
| Propyl acetate | 276.2 | 32.9 |
| Propyl-ethyl-ether | 227.4 | 32.1 |
| Triethylamine | 262 | 30 |
| Ethylbenzene | 344 | 38 |
| Propylbenzene | 365.2 | 32.3 |
| Butylbenzene | 387.2 | 30.4 |
| Cumene | 357.9 | 32.3 |
| para-xylene | 342.8 | 36.1 |
| Hexamethylbenzene | 494 | 23.5 |
| Triethanolamine | 514.3 | 24.2 |
| Diphenyl methane | 497 | 28.6 |
| Diphenyl | 516 | 38.5 |
| MTBE | 224 | 34.3 |
| Dioctylphtalate | 532.8 | 11.8 |
| Diisodecylphtalate | 613.8 | 10 |

TABLE 1-continued

| Compound | Critical temperature (° C.) | Critical pressure (bar) |
|---|---|---|
| Diisooctylphatalate | 577.8 | 11.8 |
| Nonylether | 462.8 | 13 |
| Methyloleate | 490.8 | 12.8 |
| Dioctylether | 433.8 | 14.4 |

Among the compounds of the present invention nitrogen compounds in general, preferably the amines, still preferably cyclic amines, contribute to modify coke morphology. Another useful compound in such connection is, e.g., toluene which makes a fibrous, needle coke. As an additional example, tetrabutylammonium hydroxide is a very good swelling agent and can be included in formulation as it contributes to change the morphology of formed coke, which will be more easily removable.

The swelling agents are well known in coal solubilization/extraction techniques, but have not been utilized in the petroleum/petrolchemical industry during the run of a plant. In their known applications, swelling agents penetrate coal and provoke its swelling. Factors influencing the amount of swelled coal in a solvent are: a) solvent-coal interaction degree; b) cross-link density. The swelling ratio is the ratio between the volume of swelled coal, in equilibrium with the solvent, in respect to the volume of original coal. In general, the solvents utilized for such purposes have good characteristics of coal solubilization. By using swelling agents, decoking of equipment, e.g., of process heaters, will be easied up due to change in morphology of formed coke (from "needle-like" to "fluffy" or "cloud-like").

Solvents used as swelling agents are classified in two classes: forming hydrogen bonds and non forming hydrogen bonds. In general, the first are reported to be 25-50% more effective as the latter; the effectiveness of the latter can be increased following a first coal extraction with a solvent forming hydrogen bonds with coal. Swelling effectiveness, and hence coal penetration, is attributed to replacement of carbon-carbon hydrogen bonding with solvent-carbon hydrogen bonding: the same principle is used, among the others, in the present invention.

Among non forming hydrogen bonds swelling agents are to be preferred those selected from the group consisting of: benzene, toluene, cyclohexane, naphthalene, diphenyl, xylene, tetraline, methylcyclohexane. Among forming hydrogen bonds swelling agents are to be preferred those selected from the group consisting of: pyridine, methanol, ethanol, ethylenediamine, propanol, 1,4-dioxane, acetone, formamide, aniline, tetrahydrofuran, N,N-dimethylaniline, diethylether, acetophenone, dimethylformamide, ethyl acetate, methyl acetate, methylethylketone, 1-methyl-2-pyrrolidone, quinoline.

In situations where circulation of chemical product(s) is performed at atmospheric pressure and at a temperature >150° C., under the present invention, there is preferred the compounds having boiling temperature (Teb) preferably >150° C., most preferably the ones with Teb >250° C. An exemplary list of such compounds can be found in the Handbook of Chemistry and Physics 74th Edition——CRC Press—, pages 3-12 through 3-523, the noted pages of which are incorporated herein by reference.

Among those compounds are to be preferred those selected from the group consisting of: anthraquinone, eicosanol, benzalacetophenone, benzanthracene, hydroquinone, dodecylbenzene, hexaethylbenzene, hexamethylbenzene, nonylbenzene, 1,2,3-triaminobenzene, 1,2,3-trihydroxybenzene, 1,3, 5-triphenylbenzene, diphenylmethanol, p-benzidine, benzil, 2-benzoylbenzofurane, benzoic anhydride, 2-benzoyl-methyl benzoate, benzyl benzoate, 4-tolyl benzoate, benzophenone, 4,4'-bis(dimethylamino) benzophenone, 2,2'-dihydroxybenzophenone, 2,2'-dimethylbenzophenone, 4,4'-dimethylbenzophonone, methylbenzophenone, 2-amino benzyl alcohol, 3-hydroxy benzyl alcohol, α-1-naphthyl benzyl alcohol, benzyl-ethyl-phenyl-amine, benzylaniline, benzyl ether, phenylacetophenone, 2-acetamide diphenyl, 2-amino diphenyl, 4,4'-bis(dimethylamino) diphenyl, biphenol, butyl bis(2-hydroxyethyl)amine, butylphenylamine, butylphenylketone, carbazole, diphenylcarbonate, cetyl alcohol, cetylamine, benzylcinnamate, coumarin, lindane, dibenzofuran, dibenzylamine, diethylene glycol dibenzyl ether, diethylene glycol monolaurate, diethylene glycol (2-hydroxypropyl)ether, diethylenetriamine, di-α-naphthylamine, di-β-naphthylamine, dioctylamine, diphenylamine, diphenylmethane, 4,4'-diamino diphenyl, 4,4'-dimethylamino diphenyl, 4-hydroxy diphenyl, diphenylmethanol, diphenylethylamine, di-(α-phenylethyl)amine, di-iso-propanolamine, di-2-tolylamine, eicosanol, 1,1,2 triphenylethane, ethylene glycol 1,2 diphenyl, ethyl-di-benzylamine, ethylene glycol monobenzyl ether, ethylene glycol monophenyl ether, N,N-diphenylformamide, phenylformamide, tolylformamide, 2-benzoylfurane, 2,5 diphenylfurane, glycerine and related esters, heptadecylamine heptadecanol, cerylic alcohol, hexadecanamine, cetyl alcohol, hydroxyethyl-2-tolylamine, triethanolamine, cyclohexanone, imidazole, methylimidazole, phenylimidazole, 5-amino-indane, 5-hexy-indane, 1-phenyl-1,3,3-trimethyl-indane, 2,3 diphenyl-indene, indole, 2,3 dimethyl-indole, tryptamine, 2-phenyl-indole, isocoumarin, diethyl-isophthalate, isoquinoline, benzyl laurate, phenyl laurate, lauryl alcohol, lauryl amine, lauryl sulphate, diethylbenzyl-malonate, melamine, diphenylmethane, triphenylmethane, 4-benzyl-morpholine, 4-phenyl-morpholine, 4-(4-tolyl)-morpholine, myristic alcohol, 9,10-dihydronaphthacene, acethyl-naphthalene, benzyl-, naphthalene, butyl-naphthalene, dihydro-naphthalene, dihydroxy-naphthalene, methyl-naphthalene, phenyl-naphthalene, naphthol, naphthalene, methylnaphthlamine, naphthylphenylamine, α-naphthyl-2-tolyl-ketone, nonacosanol, octadecanol, octylphenyl-ether, pentadecylamine, pentadecanol, 3-hydroxyacetophenone, tyramine, 4-hydroxyphenylacetonitrile, o-phenylenediamine, N-phenyl-phenylenediamine, 4-methylphenylenediamine, diphenylether, bis-(2-phenylethyl)amine, phosphine derivatives as phenyl, triphenyl and oxyde, triphenylphosphite, dibutyl phthalate, dibenzyl phthalate, diethyl phthalate, dioctyl phthalate, diisoctyl phthalate, didecyl phthalate, diphenyl phthalate, phthalic anhydride, N-benzoylpiperidine, 1,3-diphenoxypropane, N-(2-tolyl)propionamide, 1-methyl-3-phenyl-pyrazoline, pyridine derivatives as 3-acetamido, 3-benzyl, 4-hydroxy, 2-phenyl, phenylsuccinic anhydride, succinimide, N-benzylsuccinimide, N-phenylsuccinimide, o-terphenyl, m-terphenyl, 1,14 tetradecanediol, tetradecanol, tetraethyleneglycol, tetraethylenepentamine, 2,5-diaminotoluene, 3,5-dihydroxytoluene, 4-phenyltoluene, p-toluenesulfonic acid and related methyl and propyl esters, o-toluic acid and related anhydride, N-benzyl-toluidine (o-, m-e p-), tribenzylamine, tributylamine, triethanolamine, triethyleneglyco, and related monobutylether, triheptylamine, trioctylamine, triphenylamine, tritane, tritanol, 2-pyrrolidone, xanthene, xanthone, xylidine, The compounds under the present invention can be utilized alone or in a mixture with appropriate solvents. Typical solvents in the applications of the present invention can also be the distillation products from crude oil originating from any petroleum plant and/or being anyway present in any petroleum plant, by being finished products, blending components of finished products, intermediate products or feed to petroleum plants, and are preferably selected from the group consisting of: gasoline, diesel, gas oil, virgin naphtha, kerosene, reformed gasoline, pyrolysis gasoline, pyrolysis gas oil, light cycle oil from FCCU, decant oil from FCCU, methyl-tert-butyl-ether (MTBE), benzene, toluene, xylenes, cumene, methanol, cyclohexane, cyclohexanone, ethylbenzene, linear alkylbenzene (LAB), dimethylterephthalate, phtalic anhydride, styrene, tert-amyl-methyl-ether (TAME), ethanol, dimethylformamide (DMF), dioctylphthalate, isopropyl alcohol, butyl alcohol, allyl alcohol, butylglycol, methylglycol, ethyl-tert-buthyl-ether (ETBE), ethanolamines, acetone, octyl alcohol, methyl-ethyl-ketone (MEK), methyl-isobutyl-ketone (MIBK). Said solvents can originate from any petroleum plant as above defined.

Generally, the solvents under the present invention can be chosen among the ones produced by petroleum plants or anyway being present in a petroleum plant by being finished products, blending components of finished products, intermediate products or feedstocks of petroleum plants. In some cases, the same crude oil, the fuel oil or the quench oil from an Ethylene plant can be used as solvents of the chemical product(s) or mixtures thereof, under the present invention. The solvents as above defined can also be used as the first hydrocarbon fluid under the present invention.

A particular solvent under the present invention is the MTBE present in an oil refinery or produced in a petrochemical plant. MTBE is utilized in an oil refinery exclusively as a blending component in lead-free gasoline formulation, in order in boost octane number of formulated gasoline; its presence in an oil refinery is exclusively due to this purpose. Utilization of MTBE under the present invention differs from the state of the art and has to be considered an innovative step. Under the present invention MTBE can be pumped and circulated in a closed or semi-closed loop in any petroleum plant, alone or admixed with chemical compound(s) under the present invention, for the purpose of cleaning (treating) equipment.

The same arguments defined for MTBE may also apply to virgin naphtha, aromatic gasoline arising from a Reforming plant (reformed gasoline) and/or to benzene/toluene/xylene (BTX) products as such and/or as a mixture produced in an Aromatic Extraction plant (e.g., of the Sulfolane, Furfural, Glycols or Formylmorpholine type) and/or to the gasoline and/or the gas oil produced in an Ethylene Unit (pyrolysis gasoline/pyrolysis gas oil).

Without being bound to any specific ratio among the components, the chemical product(s) dosage under the present invention can preferably be in the range: solvent 0%-400%, chemical products) 100%-0%; most preferably in the range: solvent 50%-99%, chemical product(s) 50%-1%; still most preferably in the range: solvent 70%-95%, chemical product(s) 5%-30%. In some embodiments of the invention, the use of the solvent alone in a closed or semi-closed loop allows for the equipment cleaning (treating) under the present invention. As already stated, in embodiments of the invention the solvent can coincide with the first (and, optionally the second as well) hydrocarbon fluid and hence be "self-produced" and circulated inside the petroleum plant.

It is important to underline, that the chemical compounds used in the present invention are utilized in a different connection with respect to the state of the art, in that: a) they are utilized during the normal run of the petroleum plant with the scope of equipment cleaning and/or yield increase and/or reduction of coke formation and/or coke removal on catalysts; b) they are utilized in a closed or semi-closed loop during the petroleum plant run; c) they are utilized following the implementation of a novel apparatus, such that their circulation during plant run is enabled; d) they can be "self-produced" by means of distillation inside said petroleum plant and subsequent circulation.

During the equipment cleaning steps the cleaning status can be monitored by performing some chemical analysis, as defined by the methods published by the American Society for Testing Materials (ASTM) for petroleum products (collected e.g., in the Book of ASTM Standards for Petroleum Products) or by the Institute of Petroleum of London (IP), or by European Norms EN, selected from the group consisting of: viscosity (e.g., ASTM D 445); density (e.g., ASTM D1298); atmospheric or vacuum distillation (e.g., ASTM D86, D1160); carbon residue (e.g., ASTM D4530, D 189); sediments by hot filtration (e.g., IP 375, 390); sediments by extraction (e.g., ASTM D473); sediments by filtration (e.g., ASTM 4807); ash content (e.g., ASTM D482, EN6245); asphaltene content (e.g., IP143), colour (e.g., ASTM D1500), water and sediments by centrifuge (e.g., ASTM D2709, D1796).

One or more monitoring systems of the physical type can also be utilized for the purpose of monitoring under the present invention, selected from the group consisting of i) evaluation of the fouling factor, defined as the ratio among the heat transfer coefficient of clean apparatus and the heat transfer coefficient of the apparatus at the time when the value is recorded; ii) evaluation of pressure in various points of the petroleum plant; iii) evaluation of temperature in various points of the petroleum plant and the combination and all sub-combinations of same.

As a matter of fact, as long as the equipment is cleaned, the heavy compounds are solubilized in the cleaning fluid and hence circulating fluid becomes heavier: this is evidenced e.g., by an increase in viscosity and/or density and/or carbon residue and/or ashes; likewise, equipment's fouling factor and/or pressure loss will decrease, while heat transfer rate and/or temperature at equipment outlet, or FIT, will increase. For example, cleaning operations can be maintained until a decrease in fouling factor and/or pressure drop, within +/−10%, is recorded; or any variation in viscosity and/or density and/or carbon residue and/or ashes, within +/−5%, is recorded.

Such chemical analysis and physical systems are routinely utilized within the general state of the art for evaluating commercial specifications of petroleum products or during normal plant operation (in the production phase). In embodiments of the present invention one or more physical monitoring systems can be used alone or in combination with one or more of the chemical monitoring systems (as well as all the potential sub-combinations thereof).

As already described, another surprising benefit of embodiments of the present invention is that, while the equipment cleaning is performed, the distillation yield increases with respect to the one that a skilled person would expect from the sum of (a+b) with: a) distillates produced at a certain feed rate+b) hydrocarbons introduced from outside of the petroleum plant and/or self-produced by feed rate variation, which are subsequently distilled and re-introduced in the petroleum plant.

In the state of the art, such an improvement is impossible to achieve, in that the existing cleaning systems can operate on a closed loop circulation, but the petroleum plant is stopped and no production of any kind occurs (and obviously, by definition, no distillation yield can occur).

Still an additional surprising benefit of embodiments of the present invention is that, in the petroleum plants wherein a catalyst is used, the coke formation on said catalyst is reduced with respect to the one occurring before the introduction of the first and/or second hydrocarbon fluid(s) under the present invention. The above contributes both to increase distillation yield and/or in the performance of the catalytic plant and the operating costs, in that there will be, e.g., a lower catalyst replacement requirement to achieve the same process performance. A reduced coke formation in the catalyst during plant run implies, among others, a better performance of the catalytic plant, reduced energy consumption, reduced downtime, reduced cost in buying new catalyst, reduced maintenance costs. The present invention also reduces the catalyst agglomeration, in that a lower amount of heavy compounds will cover the catalyst, thereby facilitating the downloading of spent catalyst. The present invention also addresses differential pressure build up in a reactor containing a catalyst, in that by avoiding heavy deposits/coke from forming a lower reactor delta P will show up during plant run, and/or will reduce the delta P in the reactor once this delta P creates any concern to the plant owner (i.e., the coke will be removed from the catalyst).

In the state of the art, such an improvement is impossible to achieve, in that the existing cleaning systems can operate on a closed loop circulation, but the petroleum plant is stopped and no production of any kind occurs and, as a result, the catalyst cannot work under such conditions (or the reactor is even by-passed during cleaning operations).

The present invention provides therefore the simultaneous cleaning of the petroleum plant and the distillation yield increase. This is a surprising result over the state of the art, in that equipment fouling implies a production loss following both the decay of operating/plant conditions during the run and the downtime during cleaning operations.

In such connection the present invention can be used not for the ultimate purpose of cleaning equipment from time to time, but on a continuous basis for the purpose to increase distillation yield of a petroleum plant and run it under continuous clean conditions. In such connection, the present invention can be used during all of the plant run, all year round, 365 days in a year.

The present invention allows, among others, the elimination or avoidance of the shutdown of a plant in order to clean it and/or to reduce the maintenance shutdown downtime, with related additional improvement over the state of the art. This is an additional surprising result over the state of the art, as the state of the art implies the equipment shutdown to proceed to the cleaning, with related downtime.

In one further preferred embodiment, the present invention provides a method to design petroleum plants, wherein the equipment subject to fouling can be designed under not conservative conditions. As a matter of fact, all the current design/engineering practices is to over-dimension the equipment which is subject to fouling. This is because fouling limits the performance of said equipment and the designers consider on a conservative basis a certain amount of fouling which can be tolerated by the equipment, for sake of having the equipment running the most of the operating time and not having it on hold for the purpose of cleaning, thereby impairing, or even stopping, petroleum plant production. For example, heat exchangers are designed by taking into account a "fouling factor" which relates the duty under clean conditions versus the duty under dirty conditions. This is a standard procedure in the current state of the art. It is quite common to see in a petroleum plant, e.g., the heat exchangers are dimensioned 20-50% more than the heat they are supposed to exchange (sometimes their surface can even reach up to 100% of the theoretical one, just to take into account foulant services) or to see spare exchangers in place, which run while the other exchanger is submitted to cleaning and vice versa. All the above has a dramatic impact on capital expenditure when designing and during the engineering, procurement and construction of a new petroleum plant, as well as on the operating costs of an existing petroleum plant. By reducing/eliminating the possibility of fouling to impact plant performance, the present invention provides a new method for designing/engineering (inclusive of manufacturing) petroleum plants and related equipment, wherein said equipment is dimensioned by taking into account a reduced, or even zero, fouling. For example, heat exchangers usable under embodiments of the present invention feature heat exchangers having less than a 50% fouling factor based dimension increase, and, more preferably a 0% to less than 20% fouling factor dimension increase. The same can also apply to any other equipment which is treated under the present invention. For example, following the increase in distillation yield, the feed line dimension can be reduced as well as any other piping and/or equipment; for example distillation columns can be smaller as the feed entering them will be lower as compared to the not-treated case. All the above will have an impact on equipment dimensions, with particular reference to surface.

The present invention also includes manufacturing petroleum plants having said heat exchangers with the noted lowered or avoided fouling factor dimensions as well as the manufacturing of systems that not only utilize the aforementioned low or no-fouling compensation requirement in the equipment but avoid the need for backup similar type or redundant equipment provided to compensate for the fouling factor noted above.

An additional embodiment of the invention also features an embodiment wherein the plant is running at a rate which is higher than the design rate. As a matter of fact, given for granted the existing plants are designed under conservative conditions to take into account the fouling-related limitations, upon eliminating/reducing said limitations, the present invention will make available to the production the portion of the plant which have been over-dimensioned for the purpose. For example, if a preheat train has been designed with a 30% surface increase to take into consideration fouling and said fouling is eliminated by the present invention, said preheat train can be passed through by 30% more feed, by maintaining the same performances. In case the rest of the plant has been dimensioned with a 30% more of surface, it will be easy to increase the feed rate of the plant by 30% over the design rate. In case the rest of the plant has design constraints, the revamping of said rest of the plant can easily overcome such constraints and allow for an increase of feed rate by 30% over the design rate. The revamping will be therefore limited to only a portion of the plant and this will have a tremendous impact on capital expenditure reduction, e.g., for revamping a plant in order to increase its capacity.

As already described, to perform the present invention, an apparatus can be installed, so as to realize a closed or semi-closed circulation loop. As a petroleum plant has no possibilities, during the run, of circulating the distillates exiting a distillation column with the purpose of performing cleaning of equipment, the present invention also includes among its preferred embodiments the realization of appropriate withdrawal, introduction and circulation systems of any hot/cold distillates, in any of one or more points of the petroleum plant. The modifications to be implemented in the petroleum plant to realize appropriate withdrawal, introduction and circulation systems of distillates, are part of said apparatus and are therefore included in the scopes of the present invention.

Apparatus embodiments of the present invention to be implemented in a petroleum plant under the present invention comprise: i) withdrawal means for withdrawal from one or more point(s) in the petroleum plant of one or more hydrocarbon fluid(s) preferably having one of the following boiling ranges: a) up to 75° C.; b) from 75° C. to 175° C.; c) from 175° C. to 350° C.; d) higher than 350° C.; ii) introduction means for introduction of said one or more fluid(s) as above withdrawn into one or more point(s) of the petroleum plant, preferably upstream the equipment to be cleaned (treated); iii) distillation means for distillation of said one or more fluid(s) as above introduced into one or more point(s) of the petroleum plant; iv) re-withdrawal and re-introduction means of said one or more fluid(s) as above distilled to re-withdraw said distilled fluid(s) and re-introduce it (them) into one or more point(s) of the petroleum plant, wherein said re-withdrawal and re-introduction means can be the same withdrawal and introduction means as above; v) connection means in order to form a closed or semi-closed loop, encompassing the equipment to be treated, wherein said one or more fluid(s) will be continuously distilled, withdrawn and introduced; vi) a discharge system of the fluid(s), to allow their removal from the closed or semi-closed loop; vii) control means, which are configured to control or regulate temperature and/or pressure and/or flowrate, wherein said control means can also incorporate or be itself incorporated by a control unit for controlling/regulating the process variables such as those described herein (e.g., as to also including temperature and/or pressure and/or flowrate and/or flow direction) of the petroleum plant at one or more point(s) of said petroleum plant; viii) optional filtration means. By introducing said one or more hydrocarbon fluid(s) in a fluid upstream of a distillation column, said one or more hydrocarbon fluid(s) can be re-withdrawn and re-introduced, thereby forming a closed or semi-closed loop wherein they will be continuously distilled, withdrawn and introduced. The distillation means wherein said one or more hydrocarbon fluid(s) can be re-withdrawn can be of any kind and can be part of the petroleum plant or installed (e.g., added to a preexisting and complete plant design suited for normal operation) as to complete or establish a closed or semi-closed flow circulation loop.

The apparatus under the present invention will include, among the others:

A. withdrawal means for withdrawal of one or more hydrocarbon fluid(s) from any one or more point(s) of the petroleum plant, preferably selected from the group consisting of:

a) suction/discharge of the produced gasoline pump;
b) suction/discharge of the overhead reflux pump;
c) suction/discharge of one or more bottom/middle/top pumparound pump(s);
d) suction/discharge of the produced kerosene pump;
e) suction/discharge of the produced gas oil pump;
f) suction/discharge of any distilled hydrocarbon pump;
g) hydrocarbon line exiting any petroleum apparatus;
h) suction/discharge of the crude oil booster pump at a desalter outlet;
i) and a combination or sub-combinations for the items listed above;

B. introduction means for introduction of, for example, the withdrawn fluid, into one or more plant points and which is hence located in one or more point(s) of the petroleum plant, and which is preferably selected from the group consisting of:

i) suction/discharge of the plant feed pump;
ii) suction/discharge of the crude oil booster pump at a desalter outlet;

iii) suction/discharge of the column bottom pump;
iv) suction/discharge of the heavy gas oil pump;
v) inlet of the preheat train;
vi) inlet of the equipment to be treated;
vii) distillation residue line, upstream/downstream of any heat exchanger;
viii) column bottom;
ix) in a pump external of the plant, being part of another plant or installed on purpose, in temporary or permanent execution;
x) and a combination or sub-combinations for the items listed above;

C. distillation means for distillation of a fluid in said plant and which is located in one or more point(s) of the petroleum plant, and which preferably selected from the group consisting of:

I) atmospheric distillation column;
II) vacuum distillation column;
III) extractive distillation column;
IV) any combination or sub-combination of the above listed items;

wherein the internals of said distillation columns can be of any kind (trays, packing, etc.) and wherein said distillation columns are designed according to any known design/engineering practices and are equipped with reboiler(s) and any other device for implementing/controlling distillation of said one or more fluid(s).

The above apparatus also include the implementation of a closed or semi-closed loop between the withdrawal point(s) and the introduction point(s) of said one or more fluid(s). In an alternate embodiment of the invention a plurality of closed or semi-closed loops are provided for a plant with independent or mutual withdrawn and/or introduction points.

After the application of the present invention the heat exchangers, pumps, lines, distillation columns, furnaces, filters, vessels and any other equipment will be essentially free from heavy compounds and the petroleum plant will continue its run under cleaner conditions, without the need of opening the equipment. In case the opening of equipment is dictated by maintenance or inspection works, there can be added the steps which have been previously described to achieve gas-free or safe entry conditions.

When the cleaning in the hydrocarbon phase is over, only in the cases wherein it is required that the cleaned equipment be opened in order to perform inspection/maintenance works (e.g., during a maintenance shutdown), it is necessary to carry out further activity to guarantee the absence in the equipment of hydrocarbons or compounds which might cause fires or explosions, as well as toxic compounds for personnel. When inside the equipment there is no explosivity or light hydrocarbons, this is declared gas-free or degassed; when there aren't toxic compounds for entry personnel (e.g., $H_2S$, mercaptans, benzene, mercury) the equipment, besides being gas-free, is also decontaminated and safe for entry.

In the state of the art in order to achieve equipment gas-free/safe entry, generally steam is passed through it for a time comprised between 1 and 5 days (steam-out). In some cases, instead of steam is used nitrogen. Such procedure has many drawbacks, in that: i) it is time consuming; ii) generates airborne hydrocarbon emissions; iii) and/or does not completely remove all of the toxic compounds inside the equipment and; among other issues, this operation limits petroleum plant productivity, in that it is a bottle neck and a controlling step for shutdown operations. Upon being able to reduce downtime and to improve efficiency in achieving gas-free/safe entry conditions in the equipment, an improvement over the state of the art can be achieved.

Under the present invention, equipment gas-free and safe entry conditions can be quickly achieved by following the cleaning during plant run, under the present invention, with a circulation step of an aqueous solution of a chemical product soluble or dispersible in water, or with the introduction of said chemical product(s) into the steam used for the steam-out. In some cases, said chemical product(s) can also be introduced in the nitrogen.

In one preferred embodiment, the present invention provides a sole method to both clean the equipment and to make it gas-free and safe for entry, thereby reducing downtime and improving environmental performance and operational safety. In this way the present invention achieves the simultaneous benefit of quick and safe equipment cleaning and quick and effective achievement of gas-free/safe entry conditions, thereby contributing to dramatically reduce downtime (e.g., by eliminating the mechanical cleaning time) and hence production loss and to improve safety.

The chemical products used for achieving gas-free/safe entry conditions under the present invention are selected from the group consisting of: non-ionic surfactants, anionic surfactants, terpenes derivatives, emulsifiers, hydrogen sulphide scavengers, mercury scavengers and their mixtures in any proportion, including their aqueous solutions.

Among the anionic and non-ionic surfactants are to be preferred the ones selected from the group consisting of: alkyl-, aryl-, or alkylaryl-benzensulphonates of general formula $RC_6H_4SO_3M$ wherein R is a hydrocarbyl substituent $C_8$-$C_{20}$ and M is the ion H, Na, Ca, ammonium, triethanolammonium, isopropylammonium; dialkylsulfosuccinates of general formula $RO_2CCH_2CH(SO_3Na)CO_2R$ wherein R is a hydrocarbyl substituent $C_2$-$C_{20}$; alkylsulfates of general formula $ROSO_3M$ wherein R is a hydrocarbyl substituent $C_5$-$C_{20}$ and M is the ion sodium, ammonium, triethanolammonium; ethoxylated and sulphated alcohols of general formula $R—(—OCH_2CH_2—)_n—OSO_3M$ wherein R is a hydrocarbyl substituent $C_5$-$C_{20}$, n=1-5 and M is the ion sodium, ammonium, triethanolammonium; ethoxylated and sulphated alkyphenols of general formula $RC_6H_6—(—OCH_2CH_2—)_n—OSO_3M$ wherein R is a hydrocarbyl substituent $C_5$-$C_{20}$, n=1-5 and M is the ion sodium, ammonium, triethanolammonium; ethoxylated alcohols of general formula $R—(—O—CH_2CH_2—)_n—OH$ wherein R is a hydrocarbyl substituent $C_5$-$C_{30}$, n=1-30; ethoxylated alkyl phenols of general formula $RC_6H_4—(—OCH_2CH_2—)_n—OH$ wherein R is an hydrocarbyl substituent $C_5$-$C_{30}$, n=1-40; mono- and di-fatty acids glyceric esters wherein acid contains a hydrocarbyl substituent $C_{10}$-$C_{40}$; mono- and di-polyoxyethylene esters of oils and fatty acids of general formula $RCO—(—OC_2H_4—)_n—OH$ and $RCO—(—OC_2H_4—)_n—OOCR$ wherein the oil is of the "tall oil" or "rosin oil" type, n=1-40 and the acid contains a hydrocarbyl substituent $C_{10}$-$C_{40}$; ethoxylated "castor oils" (castor oil is a triglyceride abundant in ricinoleic esters) containing a number of polyethoxylated ethylene oxide groups variable between 5 and 200; mono- and di-ethanolamides of fatty acids of general formula $RCONHC_2H_4OOCR$ and $RCON(C_2H_4OH)C_2H_4OOCR$ wherein R is a hydrocarbyl substituent $C_{10}$-$C_{40}$; surfactants of poly(oxyethylene-co-oxypropylene), also known as block polymer, having a molecular weight of 50-10000; mono-, di- and poly-aliphatic amines derived from fatty acids, such as $RNHCH_2CH_2CH_2NH_2$ wherein R is a hydrocarbyl substituent $C_{10}$-$C_{40}$; N-alkyltrimethylendiamines of general formula

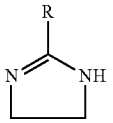

wherein R is a hydrocarbyl substituent $C_{10}$-$C_{40}$; 2-alkyl-2-imidazolines of general formula

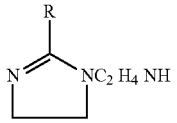

wherein R is a hydrocarbyl substituent $C_{10}$-$C_{40}$; amine oxides of general formula $RNO(CH_3)_2$ and $RNO(C_2H_4OH)_2$ wherein R is a hydrocarbyl substituent $C_1$-$C_{20}$; ethoxylated alkylamines of general formula

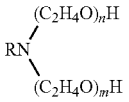

wherein m+n=2-40; 2-alkyl-1-(2-hydroxyethyl)-2-imidazolines of general formula

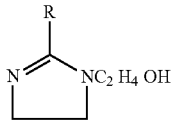

wherein R is a hydrocarbyl substituent $C_{10}$-$C_{40}$; alkoxylated ethylendiamines of general formula

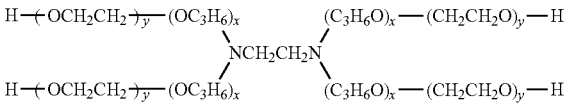

wherein x and y=4-100;

Among the terpenic products derivatives are to be preferred those selected from the group consisting of: limonene, pinene, canfor, menthol, eucalipthol, eugenhol, geraniol, thymol.

Among the emulsifiers are to be preferred those selected from the group consisting of: Tween 60, Tween 80, nonyl phenol polyethylene glicol ether, oleates, sorbitan oleates, glycerol monostearate, nonyl phenol ethoxylates, iso-propyl palmitate, polyglycerol esters of fatty acids, tridecyl alcohol ethoxylates, fatty alcohol ethoxylates, linear alkyl benzene sulphonic acid, dioctyl phthalate, sodium tripolyphosphate, citric acid, soybean oleic acid, trisodium phosphate, sodium dodecyl sulfate, didecyl dimethyl ammonium chloride, oleic acid diethanolamine, dodecyl dimethyl benzil ammonium chloride, sodium acetate, oleamide, polyethylen glycol, lanolin, ethoxylated (E20) sorbitan monooleate, sorbitan monooleate, sulfosuccinammates.

Among the $H_2S$ scavengers are to be preferred those selected from the group consisting of: diethanolamine, monoethanolamine, methyl-diethanolamine, diisopropylamine, formaldehyde, maleimides, amidines, polyamidines, glyoxal, sodium nitrite, reaction products of polyamide-formaldehyde, triazines, carboxamides, alkylcarboxyl-azo compounds, cumine-peroxide compounds, bisoxazolidines, glycidyl ethers, potassium formate.

Among the mercury scavengers are to be preferred those selected from the group consisting of: thiourea, caustic soda, sodium carbonate, trimercapto-s-triazine trisodium salt.

By referring to the attached drawings, in FIG. 1 is reported an exemplary schematic diagram of a conventional Crude Distillation Unit. In the FIGS. 2-11 are reported some illustrative examples of the present invention. For sake of illustrative simplicity, the present invention is exemplary illustrated into more details in the application of a CDU (Crude Distillation Unit). It is understood, such illustrative exemplification do not limit in any way the present invention, which is applicable to any petroleum plant. The CDU has been chosen in that it contains feed preheat, distillation and distillated products recovery systems, which are similar to the ones of other petroleum plants.

FIG. 1 is an exemplary schematic diagram of a conventional Crude Distillation Unit, normally located inside a petroleum refinery. During the normal production cycle, the plant feed coming from a tank (28) is pumped to the plant battery limits and then to the feed line (29), hence by means of pump (1) is sent to heat exchangers (2), (4), (5), (6) to get a preheat and then in a desalter (7) to reduce the salts content. At the desalter's outlet, the pump (8) sends the crude to the heat exchangers (9), (10), (11), (12) and then the feed is sent to the furnace (13) and, by means of line (31), to the distillation column (14). The distillation column residue, by means of line (32), pump (22) and line (33), is sent to the exchangers (11) and (12) to preheat the feed and then, by means of line (21), is sent to another petroleum plant and/or to storage (24). The products at the distillation column outlet enter in some strippers (15), wherein by injection of steam they are further purified. The distillates gathering at strippers' bottoms are pumped out of the plant by means of pumps (16), (17), (18), (19). Before being sent to other petroleum plants and/or to storage tanks (25), (26), (27), (23) the distillates give their sensible heat to the cold crude entering the plant in the heat exchangers (4), (5), (6), (10), (9). To control the thermal profile of the distillation column (14) are installed pumparound systems, which withdraw the distillates at a certain height by means of pumps (35), (36), (37), let them cool down in the exchangers (38), (39), (40) and re-introduce them into the column by means of lines (204), (203), (202). The pumparound also exchange heat with the crude preheat train (for sake of illustrative simplicity such thermal integration is not reported in this and the other figures). The produced gasoline from the overhead, by means of pump (42) and line (111), is on one part sent to storage and/or to other plants (41), by means of line (112), and on the other part is refluxed in the column by means of line (113). The partitioning of the two streams is made, e.g., by regulating the pneumatic valves placed in the lines (112) and (113); for sake of illustrative simplicity all of the control/regulation systems typical of the petroleum plant are not reported in this and the other figures).

The general layout of the petroleum plants schematically consists of a feed inlet, a preheat system (e.g., by means of heat exchangers), a heating system (e.g., a furnace to reach the process temperature) and a distillation system. The distillation column is provided with pumparounds/reflux to regulate its thermal profile and set the distillation intervals of the products exiting the plant. In the state of the art, systems for internal circulation of distillates do not exist, which are used during plant run to withdraw a distillate from any point of the plant and introduce said distillate in any other point of the plant (e.g., at a location not associated with the distillation column and/or one associated with a distillation column) with the scope of equipment cleaning and/or increase distillation yield and/or reduce coke formation and/or coke removal on catalysts.

The only petroleum plant which is equipped with an internal circulation system to the feed during the run is the Coking. The circulation of a distillate (generally heavy gas oil) into the feed is however dictated by the fact, that this is the only petroleum plant wherein the feed enters directly the distillation column; said circulation makes up therefore the bottom pumparound. As a matter of fact, such circulation is utilized to regulate the final boiling point of the heavy gas oil and not for the scopes of the present invention. Moreover, a high recycle ratio (quantity of heavy gas oil/quantity of feed) has a detrimental effect on the distillation yield, in that it increases the pressure in the coke drums. The state of the art trend for this particular petroleum plant is therefore the one of reducing the recycle ratio and in the market are already operative Coking plants which do not recycle distillates on the feed (zero recycle ratio).

In the FIGS. 2, 3, 4, 5, 6 and 7 are reported some illustrative examples of the present invention for the CDU. Similar examples of the present invention can be applied to any petroleum plant.

The plant cleaning can occur in one single phase or in subsequent phases.

Figure 2:
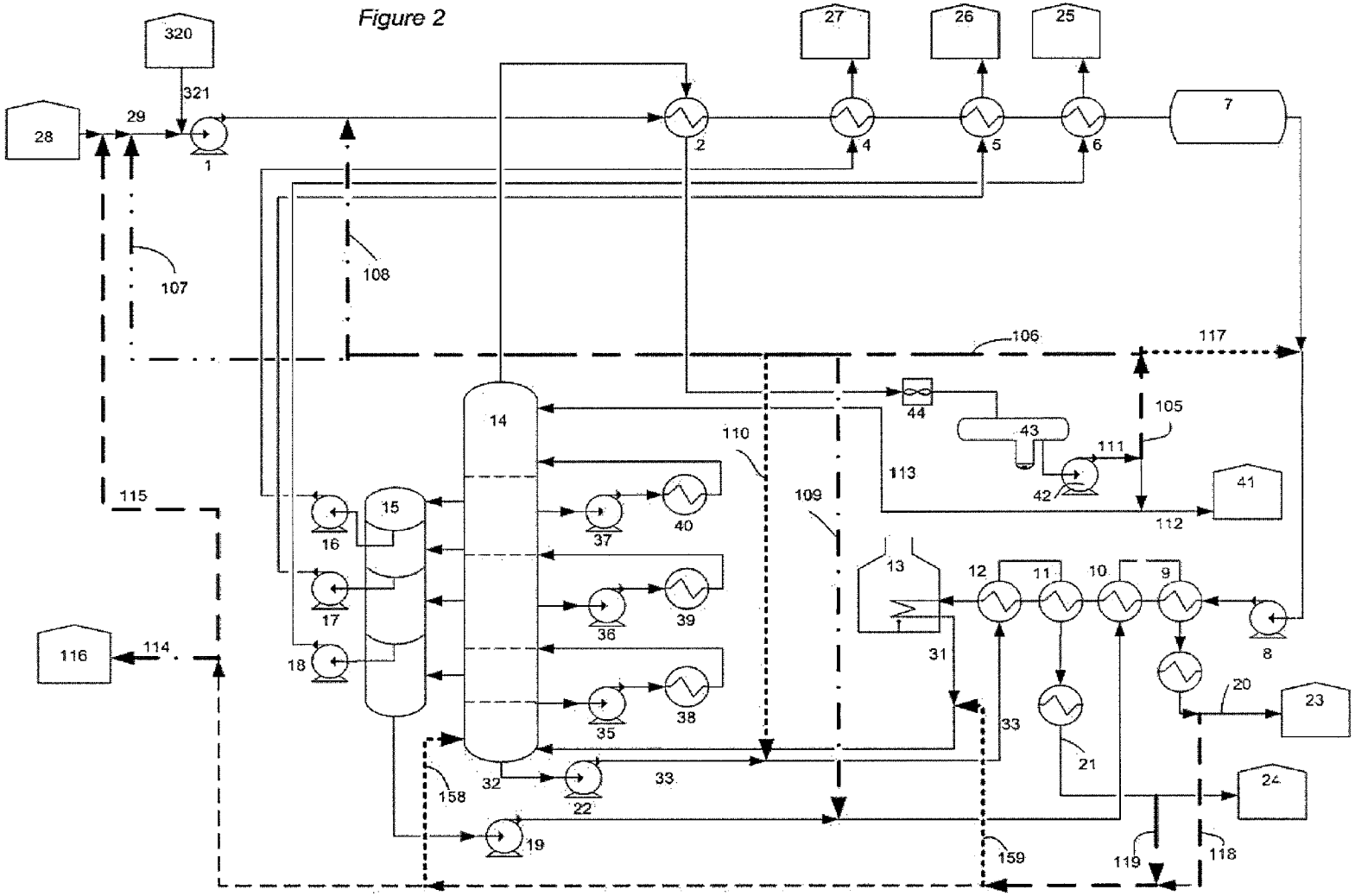
FIGS. 2 through 7 are schematic diagrams of different applications of the present invention in a Crude Distillation Unit.

FIG. 2 shows configurations of the present invention inclusive of an arrangement, such as to make up an apparatus under the present invention, wherein, on the discharge of gasoline pump (42), line (105) is inserted to facilitate the circulation of gasoline to one or more desired points of the plant. The first and/or second hydrocarbon fluid is, e.g., taken from tank (320) and sent to the suction of feed pump (1) by means of line (321). From the line (105) there is branched, for example: i) a line (117) to send the gasoline downstream of the desalter (7); ii) a line (106) to send the gasoline to the suction of feed pump (1) by means of line (107) or to the discharge of feed pump (1) by means of line (108); iii) a line (110) to send the gasoline to the suction or to the discharge of bottom pump (22); iv) a line (109) to send the gasoline in the suction or in the discharge of heavy gas oil pump (19). In the case gasoline sent to the bottom pump (22), a portion or all of the residue thereby modified, instead of being sent to storage or another plant (24), can be deviated from the line (21) by means of a line (119) and hence be sent, e.g., to a tank for out of specification products (116) by means of line (114) and/or for being circulated with the feed by means of line (115); in such latter case, the flowrate will be regulated so as to control the bottom level in the distillation column (14) according to methods well known in the state of the art. In the case the gasoline is sent to the heavy gas oil pump (19), a portion or all of the heavy gas oil thereby modified, instead of being sent to storage or another plant (23) can be deviated from the line (20) by means of a line (118) and hence be sent to a tank (116) (e.g., an out of specification products tank or a slop tank) by means of line (114) and/or being circulated in the feed by means of line (115) or any other dedicated line, not represented in the figure, save the considerations on the level of distillation column (14) and/or any other operative constrain, well known and manageable in the art. An additional circulation possibility is for example the introduction directly in the column (14), by means of a line (158) or directly in the line a furnace outlet (31) by means of line (159). The line (158) under the present invention differentiates from a pumparound line in that, for example: i) it has a different purpose (i.e., a treatment under the present invention vs. controlling the temperature profile of the column); and/or ii) the fluid which passes through it contains first and/or a second hydrocarbon fluid(s) under the present invention; and/or iii) the composition of the fluid which passes through it is different than the one which passes through a pumparound line; and/or iv) the ratio among the components of the fluid which passes through it is different than the one which passes through a pumparound line; and/or v) the temperature of the fluid which passes through it is different than the one which passes through a pumparound line. Furthermore, in a pumparound the withdrawal point is always only one and only from the distillation column, while in the line (158) the withdrawal point(s) can be one or more and from any point(s) of the plant. Additionally, a pumparound system is always made up by more than one pumparound, preferably three (top, medium, bottom), while the line (158), in the illustrated embodiment, is only one. In the cases of lines (158)/(159) will also apply the same considerations on the control of column (14) bottom level and/or any other operative constrain, well known and manageable in the art. Whenever the monitoring system would detect in the plant an insufficient amount of the first and/or the second hydrocarbon fluid, said fluid(s) can be re-introduced in the plant. The gasoline circulated by means of line (105) can indifferently be sent in any suitable point of the plant, e.g., in the suction or the discharge of plant pumps, by taking into account the normal process and/or operative considerations (e.g., pump cavitation).

Embodiments of the present invention therefore comprise all of the design/engineering part of plant modification(s) to be implemented, such as to make up an apparatus under the present invention suitable, to realize features of the present invention. For example, lines (105), (106), (107), (108), (109), (110), (117), (118), (119), (114), (115), when featured in an embodiment (e.g., one or more as in all or some combination of said lines) are calculated by considering the design operating conditions relative to the plant, equipped with suitable equipment as shut-off valves and/or, flow controlling valves (e.g., a pneumatic valve) in order to control the distillate(s) flow which is circulated, as well as all of the other control means (e.g., temperature, pressure) and devices well known in the state of the art and in particular in the design/engineering of petroleum plants. The method of the present invention can also be applied by utilizing additional configurations/modifications of the plant.

Figure 3:
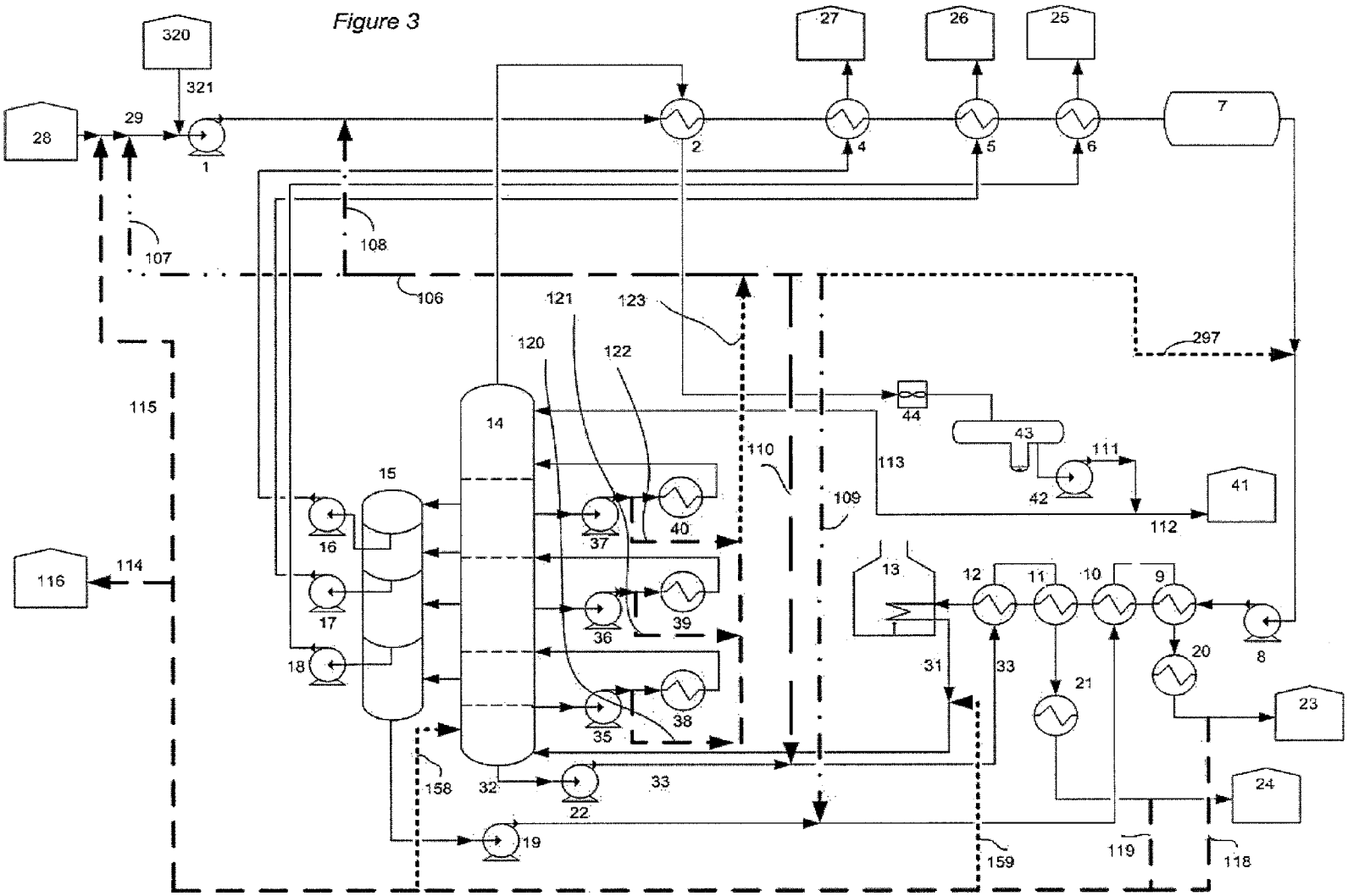

FIG. 3 illustrate additional configurations of the present invention inclusive of an arrangement, such as to make up an apparatus under the present invention, wherein in the discharge of pumparound pumps (35) and/or (36) and/or (37) are inserted the lines (120) and/or (121) and/or (122) for circulation of distillates in one or more of any points of the plant; said lines by means of the line (123) can thereafter branch to any one or more additional points of the plant. The lines (120) and/or (121) and/or (122) can be derived upstream and/or downstream of the heat exchangers (38) and/or (39) and/or (40) of the pumparound system. From the line (123) can branch, as previously described in FIG. 2, e.g., one or more (including any sub-combination) of the lines (297), (106), (107), (108), (110), (109). As per the lines (119), (114), (115), (118), (158), (159) they will apply the same considerations as illustrated in FIG. 2. Whenever the monitoring system detects in the plant an insufficient amount of the first and/or the second hydrocarbon fluid, said fluid(s) can be re-introduced in the plant. The distillate circulated by means of line (123) can indifferently be sent in any suitable point(s) of the plant, e.g., in the suction and/or the discharge of plant pumps, by taking into account the normal process and/or operative considerations (e.g., pump cavitation).

Figure 4:
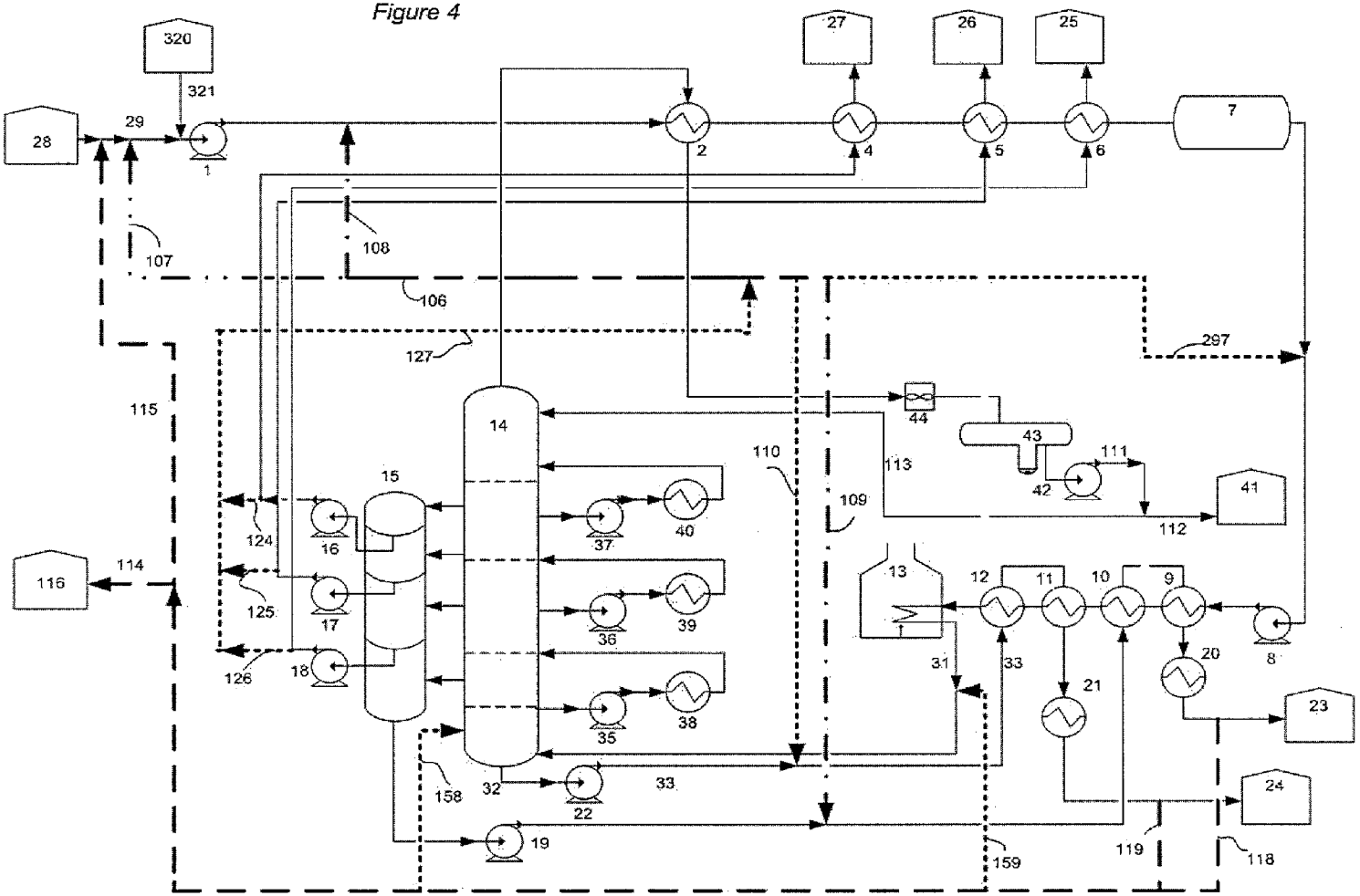

FIG. 4 illustrates a further configuration of the present invention, inclusive of an arrangement, such as to make up an apparatus under the present invention, wherein in the discharge of distillate pumps (16) and/or (17) and/or (18) are inserted the lines (124) and/or (125) and/or (126) for the circulation of distillates in any one or more points of the plant; said lines by means of the line (127) can thereafter branch in any one or more points of the plant. For example, the lines (124) and/or (125) and/or (126) can be derived upstream and/or downstream of the heat exchangers (4) and/or (5) and/or (6) of the plant. From the line (127) can branch, as previously described in FIG. 2, e.g., one or more (or any sub-combination of the lines (297), (106), (107), (108), (110), (109). As per the lines (119), (114), (115), (118), (158), (159) they will apply the same considerations as illustrated in FIG. 2. Whenever the monitoring system would detect in the plant an insufficient amount of the first and/or the second hydrocarbon fluid, said fluid(s) can be re-introduced in the plant. The distillate circulated by means of line (127) can indifferently be sent in any suitable point or points of the plant, e.g., in the suction or the discharge of plant pumps, by taking into account the normal process and/or operative considerations (e.g., pump cavitation).

Still further applicative examples can be developed by being encompassed into the scopes of the present invention; for example, the discharge of heavy gas oil pump (19) could also be branched and sent in any point or points of the plant.

Figure 5:
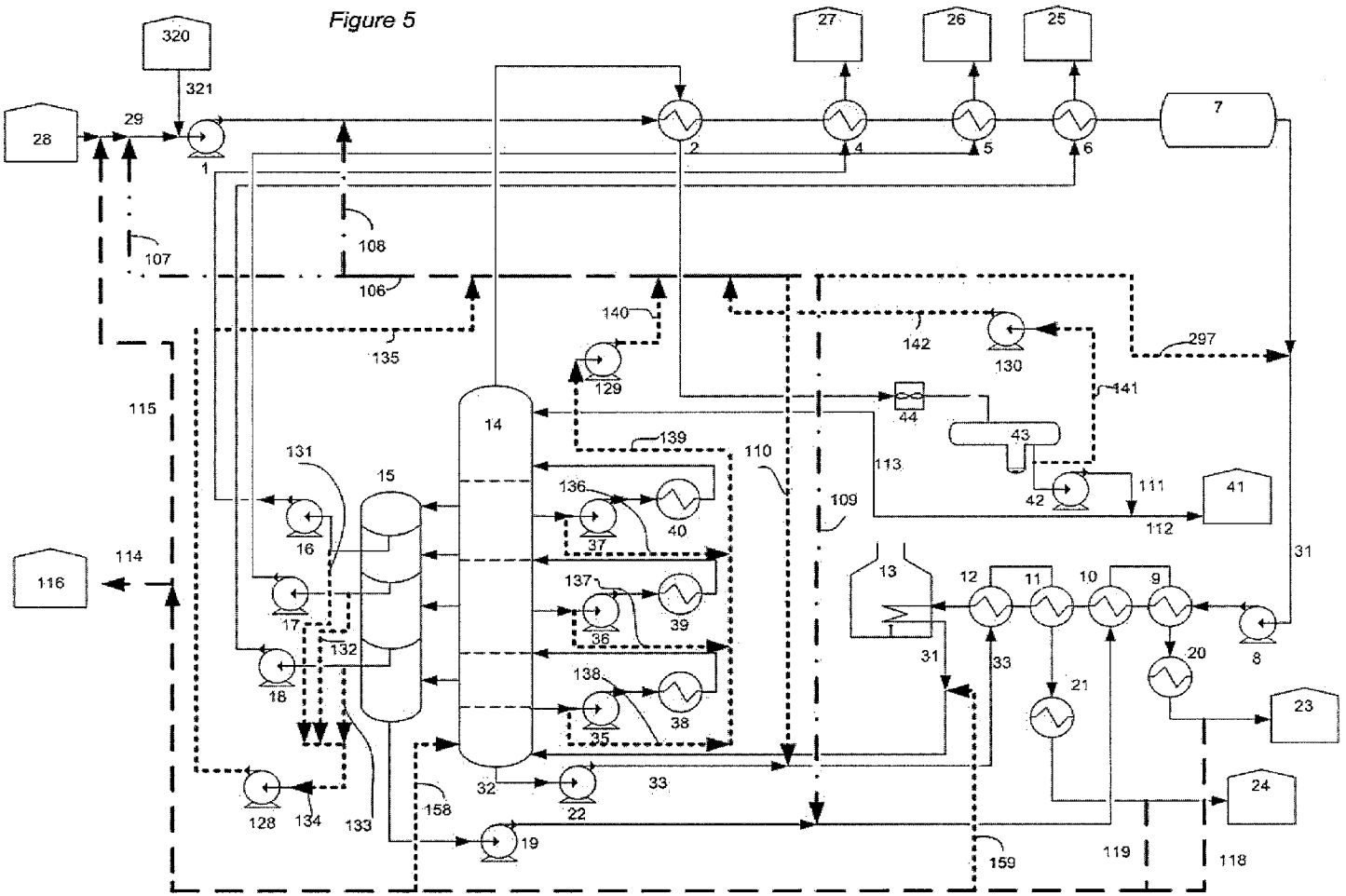

FIG. 5 illustrates a further example of configurations of the present invention including an arrangement, such as to make up an apparatus under the present invention, wherein the pumps (128) and/or (129) and/or (130) are installed on purpose to withdraw distillates and send them to any one or more points of the plant. In such a case the lines (131) and/or (132) and/or (133) are, e.g., installed on distillates withdrawal means, as in the suction of pumps (16) and/or (17) and/or (18), and hence, in one embodiment, the line (134) is connected to the suction of pump (128); the line (135) at pump (128) discharge is branched as previously described. The lines (136) and/or (137) and/or (138) are, e.g., installed on a pumparound withdrawal, in the suction of pumps (37) and/or (36) and/or (35), and hence the line (139) is connected to the suction of pump (129); the line (140) at the pump (129) discharge is branched as previously described. The line (141) is installed on the gasoline withdrawal, in the suction of pump (42); the line (142) at pump (130) discharge is branched as previously described.

In the case wherein one or more pump(s) are installed on purpose to withdraw one or more distillate(s) and to introduce it (them) in any point or points of the plant (e.g., at a location not associated with the distillation column and/or one associated with a distillation column), the same pump(s) can be arranged, e.g., to withdraw one or more distalles (e.g., by arranging more suctions, with each one preferably equipped with at least one shut-off valve) and send them to any point(s) of the plant (e.g., by arranging more discharges, with each one preferably equipped with at least one shut-off valve).

The scopes of the present invention also comprise the design/engineering of plant modifications to be implemented, such to make up an apparatus under the present invention, to realize the present invention. For example, all or some sub-combination of the respective lines (105), (106), (107), (108), (109), (110), (297), (112), (113), (114), (115), if utilized, should be calculated by taking into account the operating conditions, should preferably be equipped with flow control valves, e.g., a pneumatic valve, in order to control the distillate flowrate which is circulated, as well as with other control means (e.g., temperature, pressure) and devices well known in the state of the art and in particular in the design/engineering of petroleum plants; the pumps (128), (129), (130), if some or all are utilized, should be dimensioned by taking into account the circulating distillate flowrate and the process conditions in the withdrawal/introduction point(s). All of the design/engineering should also take into account when applicable to the apparatus utilized under the present invention all other aspects well known in the state of the art, like, e.g., thermal balancing, safety, operating management, etc.

For the scopes of the present invention also existing circulation lines, which have been designed in the plant for different purposes, can be used.

Figure 6:
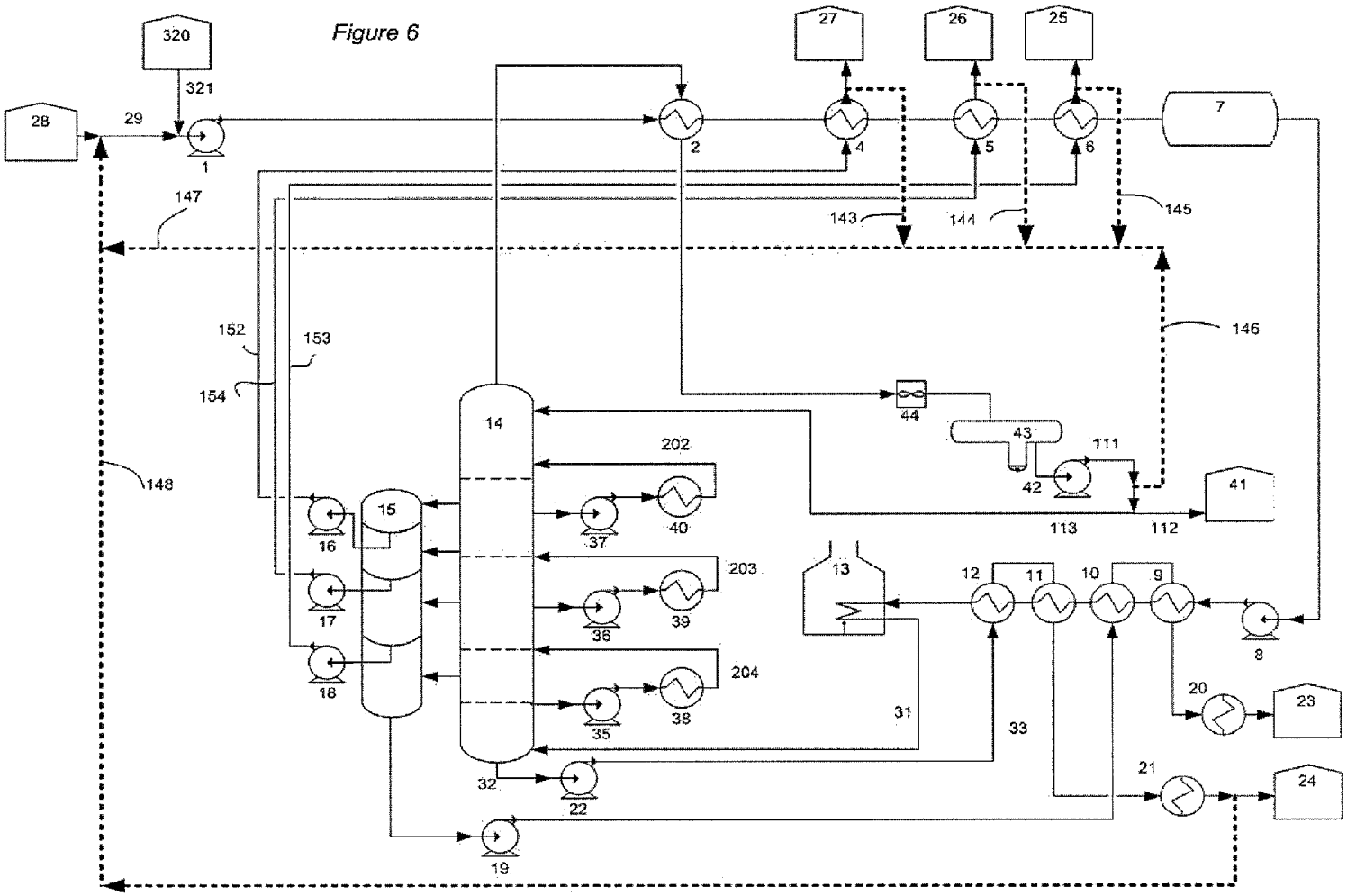

FIG. 6 illustrates additional configurations, including an arrangement of the present invention, such as to make up an apparatus under the present invention, wherein the circulation of distillates is realized by using lines of the petroleum plant, which are normally utilized for other purposes. For example, in the start-up phase only, the lines (143), (144), (145), (146) allow the circulation of distillates until the normal operating conditions (or a normal operating state) of the plant are reached and the distillates meet the specifications, so they can be pumped out from the plant. As a matter of fact, until the normal operating conditions are reached the distillation products are out of specification and cannot be pumped out to storage and/or another plant. Therefore it may exist in the plant a line (147) which collects all of the out of specification distillates during the start-up phase (wherein the process temperature is increased slowly in the furnace, from ambient temperature to process temperature, and the distillation column's thermal profile is not the one of normal operating conditions), introducing them in the feed line (29) directly or by means of the residue circulation line (148), which is also utilized in the start-up phase to circulate the out of specification residue. The residue circulation line can also be utilized to keep the plant warm when the plant is not producing (e.g., there is a contingency in another plant, or a contingency in market conditions), but the owner wants to have it "ready to go".

The lines (143), (144), (145), (146), (147), (148), wherever existing, are currently used for scopes which are different from the ones of the present invention; moreover, they do not circulate a first and/or second hydrocarbon fluid under the present invention and their operation is not dictated by the method under the present invention. For the scopes of the present invention, one or more (or any sub-combination) of the lines (143), (144), (145), (146), (147), (148) are used to circulate a first and/or second hydrocarbon fluid under the present invention, according to the method of the present invention.

As evident to those skilled in the art, under the present invention, different closed or semi-closed loops can be defined, which circulate one or more distillates to satisfy the requirements of different petroleum plants, without departing from the scopes of the present invention. All the possible layouts of closed or semi-closed loops, which circulate one or more distillates whereas the plant is under production conditions are therefore encompassed by the scopes of the present invention.

For example, the heating system of the closed or semi-closed loops can be part of another petroleum plant and be effectively connected with the equipment to be cleaned, such to realize a closed or semi-closed loop with this.

In another illustrative example, the pumps installed on purpose can be e.g., cart- or skid-mounted, such that the same pump can be used in different locations of the plant or in other plants. In still a further illustrative example, one or more pump(s) installed on purpose can have one or more suction(s) and/or discharge(s) in order to suck from one or more points of the plant or another plant and/or discharge the circulating fluids in different point(s) of the same or other plants.

Figure 7:
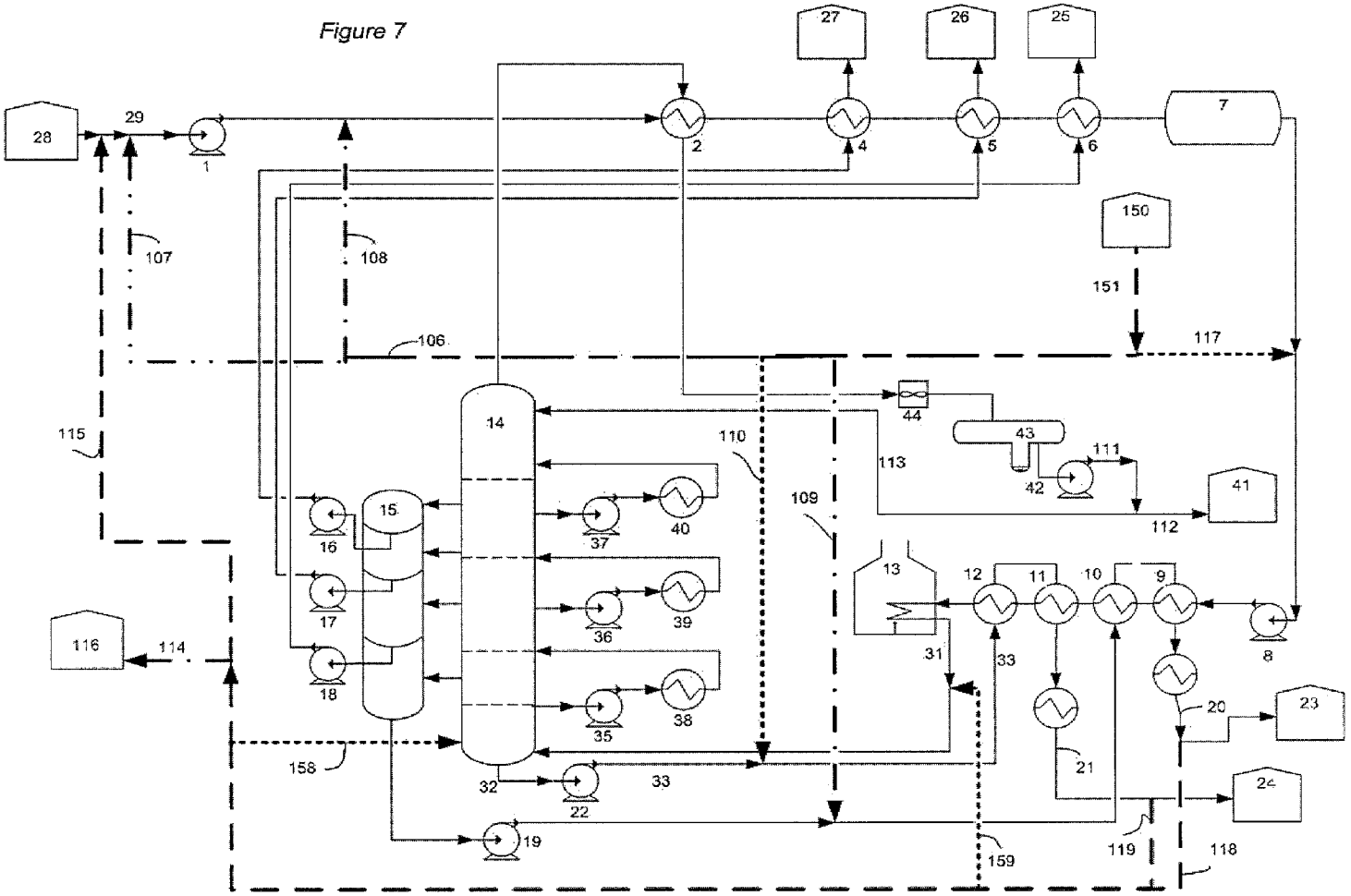

FIG. 7 illustrates additional configurations of the present invention, inclusive of an arrangement, such as to make up an apparatus under the present invention, wherein the first and/or second hydrocarbon fluid is introduced from a tank and/or another plant (150) and pumped in the plant by means of line (151), from there it is branched to one or more (or any sub-combination) of the lines (117), (106), (107), (108), (109), (110) as previously described (inclusive here, above and below, of block off or redirect valving or passage and/or the lack of one of more lines in the closed or semi-closed loop at the design stage). Also, per the lines (119), (114), (115), (118), (158), (159) they will apply the same considerations as illustrated in FIG. 2.

Figure 8:
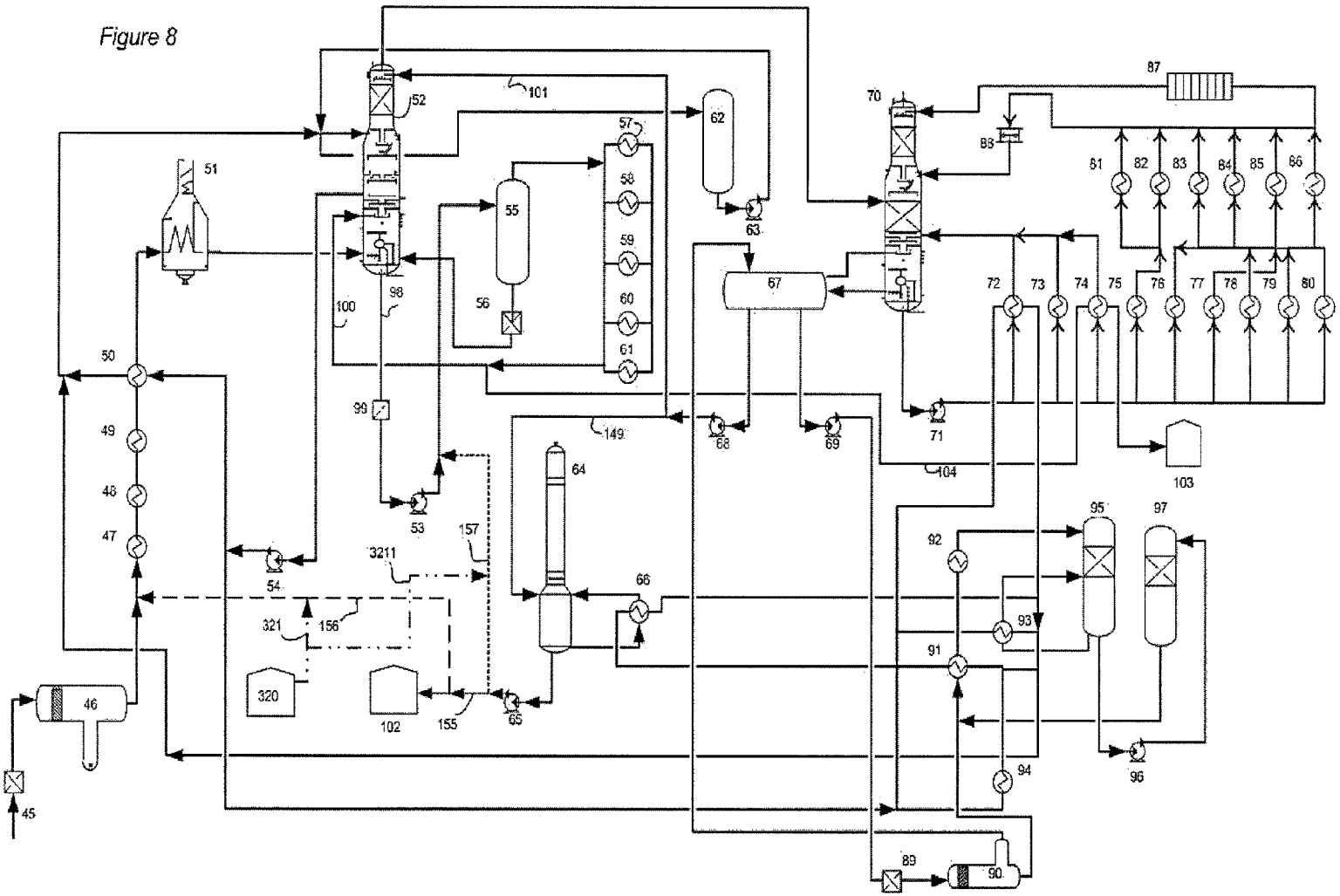
FIG. 8 is a schematic diagram for carrying out the present invention in an Ethylene Unit.

FIG. 8 illustrates additional configurations of realization of the present invention in the case of an Ethylene plant. In a typical Ethylene plant, e.g., one preferably with a current liquid feed, during the normal production cycle, the bottom product of the fractionation column (52) is sent, by means of line (98), filter (99) and pump (53) into hydrocyclones (55) and from there to heat exchangers (57), (58), (59), (60), (61). In such a way the column bottom product is cooled and re-introduced in the column (52) by means of line (100), thereby making up the so-named "quench" or "quench oil". A portion of the quench oil is sent, by means of line (104), to additional cooling in the exchanger (74) and hence to storage (103). The overhead of the fractionator (52) enters the quench column (70) wherein the process gas is cooled down and separated from the gasoline (pyrolysis gasoline), which is further separated in a separator (67), wherein by means of a pump (68) and a line (101) is on one part refluxed in the top of fractionator (52) and on the other part, by means of line (149), sent to a stripper (64), to be sent to storage (102) by means of pump (65) and line (155). The plant also includes, among the others, the "middle oil" loop, comprising the exchangers (50), (94), (91), (93), (66), (72); the cooling system of the quench tower (70), comprising the exchangers from (72) to (88); the condensate stripper (95) and the recycle gas separator (97). During the normal run of the Ethylene plant, for example, the exchangers (57), (58), (59), (60), (61) are fouled by the heavy compounds which are presents in the column bottom product and are therefore opened, extracted and mechanically cleaned. Additional fouling is also experienced, for example, in the quench tower exchangers from (72) to (88) and in the separator (67).

For the scopes of the present invention the equipment cleaning (treatment) during the run of the Ethylene plant can be performed, e.g., by inserting a line (156)—which is not included/provided in the original design—to send the gasoline from pump (65) to the preheat train (47), (48), (49), (50). Another line (157) can also be inserted, e.g., to send the gasoline on pump (53) for cleaning the items (55), (56), (57), (58), (59), (60), (61). In this case will also apply the considerations already made about the modification/design/engineering/management/operations of plants, concerning the installation of pumps, dedicated lines, etc. The first and/or second hydrocarbon fluid(s) under the present invention can be introduced, e.g., in the line (156) and/or in the line (157), e.g., by coming from a tank (320) and by means of lines (321) and/or (3211).

The above applies for any quench oil loop or any loop in a petroleum plant, for example the quench of a Visbreaker or the slurry oil loop of an FCCU.

Figure 9:
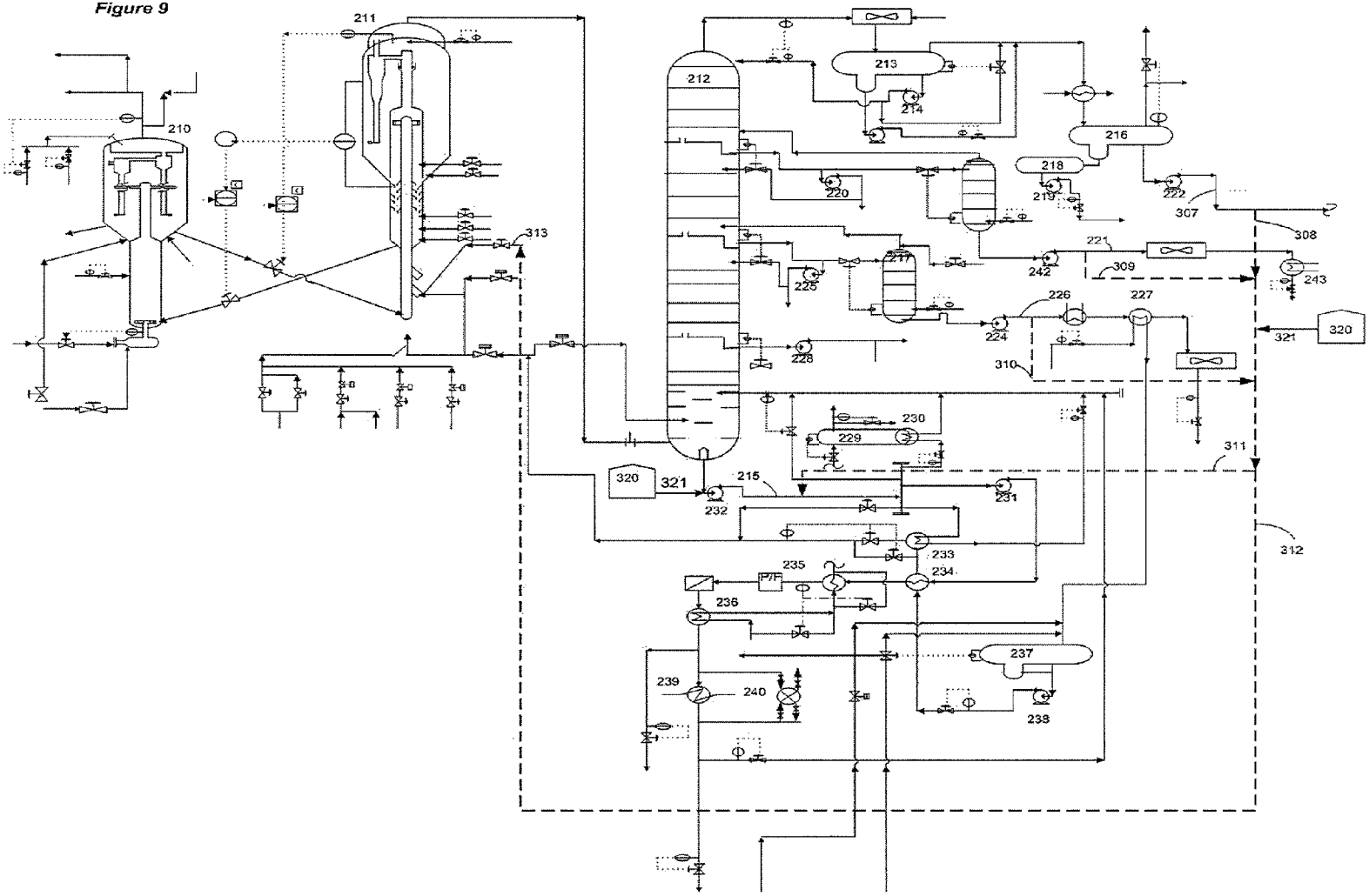
FIG. 9 is a schematic diagram for carrying out the present invention in an FCC Unit.

FIG. 9 illustrates still further configurations of the present invention in the case of an FCCU. In the case of an FCC plant, in an embodiment of the present invention, e.g., to clean the slurry loop (230, 231, 232, 233, 234, 235, 236, 239, 240) a line (308) is installed on the discharge line (307) of the pump (222) in order to send the distillate in the suction/discharge of the bottom pump (232). As previously described, other distillate lines (309) and/or (310) might also be used thereby sending all the distillates to a collector (311) and hence in the pump (232). In the same way, an external pump can be installed (not reported in the figure). From the collector (311) there can also branch a line (312) to send the distillated and/or the first and/or second hydrocarbon fluid(s) in the feed line (313) and hence to the reactor (211). Said line (312) can also be useful in other embodiments of the present invention, e.g., to increase distillation yield and/or to reduce coke formation on catalyst. The same or a different first and/or second hydrocarbon fluid(s) (e.g., from any of the above noted possible sources, such as a source tank like (320)) under the present invention can come, e.g., (alternatively or in supplemental fashion to the distilled circulation input) from a tank (320) and hence by means of a line (321) introduced in any of the lines (308), (309), (310), (311), (312), or in the suction of pump (232). As previously described, the first and/or second hydrocarbon fluid(s) can be re-introduced in the loop whenever it's (their) concentration in the closed or semi-closed loop is insufficient relative to the scopes of the present invention.

Figure 10:
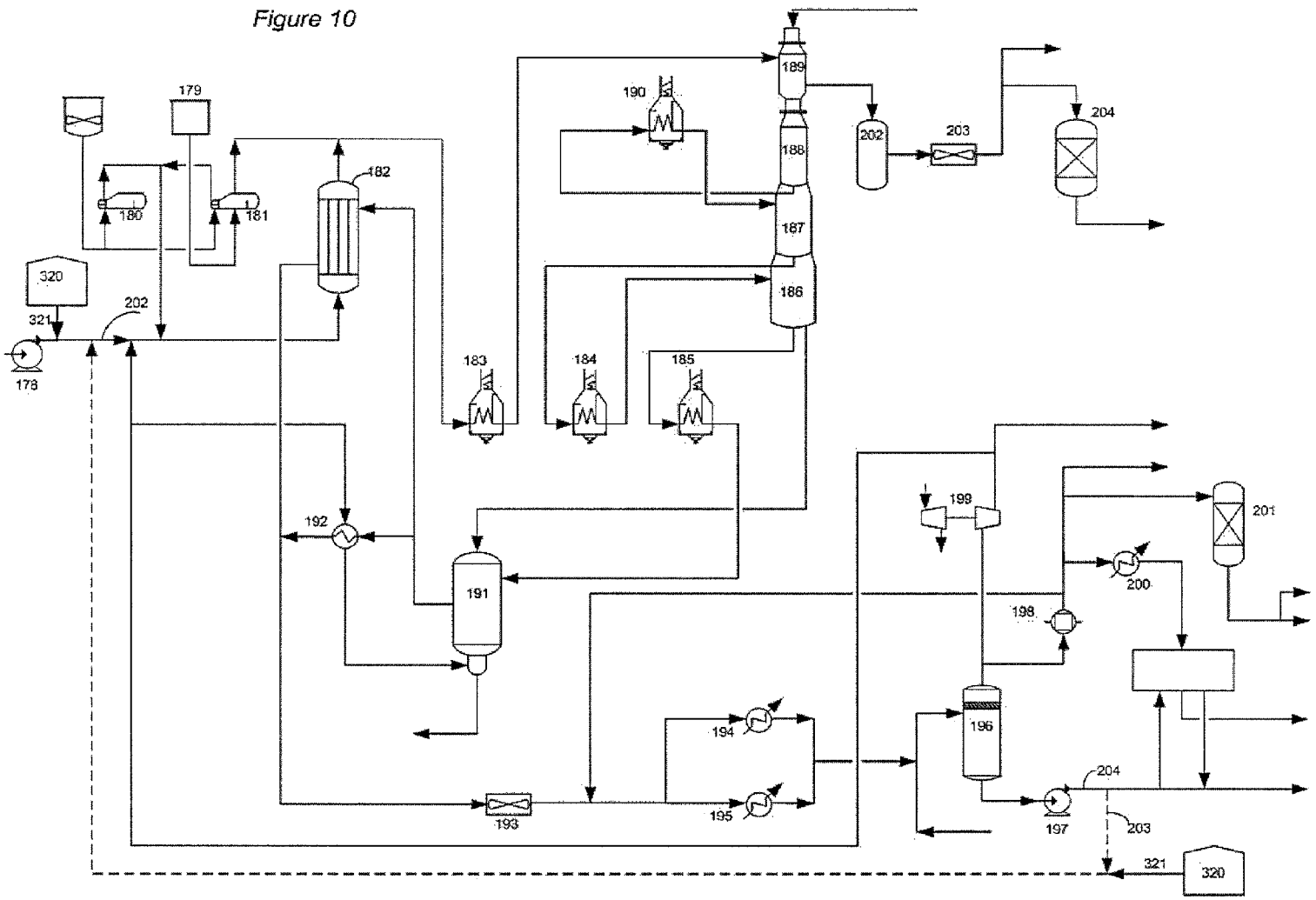
FIG. 10 is a schematic diagram for carrying out the present invention in a CCR Unit.

FIG. 10 illustrates additional configurations of the present invention in the case of a CCR (Continuous Catalytic Reforming) plant. In a CCR plant the present invention can be applied to clean, e.g., the feed/effluent exchanger(s) (182) by installing in the discharge line (204) of pump (197) a line (203) to send the distillate in the line (202) in the discharge of feed pump (or in the suction, not reported in the figure). The first and/or second hydrocarbon fluid(s) can, e.g., (alternatively or in supplemental fashion to the distilled circulation input) come from a tank (320) and, by means of a line (321), be introduced in the line (203) or in the line (202). As previously described, other distillates lines can also be used (which are not reported in the figure). In the same way, it can be installed on purpose an external pump (not reported in the figure). It is worth to note, the same arrangement described hereinabove, can also simultaneously realize additional embodiments of the present invention, e.g., while achieving the cleaning of the equipment (in this case the feed-preheat heat exchanger(s)) simultaneously achieving the reduction of coke formation on catalyst and/or coke removal on catalyst. This can be done by proper selection of the first and/or the second hydrocarbon fluid(s) under the present invention.

Figure 11:
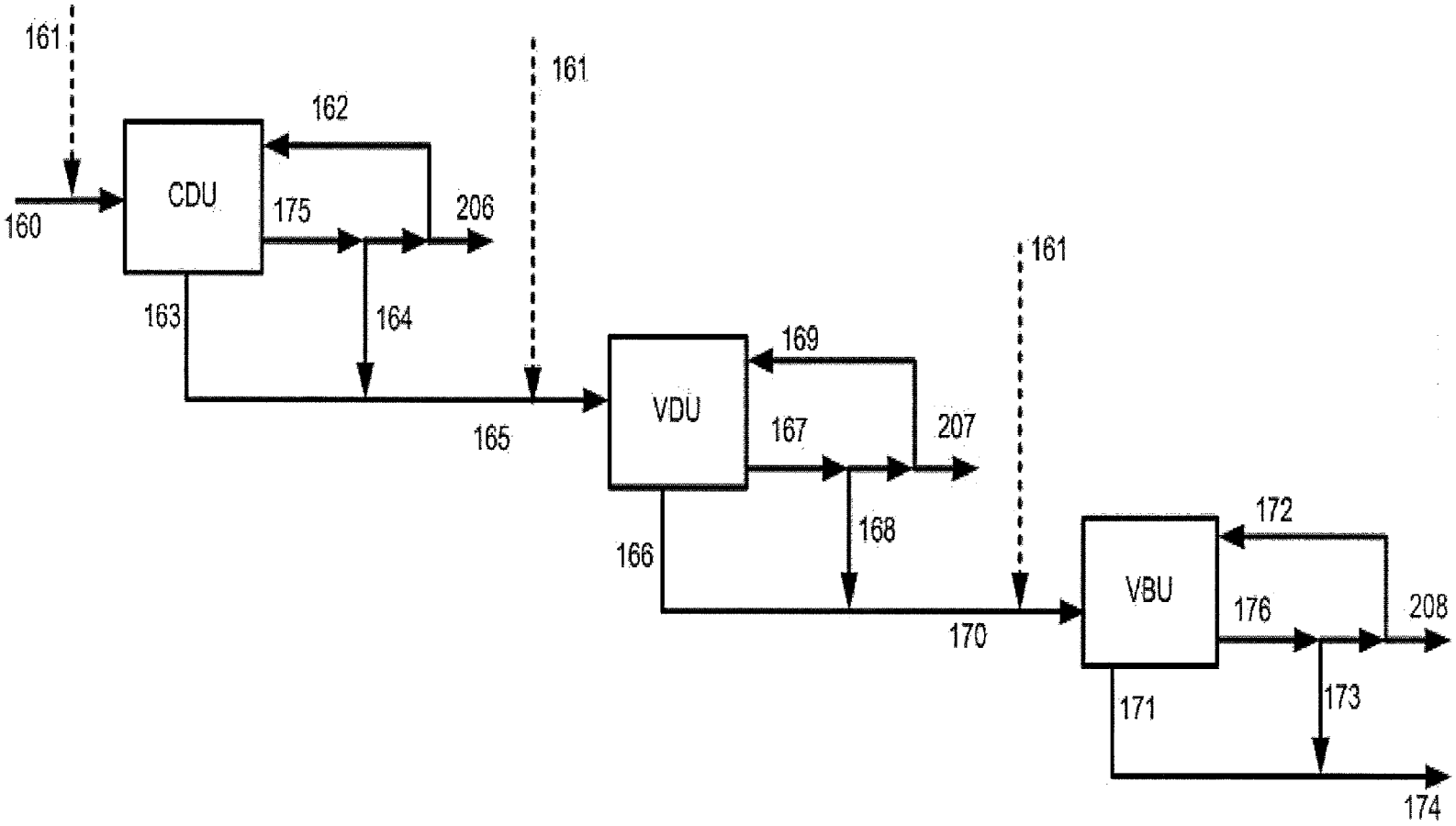
FIG. 11 is a schematic diagram for carrying out the present invention simultaneously in a CDU, VDU and VBU.

FIG. 11 illustrates an exemplary schematic of an additional embodiment of the present invention, wherein the hydrocarbon fluid(s) under the present invention is (are) sent in a cascade mode to other plants, in order to provide the simultaneous cleaning (treatment) of a plant and one or more plants which are downstream from said plant. In the case of FIG. 11 are simultaneously cleaned (treated) the plants CDU, Vacuum (VDU), Visbreaker (VBU) during their run. In such a case, e.g., the present invention can be applied starting with the CDU by injecting in the feed line (160) a first and/or second hydrocarbon fluid(s) (161); this will be withdrawn from any one or more points of the plant (as previously described) as distillate (175) (and/or from a source tank) and partially circulated (162) inside the CDU and/or it will leave the plant to make up a product (206) and partially (164) introduced in the residue line (163), where it will make up part of the VDU feed (165). Whenever needed, the first and/or second hydrocarbon fluid(s) (161) can be re-introduced in the VDU feed (165). In the VDU, the first and/or second hydrocarbon fluid(s) will be withdrawn from any one or more points of the plant (as previously described) as distillate (167) and partially circulated (169) inside the VDU and/or it will leave the plant to make up a product (207) and partially (168) introduced in the residue line (166), where it will make up part of the VBU feed (170). Whenever needed, the first and/or second hydrocarbon fluid(s) (161) can be re-introduced in the VBU feed (170). In the VBU, the first and/or second hydrocarbon fluid(s) can be withdrawn from any point of the plant (as previously described) as distillate (176) and partially circulated (172) inside the VBU and/or it can be sent out from the plant to make up a product (208) and, at the same time, partially (173) introduced in the residue line (171), where it will make up a fluid (174) which can be used or reprocessed as previously described.

Figure 12:
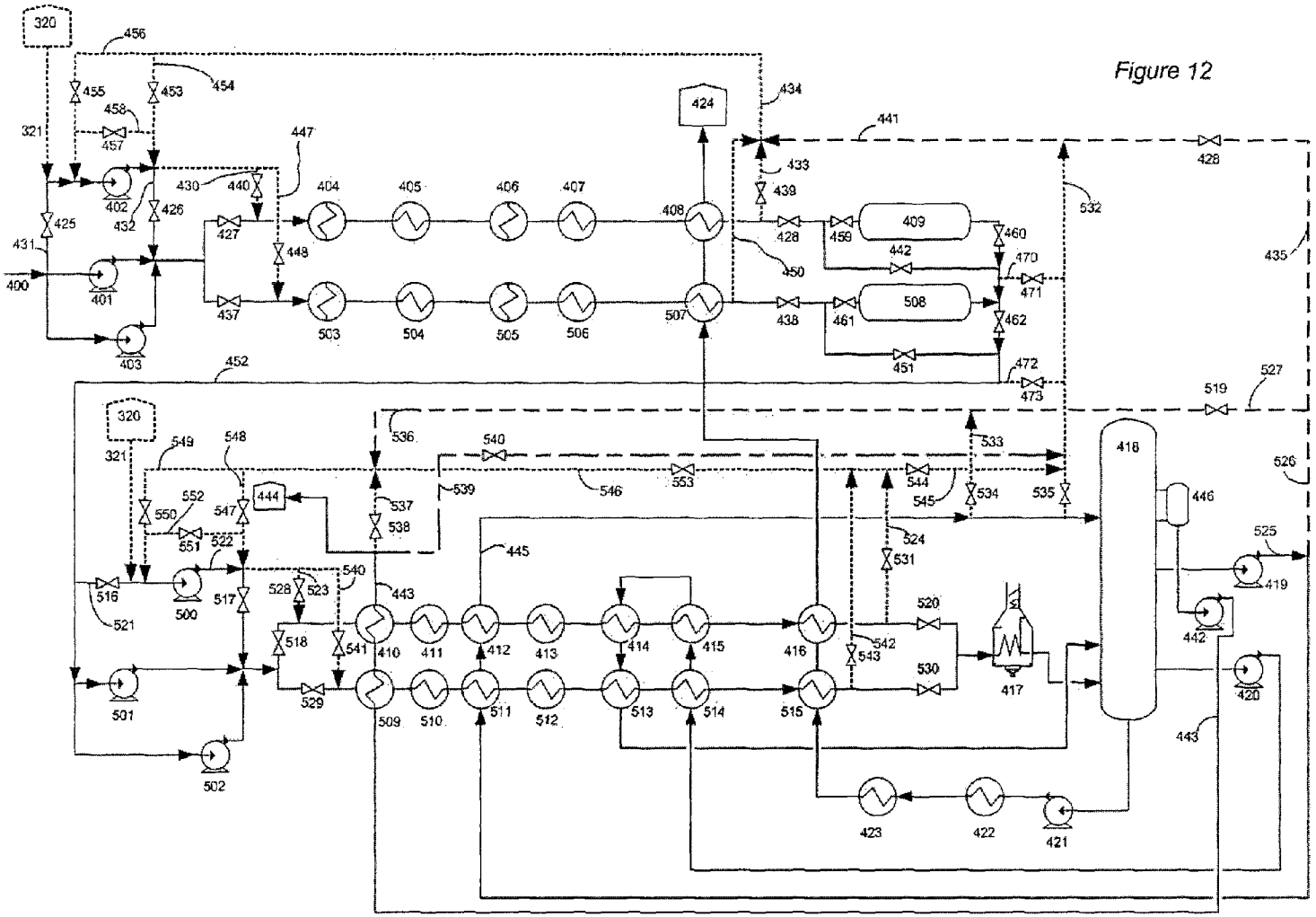
FIG. 12 is a schematic diagram for carrying out the present invention, wherein a portion of the petroleum plant is cleaned and does not contribute to production, while the other portion of the plant is running and makes up the production.

FIG. 12 illustrates additional configurations of the present invention, inclusive of an arrangement wherein a portion of the plant is cleaned and does not contribute to the production, whereas the other portion runs and contributes to the production. For example, a preheat train in a CDU, divided in two production lines, is cleaned by operating in two steps, wherein firstly a line of heat exchangers is cleaned, while the other is left with the feed inserted, and vice versa. Under an embodiment of the present invention, in such an application are realized some plant modifications, such as to make up an apparatus under the present invention, with the scope of implementing a closed loop comprising the equipment to be cleaned; the dashed lines represent the modifications to be implemented, while the solid lines represent the normal plant configuration. In such a connection, e.g., at the exchanger (416) outlet, there is installed, on purpose, a line (524) to circulate: e.g., i) a first and/or second hydrocarbon fluid(s) under the present invention coming from a tank (320) and introduced by means of a line (321) in the suction of pump (500), and/or e.g., ii) a fluid withdrawn by realizing a line (526) in the discharge line (525) of the pump (419) of the middle pumparound, and/or e.g., iii) a fluid withdrawn by realizing a line (537) in the line (443) of the kerosene to storage or to other plant (444). Always for the same purpose, at the exchanger (408) outlet is installed a proper line (433) in order to circulate a first and/or second hydrocarbon fluid(s) under the present invention, coming from tank (320) by means of a line (321), in the suction of pump (402) and/or a fluid withdrawn by realizing a line (435) in the discharge line (525) of the medium pumparound pump (419). Obviously, any hydrocarbon suitable under the present invention can be withdrawn from any point of the plant and introduced in any other point or points of the plant. From the line (526) the withdrawn fluid can be branched in any point or points of the plant, e.g., by means of, for example, lines (527) and (536) in the suction line (521) of booster pump (500) by realizing a line (549), or in its discharge line (522), by realizing a line (548); or by means of lines (435) and (441) in the suction line (431) of feed pump (402) by realizing a line (456), or in its discharge line (432), by realizing a line (454). The pumps (402) and (500) are equipped under the present invention with a by-pass valve (458) and (552) in order to set the flowrate during the various steps and eventually with a PCV (pressure control valve) in order to set the inlet pressure. In the discharge line (522) of the pump (500) is realized a line (523) and a line (540) in order to close the circulation loop at exchanger (410) and (509) inlet. In the discharge line (432) of the pump (402) is realized a line (430) and a line (447) in order to close the loop at exchanger (404) and (503) inlet. The modifications are completed with the realization of lines in order to circulate separately or altogether the single lines of the cold train (upstream the desalter) and/or the hot train (downstream the desalter), or to withdraw/introduce a hydrocarbon fluid in any point or points of the plant. The same approach can be used to realize the other applications of the present invention.

In the subsequent example 3, which refers to FIG. 12, are utilized the pumps which already exist in the plant, in order to reduce implementation costs (e.g., there can be used a spare pump, which is normally on stand-by) and the tie-ins to create the circulation loop can be realized when the pump is not running, for example by inserting a valved tee in the suction/discharge spool. Alternate embodiments feature the use of an appropriate suitable external pump. In such a case, another valved tee can be inserted in the inlet/outlet spools of the loop or of the equipment to be cleaned, such to realize a closed loop.

Figure 13B:
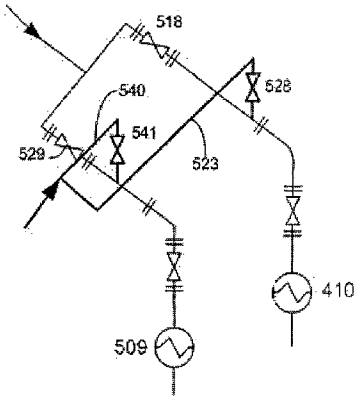
FIGS. 13A to 13C are schematic diagrams of portions of an apparatus under the present invention with reference to FIG. 12.
Figure 13C:
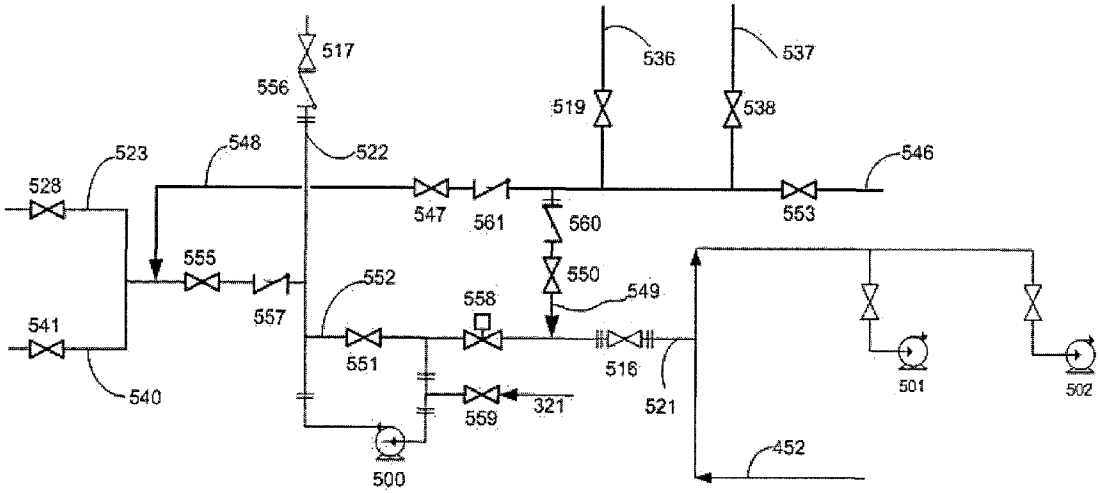
Figure 13A:
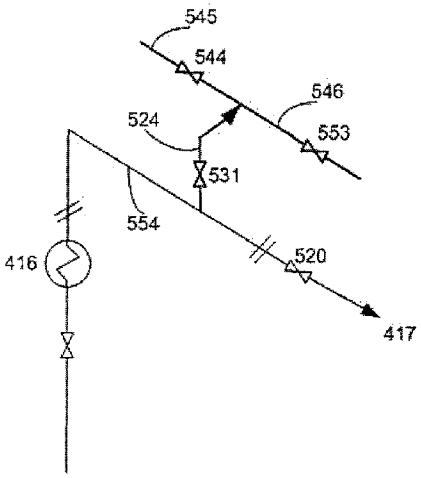

FIGS. 13A to 13C illustrate some modification examples, arranged to represent apparatus embodiments under the present invention, to be realized with reference to FIG. 12. For example, at exchanger (416) outlet, the spool (554) can be removed (by removing it between the flanges at the exchanger (416) outlet and the valve (520)) and hence insert in said spool the line (524) and the valve (531) and connect the line (524) with line (546); or there can be performed a hot tapping and weld the line (524) equipped with a valve (534) to both lines (554) and (546). The connections of pump (500) can be modified by inserting on the discharge a non-return check valve (NRV) (557) and a valve (555), downstream of which are connected the lines (523) and (540), as well as the line (548), which is also equipped with a NRV (561) and a valve (547). A NRV (560) can also be inserted in the line (549), together with valve (550), in the suction of pump (500). A PCV (558) can also be inserted in the suction of pump (500) to set the pressure during circulation. The by-pass line (552) will allow, by means of valve (551), pump safe operation in case of low flowrate, as, e.g., there could occur during the step of introducing a first and/or second hydrocarbon fluid(s). Additionally in the suction of pump (500) there can also be inserted a valve (559) in order to introduce the second hydrocarbon fluid by means of line (321). All of the above illustrative exemplary modifications are not included in the state of the art and are examples of suitable configurations to make up an apparatus under embodiments of the present invention. The same principle can be followed for the other schematically/exemplary illustrative modifications, such as to make up an apparatus under the scopes of the present invention.

The present invention therefore also comprises all of the modifications, such to make up an apparatus under the present invention, to be implemented in the petroleum plant in order to realize it. For example, in case the light gas oil pump has a discharge pressure of 15 bar and said light gas oil is to be introduced in the discharge of the crude feed pump, having a pressure of 40 bar, the present invention comprises the replacement (or supplementing) of the original pump with one having suitable characteristics (alone or in combination) and/or the installation of a new pump with suitable characteristics and/or the installation of a temporary pump, e.g., a cart/skid mounted one, having suitable characteristics. The same applies for the circulation line.

The present invention also comprises the design/engineering/procurement/construction/modification, e.g.: i) of the existing drains/connections in order to create a circulation loop; ii) of the flowrate/pressure/temperature control/regulation equipment to be included in the loop; iii) of line/safety valve dimensioning; iv) of any portion of the plant to be included in the circulation loop. The dimensioning calculations of the components for the realization of the present invention will be performed according to the methods known in the state of the art.

Figure 14:
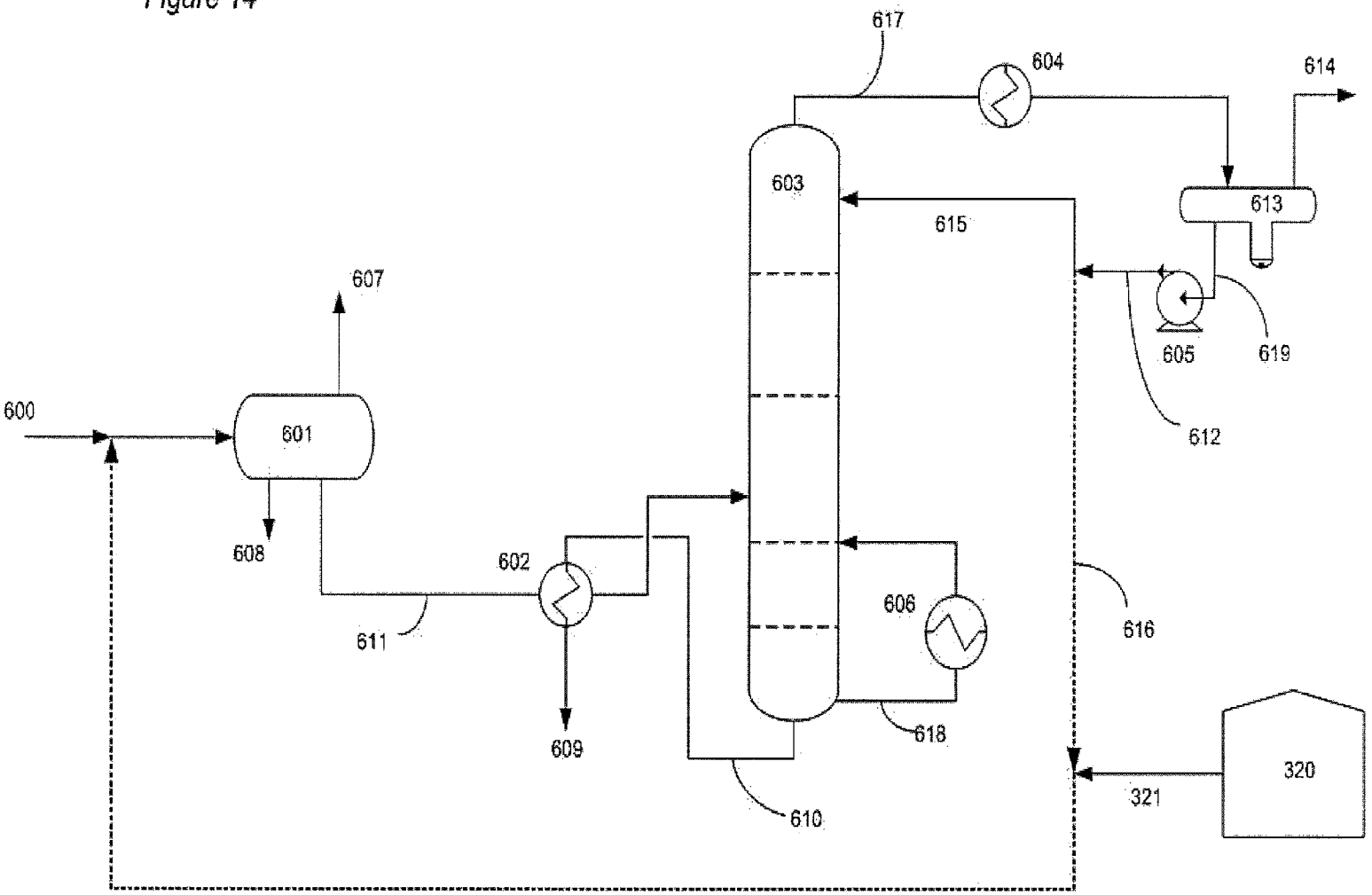
FIG. 14 is a schematic diagram for carrying out the present invention in a crude stabilizer plant, following the extraction of crude oil in an oil field.

FIG. 14 illustrates additional configurations of the present invention to a plant of Crude Oil Stabilization for the crude extracted from one or more oil wells. The crude coming from the wells (600) is sent to a separator (601), wherein a gas phase (607) and a water phase (608) are separated; by means of line (611) the crude after preheating (602) is sent to a Stabilizer column (603) wherein, due to heating by means of a reboiler (606), in the overhead line (617) is distilled a light phase which, after condensation (604) goes to an accumulator (613), wherein a gas phase (614) and condensated gasoline (619) are separated. The pump (605) by means of lines (612) and (615) sends said condensed gasoline as a reflux in the Stabilizer column (603); the stabilized crude leaves from the column bottom and is sent to storage by means of line (609). In order to perform a cleaning during plant run, under the method of the present invention, there is, e.g., built a line (616) in the discharge line (612) and said line (616) is connected to separator (601) inlet, in the line (600) of inlet of crude from wells, in a way that a part of the condensate gasoline is circulated at the plant's inlet. A first and/or second hydrocarbon fluid under the present invention can also (either alternatively or as a supplemental) for example be introduced in the line (616) by means of line (321), by coming from a tank (320).

Figure 15:
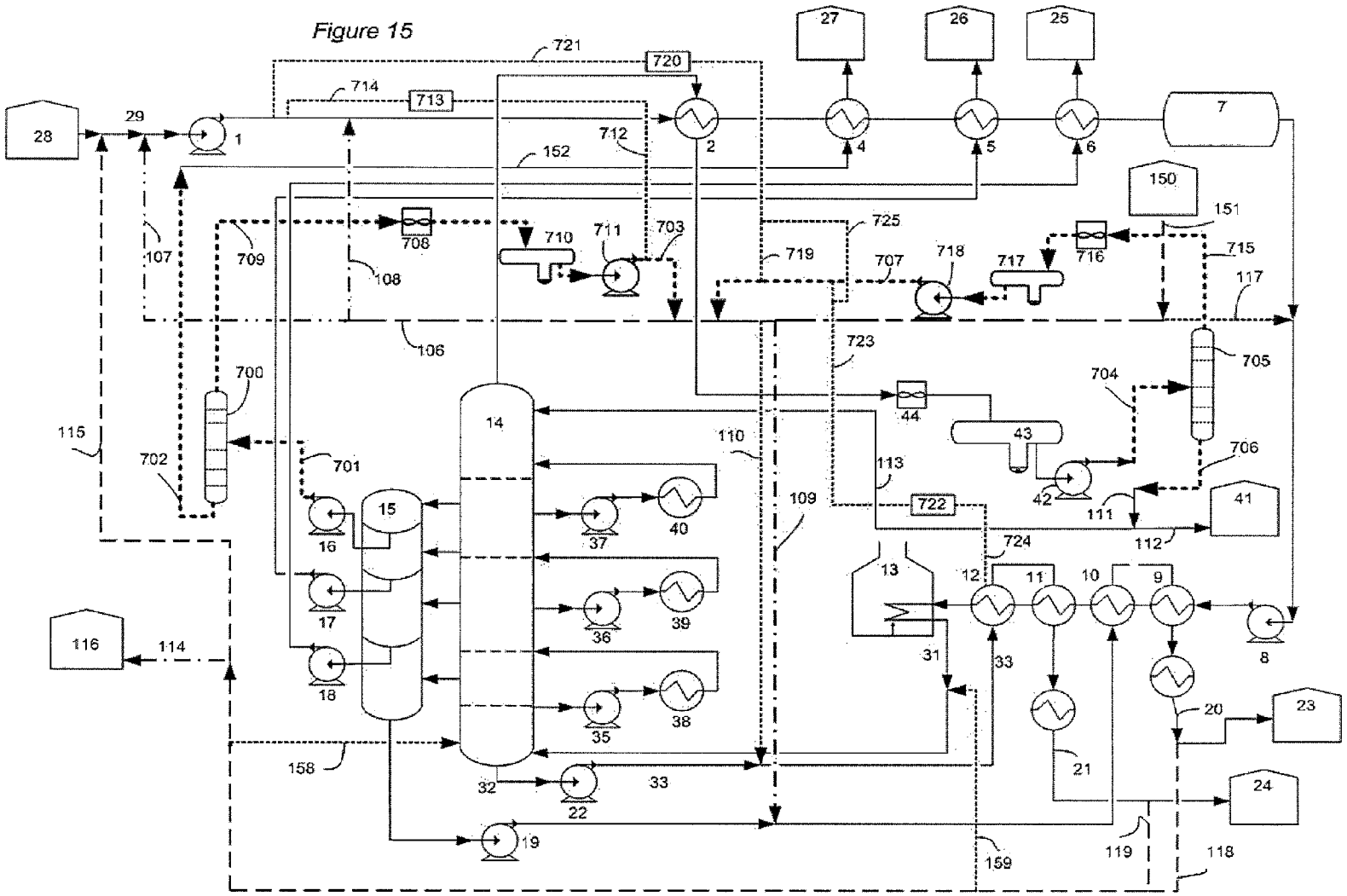
FIG. 15 is a schematic diagram for carrying out the present invention wherein the first and/or second hydrocarbon fluid(s) are specifically distilled before re-introduction and circulation.

FIG. 15 illustrates additional configurations of the present invention, inclusive of an embodiment wherein the first and/or second hydrocarbon fluid(s) are distilled on purpose, by means of a specific column, before re-introduction and circulation. For example, in an embodiment of the invention, the first and/or second hydrocarbon fluid(s) have boiling point(s) such that they are gathered in the suction of the pump (16) and/or (42). Said first and/or second hydrocarbon fluid(s) are shown to be specifically distilled by modifying the discharge line (152) of pump (16). The original discharge line (152) (see FIGS. 1 and 6 for example) is interrupted at a convenient point, thereby creating a new discharge line (701), which will enter the column (700). With an arrangement wherein the first and/or second hydrocarbon fluid(s) go to the overhead line (709) of column (700), after eventual condensation by means of a cooler (708) and separation/collection in a separator/drum (710), said first and/or second hydrocarbon fluid(s) can be re-introduced in any point (or points) of the plant by means of pump (711) and line (703), while the bottom of column (700) by means of line (702) will connect to the original line (152). The same applies for pump (42), wherein the discharge line (111) is modified to enter the column (705) by means of a new discharge line (704). With an arrangement wherein the first and/or second hydrocarbon fluid(s) go to the overhead line (715) of column (705), said first and/or second hydrocarbon fluid(s) can be re-introduced in any point (or points) of the plant by means of line (707), as previously described, while the bottom of column (705), by means of line (706), will connect to the original line (111). The above applies to any other withdrawal point of the first and/or second hydrocarbon fluid(s). The columns (700)/(705), or any other column introduced under the present invention, will be designed according to design/engineering practices and, if applicable relative to the arrangement utilized, will be equipped with reboiler(s) and any other device for implementing/controlling distillation of said first and/or second hydrocarbon fluid(s). FIG. 15 also illustrates additional configurations of the present invention, inclusive of an embodiment wherein control means are added in order to regulate the introduction of the first and/or second hydrocarbon fluid(s) and simultaneously control the feed rate (inclusive of its variation) under the present invention. As an illustrative example, in the discharge line (707), preferably from the control valve which is controlling/regulating the flow of the first and/or second hydrocarbon fluid(s) (not shown in the figure) a signal is withdrawn by means of line (719) (which can consist of a cable, a wi-fi signal, a radio signal, or any other suitable means), and is connected to a controller (720) which, in turn, by means of line (721) (which can consist of a cable, a wi-fi signal, a radio signal, or any other suitable means) will delivery said signal to the control valve (not shown in the figure) of feed pump (1) in order to regulate the feed rate. In this way the self-production of the first and/or second hydrocarbon fluid(s) can be automated and/or controlled/regulated from the control room of the petroleum plant. The embodiment of the present invention will also include all of the logic and the devices (including, for example, software and/or hardware) which are used to implement said control/regulation of feed rate and/or the introduction of the first and/or second hydrocarbon fluid(s). The same can be applied to line (703) for the controller (713). FIG. 15 also illustrates further additional configurations of the present invention, inclusive of an embodiment wherein control means are added in order to regulate the introduction of the first and/or second hydrocarbon fluid(s) and simultaneously control the feed rate (inclusive of its variation) under the present invention, subject to a monitoring of the process under the present invention. As an illustrative example, the process data of an equipment are collected, elaborated and returned in form of a signal which can control the introduction of the first and/or second hydrocarbon fluid(s) and/or of the feed rate. This is, e.g., the case wherein the run data of heat exchanger (12) are collected and elaborated in order to calculate the current fouling factor (or delta P, or any other control parameter) of said exchanger. The system can be designed, e.g., in order to alert plant personnel to perform the treatment under the present invention. Said treatment will be automated, e.g., by regulating the flowrate of the first and/or second hydrocarbon fluid(s) and/or the feed rate, and by continuing the introduction of the first and/or second hydrocarbon fluid(s) until the control parameter signal (fouling factor, delta P, etc.) returns to a pre-definite value. As an illustrative example, this can be realized by having the controllers (720) and (722) interacting by means of a line (725) (which can consist of a cable, a wi-fi signal, a radio signal, or any other suitable communication means). The same applies to any other equipment treated under the present invention. For example the delta P of reactor containing a catalyst can be controlled in the same way. The embodiment of the present invention will also include all of the logic and the devices (including, for example, software and/or hardware) which are used to implement said control/regulation of feed rate and/or the introduction of the first and/or second hydrocarbon fluid(s), as well as all of the logic and the devices (including software and/or hardware) which are used to monitor and calculate the control parameter(s).

The characteristics and the achievable results of the present invention can be better illustrated by further illustrative examples. All the examples hereinafter and hereinabove reported are to be interpreted as illustrative and in no case can be interpreted as a limitation of the present invention.

Example N.1

A crude atmospheric distillation plant (CDU) has a design throughput of 500 tons per hour (T/h) and a technical minimum throughput of 250 T/h. Based on design throughput there have also been designed downstream plants, which receive the products resulting from distillation as well as distillation residue. The distillation yield of the typical processed crude is: 20% gasoline, 20% kerosene, 30% gas oil, 30% atmospheric residue. At the design throughput this corresponds to 100 T/h gasoline, 100 T/h kerosene, 150 T/h gas oil, 150 T/h atmospheric residue. When the fresh feed rate is 250 T/h, a yield of 50 T/h gasoline, 50 T/h kerosene, 75 T/h gas oil, 75 T/h atmospheric residue will be achieved. The plant is however designed to manage a production up to 150 T/h gas oil and a feed of 500 T/h, therefore it is possible to introduce in the plant, in one or more points (e.g., in the feed), up to 75 T/h gas oil (e.g., coming from storage). In this latter case therefore, the feed will be now made up of 250 T/h of fresh feed and of 75 T/h of gas oil (total 325 T/h) and the production will be 50 T/h gasoline, 50 T/h kerosene, 150 T/h gas oil, 75 T/h atmospheric residue. From the produced 150 T/h gas oil, 75 T/h will exit the plant in order to satisfy production needs, while 75 T/h will be re-introduced in the plant and circulated; the cycle will continue until the monitoring under the present invention will indicate, the cleaning operation to be terminated. The monitoring will also define when and if it will be necessary to pump out of the plant all of the produced distillates (i.e., all of the 150 T/h gas oil will exit the plant) and repeat the introduction of a hydrocarbon fluid(s) in the plant, its subsequent distillation and circulation. Obviously, the same effect can be achieved by running the plant at 500 T/h and by progressively reducing the feed rate to 250 T/h (or to any value lower than 500 T/h, depending on the volume of hydrocarbon fluid which is meant to be circulated): in such a case the 75 T/h gas oil (or any value resulting from the reduction in feed rate) will be "self-produced" and hence progressively circulated as soon as they will be "self-produced". It is important to note, in both of the above cases the circulating 75 T/h of gas oil (or any value resulting either from the introduction of a hydrocarbon fluid and/or the reduction in feed rate) will be "self-produced", and therefore (besides the "bleedings" of the loop) the introduction and/or the "self-production" will be theoretically performed only one time and not continuously (i.e., the introduction of a hydrocarbon fluid and/or the reduction in feed rate will be accomplished only once). The continuous introduction of gas oil into the plant can reduce cleaning time, but impacts the economics of the system.

Example N.2

The crude atmospheric distillation plant (CDU) of example 1 runs at a fresh feed flowrate of 400 T/h, therefore the production will be 80 T/h gasoline, 80 T/h kerosene, 120 T/h gas oil, 120 T/h atmospheric residue. The fresh feed rate is then increased to 500 T/h, and the "exceeding" 30 T/h gas oil will be re-introduced and circulated in the plant. The fresh feed rate is then decreased back to 400 T/h and the gas oil "exceeding" the one of normal production will be re-introduced and circulated in the plant. The plant can thereafter continue to run under these conditions (fresh feed 400 T/h, circulating self-produced gas oil 30 T/h) or by reducing, e.g., the fresh feed to 300 T/h, by having 60 T/h of "exceeding" gas oil re-introduced and circulated in the plant. The fresh feed can then be reduced to 250 T/h, thereby distilling 150 T/h gas oil. From the distilled 150 T/h gas oil, e.g., 75 T/h will exit the plant to satisfy production needs, while 75 T/h will be re-introduced in the plant and circulation will continue until the monitoring system under the present invention will indicate the termination of cleaning operations. The monitoring will also define when and if it will be necessary to pump out of the plant all of the produced distillates and repeat the operation of feed rate increase and subsequent feed rate reduction(s) in order to self-produce a hydrocarbon fluid(s) in the plant, which is subsequently distilled and circulated.

In the above examples 1 and 2 together with the first introduced hydrocarbon fluid (gas oil, in this case), it can be also introduced a second hydrocarbon fluid under the present invention; this latter will also be distilled and circulated like the first one.

Obviously, the above operations will be performed by taking into account both the balancing (mass, thermal, etc.) of the plant under cleaning (treatment) and the balancing of downstream plants, if present, according to common petroleum plants management techniques, as well as to design limits of the equipment wherein the first and/or second hydrocarbon fluid(s) pass(es) through. Generally, it is preferable to run at a defined feed rate (e.g., the technical minimum), introduce the first and/or second hydrocarbon fluid(s) and then distill and circulate them. A progressive introduction step by step of the first and/or second hydrocarbon fluid(s) will allow anyway to face eventual operative problems.

Example N.3

With reference to FIG. 12, during the normal run, two feed pumps (401) and (403) are running, while the pump (402) is idle and in stand-by as a spare of (401) and (403. The same applies to the booster pump (500), a spare of (501) and (502), which during the normal run will have the valves (516) and (517) closed. Moreover, all of the cold train exchangers (from 404 to 408 and from 503 to 507), the desalters (409 and 508) and all of the hot train exchangers (from 410 to 416 and from 509 to 515), are inserted in the production cycle (valves 427, 428, 518, 520, 437, 438, 529, 530 opened). Hereinafter are exemplary described the operations, under the present invention, to clean one hot preheat line, while the other preheat line is inserted in the production cycle and allows for the run of the plant. In order to realize the present invention, e.g., to clean one hot preheat line, firstly the valves (518), (520) are closed to isolate the equipment to be cleaned; the valves (516) and (517) still remain closed in order to isolate the booster pump (500), which will be used as a circulation pump. A first and/or second hydrocarbon fluid(s), under the present invention, is thereafter introduced in the line (521) by means of line (321), by coming from a tank (320); alternatively (or in addition thereto), the first and/or second hydrocarbon fluid(s) can be introduced by opening the valve (519), by withdrawing the gas oil for middle pumparound directly from the column (418) (by means of lines 527 and 536, by having the valve 519 opened), or at exchanger (412) outlet (by means of lines 533 and 536, by having the valve 519 closed and the valve 534 opened). Thereafter are opened the valve (528) in the line (523) and the valve (520) at exchanger (416) outlet, and the pump (500) is started up (in case the circulating fluid(s) is introduced in the suction by means of line 549, with valve 550 open and valve 547 closed) to allow the outflow of fluids into the column (418), wherein they will be distilled, and the filling of the loop to be cleaned. If the first hydrocarbon fluid is introduced by means of line (536), and then by means of line (546) it will be introduced in the suction/discharge of pump (500), the second hydrocarbon fluid will be subsequently introduced by means of line (321) in the line (521). The first hydrocarbon fluid can also be introduced by means of line (537) which enters the line (546), after having opened the valve (538), with the valve (553) closed. Thereafter, the valves (519)/(538) and (520) are closed and the valve (531) is opened in order to establish a closed loop and perform the circulation under the present invention. The circulation duration will be determined by performing the monitoring under the present invention. Upon terminating the circulation, the above operations can be repeated by opening the valve (520) and by introducing a first and/or second hydrocarbon fluid under the present invention by means of line (321) and/or by opening the valves (519)/(538) as previously described. Upon terminating the cleaning operations, the cleaned equipment will be re-inserted in the production cycle by opening the valves (518) and (520), by closing the valves (528) and (531) and by stopping the pump (500). Simultaneously with the cleaning of one line of the hot preheat, the corresponding line in the cold preheat can also be cleaned, by utilizing the same method as previously described. The cold and the hot preheat trains can also the cleaned at the same time, by using the lines (545) and (532) and by opening the valve (544) and by having the valve (535) closed. In such a way the hydrocarbon fluid at exchanger (416) outlet will enter the pump (402) by means of lines (441) and (434) and will be circulated on a closed loop throughout the entire cold train and hot train. During the cold and/or hot train cleaning, the desalter(s) (409)/(508) can be inserted in the cleaning loop (valves 442/451 closed and valves 459/460/471 or 461/462/473 opened), or being by-passed (valves 442/451 opened) after having isolated it (them) from the circulation loop (valves 459/460/471 or 461/462/473 closed); during the normal run the valves 471/473 are closed; the lines 470/472 are built on purpose, under the present invention, to realize the cleaning of desalter(s) during plant run. Upon termination of one preheat train line cleaning, this will be re-inserted in the production cycle; the other train (cold and/or hot) will be then be excluded from the production cycle in order to perform its cleaning (if required), thereafter it will be re-inserted in the production cycle and the CDU will continue its run with both of the trains under clean conditions, thereby running under improved operative conditions.

Example N.4

A foulant deposit of 100 g, taken during mechanical cleaning of a Visbreaker bottom column exchanger, is placed in a laboratory reactor equipped with a reflux condenser, together with 100 grams of gasoline and 20 grams of a hydrocarbon fluid composed of: 50% MTBE, 30% Xylene, 10% Ethomeen S 22 (aliphatic amine $C_{22}$ ethoxyilated with 10 moles of ethylene oxyde), 5% Dimethylformamide, 5% Dioctylphtalate. The temperature is thereafter increased up to 450° C. while the produced distillate is condensed, re-introduced in the reactor and then re-distilled and re-introduced, so as to create a circulation of said distillate between the reactor and the condenser; such conditions have been maintained for 24 hours. Upon opening the reactor, 100% of the foulant deposit had been solubilized in the hydrocarbon fluid.

Example N.5

A foulant deposit of 100 g, taken during mechanical cleaning of the quench oil loop of an Ethylene plant, is placed in a laboratory reactor equipped with a reflux condenser, together with 100 grams of pyrolysis gasoline and 20 grams of a hydrocarbon fluid composed of: 30% Xylene, 20% Toluene, 20% Butylglycol, 30% Methylglycol. The temperature is thereafter increased up to 350° C. while the produced distillate is condensed, re-introduced in the reactor and then re-distilled and re-introduced, such to create a circulation of said distillate between the reactor and the condenser; such conditions have been maintained for 24 hours. Upon opening the reactor, 100% of the foulant deposit had been solubilized in the hydrocarbon fluid.

Example N.6

A Delayed Coking pilot plant has been modified under the present invention, by inserting the facilities to circulate in the feed a portion of the produced gasoline. A normal run by using the conventional process scheme, without activating the modifications under the present invention, has been performed in order to measure the distillation yield and take it as a reference. A subsequent run with the same feed, under the same operating conditions, has been thereafter performed by introducing in the feed 0.5% of coking naphtha and by circulating in the feed the same amount (0.5% with respect to the feed) of the produced naphtha. On the "self-produced" naphtha, a hydrocarbon fluid under the present invention has been introduced at a concentration of 0.1%, said fluid having the follow composition: 30% Xylene, 20% Toluene, 30% Ethomeen S22, 20% Butylglycol. Distillation yield have been measured, by achieving the results summarized in Table 2:

TABLE 2

| Fraction | Reference run wt % | Run under the present invention wt % |
|---|---|---|
| $H_2S$ | 0.78 | 0.92 |
| $H_2$ | 0.02 | 0.02 |
| GAS ($C_1$-$C_4$) | 6.27 | 8.35 |
| P.I.-75° C. | 1.48 | 1.72 |
| 75-175° C. | 7.06 | 7.87 |
| 175-350° C. | 22.26 | 22.74 |
| 350-370° C. | 4.20 | 4.13 |
| 370+ ° C. | 23.28 | 23.64 |
| COKE | 34.65 | 30.61 |

Example N.7

The coke content of an exhausted catalyst sample, taken during the downloading of a catalytic bed of a Virgin Naphtha Hydrodesulphurization plant, has been analyzed. 100 grams of said exhausted catalyst were placed in a laboratory reactor equipped with a reflux condenser, together with 100 grams of virgin naphtha and 20 grams of a hydrocarbon fluid composed of: 30% Xylene, 30% Toluene, 30% Butylglycol, 10% Cyclohexane. The temperature was thereafter increased up to 450° C. while the produced distillate was condensated, re-introduced in the reactor and then re-distilled and re-introduced, so as to create a circulation of said distillate between the reactor and the condenser; such conditions have been maintained for 24 hours. Upon opening the reactor, 50% of the coke which was originally present in the catalyst had been solubilized in the hydrocarbon fluid.

Example N.8

In a Virgin Naphtha Hydrodesulphurization pilot plant, a reference blank run was performed in order to evaluate coke formation on catalyst. The same plant was modified according to the present invention, by implementing a circulation in the feed of 1% desulphurated virgin naphtha and the introduction in the feed of 300 ppm of a hydrocarbon fluid composed of: 30% Xylene, 30% Toluene, 30% Butylglycol, 10% Cyclohexane. The pilot plant was thereafter run under the same operative conditions (same feed, same temperatures and pressures, same run duration, same catalyst) in order to evaluate the coke in the catalyst. A reduction of 50% in coke formation has been achieved with respect to the blank run.

Example N.9

In a Visbreaker pilot plant, a reference blank run (at 90% of design throughput) was performed in order to evaluate fouling formation in the preheat train exchangers and distillation yield. Said pilot plant was thereafter shutdown and cleaned by circulating for two days at 150° C. a gas oil which contained 0.5% vol of a hydrocarbon fluid composed of: 50% MTBE, 30% Xylene, 10% Ethomeen S22, 5% Dimethylformamide, 5% Dioctylphthalate. The pilot plant was thereafter re-started in order to evaluate the fouling factor of the above exchangers after said cleaning. A reduction of 60% of fouling factor has been achieved with respect to the fouling factor before shutdown and cleaning by circulation. The same pilot plant has been degassed by steaming it out for 3 days, then mechanically cleaned and hence modified by installing an apparatus under the present invention. A second run has been then performed in the same operating conditions, with the same feed and for the same time as per the blank run. At this point, instead of stopping the plant and proceeding to the closed loop cleaning as previously performed, the apparatus under the present invention was put in service, by continuing the plant run and by executing a circulation in the feed of 1% vol of the gas oil withdrawn from the stripper and by introducing in said gas oil 0.5% vol (referred to the feed) of the same hydrocarbon fluid used in the previous cleaning. The cleaning during the run lasted 2 days, after that the plant run in the same operating conditions as the blank run. An average preheat train fouling factor reduction of about 30% has been achieved with respect to the cleaning performed by stopping the production and circulating on a closed loop. Moreover a distillation yield increase of an average 3% could be noted with respect to the yield achieved in the same operating conditions, without activating the apparatus under the present invention.

Example N.10

In the Visbreaker pilot plant of Example N.9 at the end of the second run a final cleaning has been performed by executing a circulation in the feed of 1% vol of the gas oil withdrawn from the stripper and by introducing in said gas oil 0.5% vol (referred to the feed) of the same hydrocarbon fluid used in the Example N.9. The cleaning during the run lasted 2 days, after that the feed was discontinued, the plant drained and steaming out operations started. This time, however, a chemical under the present invention has been introduced into the steam, said chemical being composed of: 50% water, 20% Teewn 80, 10% iso-propyl alcohol, 5% diisopropylamine, 15% iso-propyl palmitate. By injecting said chemical into the steam, the degassing of the plant has been achieved in 1 day.

By considering the impact on yield, the present invention can be used continuously, by evaluating the right balance among the reduction in throughput and the yield increase. In such connection the time of introduction of the first and/or the second hydrocarbon fluid can be up to the whole calendar year.

Without departing from the scope of the present invention, all of the formulations of chemical compounds described in the present invention can also include amounts, as suitable for the scope, of compounds already known in the state of the art, which can be useful for the scope. Therefore the introduction of, e.g., dispersant, asphaltene stabilizers, detergents, in the formulation of the compounds hereby claimed cannot prejudice the novelty of the present invention, as characterized by its claims.

By considering the detailed description of the invention it is evident, the present invention provides a method and/or apparatus and/or chemical products for: a) equipment cleaning in a petroleum plant during the run of said plant; and/or b) distillation yield increase of a petroleum plant; and/or c) coke formation reduction in catalysts of a petroleum plant; and/or d) coke removal in catalysts of a petroleum plant. In the above description, the word "clean" (and its derivated nouns, verbs) can therefore be interpreted as "distillation yield increase" and/or "coke formation reduction in catalysts", "coke removal in catalysts" as appropriate. By considering the above and the fact, the embodiments of the present invention can be exploited on a single basis or cumulatively; in the above description and/or in the appended claims we refer to the word "treat" (and its derivated nouns, verbs) to include all of the above embodiments a)/b)/c)/d).

In the above specification, all data obtained during lab tests and experiments have been included for completeness. Efforts to exclude any value outside acceptable error limits have not been made. It is believed that, during course of these tests and experiments, possible errors in preparing samples and in making measurements may have been made which may account for any occasional data that is not supportive of this art.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth hereinabove but rather that the claims are construed as encompassing all the features of patentable novelty which reside in the present invention, including all features which would be treated as equivalents thereof by those skilled in the art to which the invention pertains.

The invention claimed is:

1. A method for treating a petroleum plant or equipment of the petroleum plant during a running of the petroleum plant, comprising:

maintaining, during a treatment period, the petroleum plant under a production operating condition, typical of the plant itself, which includes providing fresh feed to the petroleum plant;

while maintaining the petroleum plant under the production operating condition, there is carried out one or both of a) and b);

a) introducing in the petroleum plant, during the treatment period, a hydrocarbon-based treatment fluid;

b) varying an established feed rate, present at initiation of the treatment of the petroleum plant or equipment of the petroleum plant, which established feed rate ranges from a maximum operation rate for the petroleum plant, which is inclusive of a design rate for the petroleum plant, to a minimum operation rate which is set at a level for satisfying a minimum production operating state in the petroleum plant;

wherein said introduction of a hydrocarbon-based treatment fluid and/or said variation to the established feed rate generates an additional source or sources for distillation with respect to the amount provided by the established rate present at initiation of treatment; and distilling said additional source or sources for distillation in conjunction with the distillation of a plant process stream as to form a combination distillate, and diverting a portion of said combination distillate from a flow stream of said combination distillate as to form both a flowing continuation stream of the combination distillate and a diverted stream of the combination distillate, and re-introducing the diverted stream containing combination distillate to the or another plant process stream such that the combination distillate passes within a plant treatment zone for the purpose of plant treatment.

2. The method of claim 1 wherein b) is carried out for purposes of plant treatment, and the additional source or sources of distillate generated by the variation to the established feed rate is fed into the current fresh feed of the plant as the introduction source "a)" or as a supplement to an alternate introduction source "a)" to the plant.

3. The method of claim 1 wherein b) is carried out for purposes of plant treatment, and varying the established feed rate includes an adjustment of the established feed rate in association with an introduction of the hydrocarbon-based treatment fluid at least partly derived from an external source and wherein said first externally derived hydrocarbon-based treatment fluid is introduced into a closed or semi-closed loop at least partly formed by said plant.

4. The method of claim 3 wherein said hydrocarbon-based fluid is a fluid that cleans a heavy deposit in said plant by removal from a source location in the plant and passing the removed heavy deposit with the cleaning hydrocarbon-based fluid to an outlet of said plant.

5. The method of claim 1 wherein b) is carried out, and the varying of the established feed rate includes varying the fresh feed rate to the plant by an increase adjustment in the plant fresh feed rate from said established feed rate to a level above the established feed rate as to generate an additional quantity of distillates relative to a quantity generated at the established feed rate, and the diverting of at least a portion of a flow of said combination distillate includes the drawing off at least some of an overall quantity of distillate generated from the increased plant feed rate and the re-introducing of the diverted portion for the purpose of plant treatment includes introducing the drawn off distillate into a treatment region of said plant.

6. The method of claim 5 further comprising passing the diverted flow of said combination distillate, which includes said drawn off distillate, through a closed or semi-closed loop forming at least a portion of said plant and extending through the treatment region.

7. The method of claim 6 wherein said closed or semi-closed loop of said plant is configured such that drawn off distillate is re-introduced into a distillation device of the plant which is a source of the initially drawn off distillate and drawing off a recirculation output of distillate from said distillation device following receipt of the re-introduced drawn off distillate and passing the recirculation output of distillate to the treatment region.

8. The method of claim 6 further comprising adjusting a plant configuration to include the closed or semi-closed loop.

9. The method of claim 5 further comprising introducing the drawn off distillate to one or more fresh feed rate passageways of the plant such that, upon introduction to the fresh feed rate passageways of the plant, the introduced drawn off distillate provides a source for said introduction of said hydrocarbon-based treatment fluid or a supplement thereto, and varying the fresh feed rate includes a lowering of a current fresh feed rate to the plant such that the lowered fresh feed rate plus the additional drawn off distillate passing through one or more common passages in the plant sum to conform with plus or minus 60% of the established rate.

10. The method of claim 9 wherein the sum to conform is plus or minus 30% of the established rate.

11. The method of claim 5 further comprising introducing an increasing amount of the drawn off distillate to one or more fresh feed passageways of the plant and varying the fresh feed rate to the plant includes a coordinated lowering of a current fresh feed rate to the plant such that the lowered fresh feed rate plus the additional drawn off distillate is summed together to a desired treatment feed rate and wherein a controller is configured as to monitor and adjust the fresh feed rate to the plant, based on an input level of the drawn off distillate being received in said one or more fresh feed passageways, a current fresh feed to the plant, and a set desired treatment feed rate in the plant.

12. The method of claim 5 wherein the drawn off distillate is introduced into a fresh feed passageway of the plant and wherein there is an introduction of hydrocarbon-based fluid that includes introduction of a first and/or second hydrocarbon-based fluid, and varying the established feed rate comprises an introduction of the first and/or second hydrocarbon treatment fluids, with the introduction of first and/or second hydrocarbon treatment fluids including both the drawn off distillate plus an external source of said first and/or second hydrocarbons placed into combination with the drawn off distillate so as to establish a desired treatment feed rate.

13. The method of claim 1 further comprising introducing into a closed or semi-closed loop of the petroleum plant, during the treatment period, the hydrocarbon-based fluid, with the hydrocarbon-based fluid being derived from either an external source of the hydrocarbon-based fluid, an internal plant source of the hydrocarbon-based fluid or both.

14. The method of claim 13 wherein the introduction of the hydrocarbon-based fluid comprises the introduction of a hydrocarbon based fluid A and/or a hydrocarbon based fluid B, with hydrocarbon based fluid A being introduced in a ratio comprised between 0% and 100% with respect to a current fresh feed in the plant.

15. The method of claim 14 further comprising introducing in said plant hydrocarbon-based fluid B in a ratio comprised between 0.01% and 50% with respect to a current fresh feed in the plant.

16. The method of claim 1 wherein the diverting of at least a portion of the flow of said combination distillate comprises passing at least a portion of the combination distillate from a non-treatment, normal, plant operation mode passage route to a treatment mode passage route by feeding combination distillate into a closed or semi-closed circulation loop at least partially passing inside the plant and which closed or semi-closed circulation loop passes the combination distillate received therein to a different location in the plant than when directed in the non-treatment mode.

17. The method of claim 16 wherein said different location in the plant is at a location positioned upstream of plant equipment to be treated.

18. The method of claim 16 wherein there is circulated in the closed or semi-closed loop one or both of a first hydrocarbon-based fluid and a second hydrocarbon-based fluid inside the equipment to be treated as part of the introduction of hydrocarbon-based fluids in the plant, such that a portion of the products distilling during said circulation are re-introduced in said closed or semi-closed loop, whereas another portion of the distillates makes up the petroleum plant production and/or the normal distillate flow stream.

19. The method of claim 16 wherein there is circulated in the closed or semi-closed loop one or both of a first hydrocarbon-based fluid and a second hydrocarbon-based fluid inside the equipment to be treated, for a time of at least 20 minutes, at a temperature comprised between 100° C. and 900° C. and at a pressure comprised between 1 bar and 400 bar.

20. The method of claim 1 wherein a treatment zone cleaning status monitoring criteria associated with a running of said plant is monitored, and wherein the introduction of the hydrocarbon based fluid includes the circulation within a closed or semi-closed loop of a first hydrocarbon-based fluid or a first and a second hydrocarbon based fluids, and which circulation is carried out in repeated fashion until the treatment zone cleaning status monitoring criteria is deemed satisfactory.

21. The method of claim 1 wherein the plant operating running conditions during treatment are such that there is continued distillation of fresh feed source material.

22. The method of claim 1 wherein varying the established feed rate includes, a reduction in the established feed rate by varying the fresh feed rate of the plant to a value comprised between 40% and below 100% with respect to the design feed rate, followed by the introduction of the hydrocarbon-based fluid which comprises an introduction of first and/or the second hydrocarbon-based fluid(s) in an amount as to compensate up to the difference among the rate at which the plant is running and its design feed rate, and so as to manage up to the maximum allowable plant distillate flow rate or in any case the distillate flow rate applicable prior to the introduction of the first and/or the second hydrocarbon-based fluid(s), such as to run the plant at the flow rate resulting from the sum: [flow rate of reduced fresh feed]+[flow rate of the first and/or the second hydrocarbon-based fluid(s)], and wherein said flow rate is equal to or higher to the one prior to the reduction in fresh feed rate.

23. The method of claim 1 wherein the introduction of the hydrocarbon based fluid comprises introduction in the plant of a first and a second hydrocarbon-based fluid from separate sources, and which second hydrocarbon-based fluid joins and passes together with the first hydrocarbon-based fluid to a common treatment introduction point of the petroleum plant.

24. The method of claim 1 wherein the treatment is carried out in a plant with a furnace and wherein the treatment increases a value setting for a furnace inlet temperature of the furnace, and/or for reducing or avoiding the increase of a value setting for the tube metal temperature of the furnace, existing at the point of initiation of the treatment.

25. The method of claim 1 wherein the treatment increases the plant distillation yield in a manner beyond the quantity derivable from an equal overall feed amount to the plant distillation source(s) at a point of treatment initiation.

26. The method of claim 1 wherein the treatment reduces plant catalysts agglomeration and/or reduces coke formation on plant catalysts and/or reduces heavy compounds deposits, including coke, on plant catalysts and/or reduces differential pressure in a plant reactor containing a catalyst.

27. The method of claim 1 wherein the hydrocarbon-based fluid used for the treatment is recovered or reused in a way selected from the group consisting of: i) routing as a blend component of a fuel/heavy oil; ii) routing to a crude tank; iii) routing to slop; iv) routing inside the petroleum plant containing the equipment which has (have) been treated; v) routing to another petroleum plant; and (vi) any combination or subcombination of (i) to (v).

28. The method of claim 1 wherein the hydrocarbon based fluid includes the introduction of one or both of a first hydrocarbon-based fluid and a second hydrocarbon fluid that is or are capable of solubilizing the deposits in said equipment to be treated essentially under near critical or supercritical conditions at the operating conditions of the plant.

29. The method of claim 28 wherein the first hydrocarbon-based fluid contains one or more chemical products and said first hydrocarbon-based fluid and said chemical products are mixed in a proportion designed in order to be utilized in a solution form, and wherein said first hydrocarbon-based fluid forms the solvent of said chemical products.

30. The method of claim 29 wherein in the ratio solvent/chemical products varies in the range: solvent 70%-99.99%, chemical products 0.01%-30%.

31. The method of claim 29 wherein the solvent coincides with the first hydrocarbon fluid and is internally generated in said plant and circulated inside the petroleum plant.

32. The method of claim 1 wherein the treatment is carried out according to one of: i) injection of a first hydrocarbon fluid introduced from outside of the plant and further introduced in any part of the plant, upstream a distillation column, which is thereafter distilled and introduced in any part of the plant; ii) internal plant generation of a first hydrocarbon fluid produced by distillation at a certain feed rate, followed by the variation of fresh feed rate, the withdrawal of said hydrocarbon fluid from any part of the plant and the introduction of said internal plant produced distillate in any part of the plant; iii) introduction of the first hydrocarbon fluid according to one or more of the above points i) and ii) and iv) the introduction according to iii) together with a second hydrocarbon fluid which is introduced simultaneously with or subsequently to said first hydrocarbon fluid.

33. The method according to claim 1 wherein the introduction of the hydrocarbon based fluid comprises the introduction of a first hydrocarbon fluid or the first and a second hydrocarbon fluid, and which first and/or second hydrocarbon fluid is or are selected from a group consisting of distillation products from crude oil originating from the petroleum plant and/or being anyway present in the petroleum plant, by being finished products, blending components of finished products, intermediate products or feed to the petroleum plant and are selected from the group consisting of: gasoline, diesel, gas oil, virgin naphtha, kerosene, reformed gasoline, pyrolysis gasoline, pyrolysis gas oil, light cycle oil from FCCU, decant oil from FCCU, methyl-tert-butyl-ether (MTBE), benzene, toluene, xylenes, cumene, methanol, cyclohexane, cyclohexanone, ethylbenzene, linear alkylbenzene (LAB), dimethylterephthalate, phtalic anhydride, styrene, tert-amyl-methyl-ether (TAME), ethanol, dimethylformamide (DMF), dioctylphthalate, isopropyl alcohol, butyl alcohol, allyl alcohol, butylglycol, methylglycol, ethyl-tert-butyl-ether (ETBE), ethanolamines, acetone, octyl alcohol, methyl-ethyl-ketone (MEK), methyl-isobutyl-ketone (MIBK), crude oil, fuel oil, quench oil from Ethylene Unit, aromatic gasoline from Reforming Unit, benzene/toluene/xylenes (BTX) as produced by an Aromatic Extraction Unit (inclusive of the Sulfolane, Furfural, Glycols or Formylmorpholine type), the gasoline and/or the gas oil produced in an Ethylene Unit (pyrolysis gasoline/gas oil).

34. The method according to claim 33 wherein the first and/or the second hydrocarbon fluid is or are used in combination with one or more compounds, as a standalone or mixture thereof, selected from the group consisting of: polymethacrylates, polyisobutylene succinimmides, polyisobutylene succinates; laurylacrylate/hydroxyethylmethacrylate copolymer; alkylarylsulfonates, alkanolamine-alkylarylsulfonates and alkylarylsulfonic acids; substituted amines, where the substituent is an hydrocarbon containing at least 8 carbon atoms; acylated compounds containing nitrogen and having a substituent with at least 10 aliphatic carbon atoms, such substituent being obtained by reaction of an acylant carboxylic acid with at least an aminic compound containing at least a group-NH—, said acylant agent being joined to said aminic compound by way of a imido, amido, amidine or acyloxyammonium bridge; nitrogen containing condensated compounds of a phenol, an aldehyde or an aminic compound, having at least a group —NH—; esters of a substituted carboxylic acid; hydrocarbyl substituted phenols; alkoxylated derivatives of an alcohol, a phenol or an amine; phthalates; organic phosphates; oleic acids esters; diethylhydroxylamine; glycols and/or their derivatives, said glycols and/or their derivatives being not in a polymeric form, in the sense that they are molecules of single compounds, also in an adduct form, and not molecules constituted by a chain where a single monomer is repeated, e.g.: tetraethyleneglycol; mono- and di-ethers, mono- and di-esters, ether-esters and thioethers of single glycols; glycol of general formula $CH_2OH—(CH)_nOH_n—CH_2OH$ where n=0-10; glycol ethers of general formula $R_1—O—CH_2—CH_2—O—R_2$ where $R_1$ is an hydrocarbyl substituent $C_1$-$C_{20}$ and $R_2$ is H atom or an hydrocarbyl substituent $C_1$-$C_{20}$; glycol esters of general formula $R_1—O—O—CH_2—CH_2—O—O—R_2$ where $R_1$ is an hydrocarbyl substituent $C_1$-$C_{20}$ and $R_2$ is H atom or an hydrocarbyl substituent $C_1$-$C_{20}$; thioglycols of general formula $HO—R_1—S—R_2—OH$ where $R_1$ is an hydrocarbyl substituent $C_1$-$C_{10}$ and $R_2$ is H atom or an hydrocarbyl substituent $C_1$-$C_{10}$; glycol ethers-esters of general formula $R_1—O—CH_2—CH_2—O—O—R_2$ where $R_1$ and $R_2$ are an hydrocarbyl substituent $C_1$-$C_{20}$; ethers of general formula $R_1—O—R_2$ where $R_1$ or $R_2$ is an hydrocarbyl substituent $C_1$-$C_{20}$; substituted benzenes of general formula

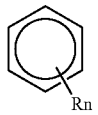

where n=1-6 and R can be indifferently H atom, —OH group, —COOH group, —CHO group, $—NH_2$ group, $—HSO_3$ group, the same or different hydrocarbyl substituent $C_1$-$C_{30}$; ketones of general formula $R_1—CO—R_2$ where $R_1$ or $R_2$ is an hydrocarbyl substituent $C_1$-$C_{20}$; anhydrides of general formula $R_1—CO—O—CO—R_2$, included those where $R_1$ and $R_2$ are bound together to form cyclic anhydrides, where $R_1$ or $R_2$ is an hydrocarbyl substituent $C_1$-$C_{20}$; amides of general formula

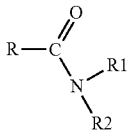

where R, $R_1$, $R_2$ are indifferently H atom or an hydrocarbyl substituent $C_1$-$C_{20}$; heterocyclic compounds, preferably of the hydrogenated type, containing from 0 to 3 hydrocarbyl substituent $C_1$-$C_{20}$; heterocyclic compounds selected from the group consisting of: furans, pyrrols, imidazoles, triazoles, oxazoles, thiazoles, oxadiazoles, pyranes, pyridine, pyridazine, pyrimidine, pyrazine, piperazine, piperidine, triazines, oxadiazines, morpholine, indane, indenes, benzofuranes, benzothiophenes, indoles, indazole, indoxazine, benzoxazole, anthranile, benzopyran, coumarins, quinolines, benzopyrones, cinnoline, quinazoline, naphthyridine, pyrido-pyridine, benzoxazines, carbazole, xanthene, acridine, purine, benzopyrroles, benzothiazoles, cyclic amides, benzoquinolines, benzocarbazoles, indoline, benzotriazoles; including all the possible compounds configurations, including the iso-form: e.g. the term "dithiols" is meant to include 1,2 dithiol and 1,3 dithiol, "quinolines" is mean to include quinoline and isoquinoline; the term "hydrocarbyl substituent" refers to a group having a carbon atom directly attached to the rest of the molecule and having a hydrocarbon or predominantly hydrocarbon character, as e.g. the hydrocarbon groups, including aliphatic, (e.g. alkyl or alkenyl), alicyclic (e.g. cycloalkyl or cycloalkenyl), aromatic, aliphatic- and/or alicyclic-substituted aromatic, condensated aromatic; aliphatic groups are preferably saturated, as e.g.: methyl, ethyl, propyl, butyl, isobutyl, pentyl, hexyl, octyl, decyl, octadecyl, cyclohexyl, phenyl, said groups may also contain non-hydrocarbon substituents provided they do not alter the predominantly hydrocarbon character of the group, e.g. the groups selected from: keto, hydroxy, nitro, alkoxy, acyl, sulphonic, sulphoxid, sulphur, amino, said groups may also or alternatively contain atoms other than carbon in a chain or ring otherwise composed of carbon atoms, e.g. heteroatoms selected from the group of: nitrogen, oxygen and sulfur.

35. The method of claim 1 wherein the introduction of the hydrocarbon based treatment fluid includes the introduction in the petroleum plant of a first hydrocarbon-based fluid in a ratio comprised between 0.1% and 100% with respect to current plant fresh feed and a second hydrocarbon-based fluid in a ratio comprised between 0.01% and 50% with respect to a current plant fresh feed; and wherein the second hydrocarbon fluid is selected from the group consisting of: methanol, ethanol, propanol, isopropanol, butanol, isobutanol, methylglycol monomethylether, butylglycol monobutylether, toluene, aliphatic amines $C_8^+$ ethoxylated with at least 6 moles ethylene oxide, arylsulfonates, benzene, diphenyl, phenanthrene, nonylphenol, 1-methyl-2-pyrrolidinone, diethyl ether, dimethylformamide (DMF), tetrahydrofuran (THF), ethylenediamine, diethylamine, triethylamine, trimethylamine, propylamine, 1-(3-aminopropyl)-2-pyrrolidone, 1-(3-aminopropyl) imidazole, N-hydroxyethylimidazolidinone, N-aminoethyl-imidazolidinone, 2-(2-aminoethylamino) ethanol, isopropylamine, cumene, 1, 3, 5 trimethylbenzene, 1, 2, 4 trimethylbenzene, maleic anhydride, p-toluidine, o-toluidine, dipropylamine, diphenyl ether, hexamethylbenzene, propylbenzene, cyclohexylamine, 1-isopropyl-4-methyl-benzene, 1, 2, 3, 5 tetramethylbenzene, hexanol, morpholine, o-xylene, m-xylene, p-xylene, butylamine, methylamine, mesitylene, examine, succinic anhydride, decahydronaphthalene, ethylbenzene, 1, 2 dimethylnaphthalene, 1, 6 dimethylnaphthalene, p-cymene, ethyl ether, isopropyl ether, etoxybenzene, phenyl ether, acetophenone, monoethanolamine (MEA), diethanolamine (DEA), triethanolamine (TEA), diethyleneglycol, triethyleneglycol, tetraethyleneglycol, hexyl glycol, dodecylbenzene, lauryl alcohol, myristyl alcohol, thiodiglycol, dioctylphthalate, diisooctylphthalate, didecylphthalate, diisodecylphthalate, dibutylphthalate, dinonylphthalate, methylethylketone (MEK), methylisobutylketone (MIBK), methyl-tert-butyl-ether (MTBE), cyclohexane, cyclohexanone, methyl- or ethyl-esters of fatty acids achieved by esterification of vegetal and/or animal oils (biodiesel); dimethylamine, ethylamine, ethyl formate, methyl acetate, dimethylformamide (DMF), propanol, propylamine, isopropylamine, trimethylamine, tetrahydrofuran (THF), ethyl vinyl ether, ethyl acetate, propyl formate, butanol, methyl propanol, diethyl ether, methyl propyl ether, isopropyl methyl ether, diethyl sulfide, butylamine, isobutylamine, diethylamine, diethylhydroxylamine, cyclopentanol, 2-methyltetrahydrofuran, tetrahydropyran, pentanal, isobutyl formate, propyl acetate, pentanoic acid, butyl methyl ether, tert-butyl methyl ether, ethyl propyl ether, methylpyridines, methylcyclopentane, cyclohexanol, hexanal, pentyl formate, isobutyl acetate, 2-ethoxyethyl acetate, methyl pentyl ether, dipropyl ether, diisopropyl ether, hexanol, methyl pentanols, triethylamine, dipropylamine, diisopropylamine, benzaldehyde, toluene, cresols, benzyl alcohol, methylanilines, dimethylpyridines, furfural, pyridine, methylcyclohexane, heptanol, acetophenone, ethylbenzene, xylenes, ethylphenols, xylenols, anilines, dimethylaniline, ethylaniline, octanenitrile, ethyl propanoate, methyl butanoate, methyl isobutanoate, propyl propanoate, ethyl 2-methyl propanoate, methyl pentanoate, heptanoic acid, octanoic acid, 2-ethylhexanoic acid, propyl 3-methylbutanoate, octanoles, 4-methyl-3-heptanol, 5-methyl-3-heptanol, 2-ehtyl-1-hexanol, dibutyl ether, di-tert-butyl ether, dibutylamine, diisobutylamine, quinoline, isoquinoline, indane, cumene, propylbenzene, 1,2,3-trimethylbenzene, 1, 2, 4, -trimethylbenzene, mesitylene, o-toluidine, N,N-dimethyl-o-toluidine, nonanoic acid, nonanols, naphthalene, butylbenzene, isobutylbenzene, cymenes, p-diethylbenzene, 1,2,4,5-tetramethylbenzene, decahydronaphthalene, decanoic acid, decanol, 1-methylnaphthalene, carbazole, diphenyl, hexamethylbenzene, dodecanols, diphenylmethane, tridecanols, tetradecanols, hexadecanols, heptadecanols, terphenyls, octadecanols, eicosanols; fatty amines and their mixtures, p-toluidine, toluene, dipropylamine, diisobutyl acetate, propyl acetate, propyl-ethyl-ether, triethylamine, ethylbenzene, propylbenzene, butylbenzene, cumene, para-xylene, hexamethylbenzene, triethanolamine, diphenylmethane, MTBE, dioctylphthalate, diisodecylphthalate, diisoctylphthalate, nonylether, methyloleate, dioctylether; the compounds named in plural refer to all possible isomers of said compound: e.g. the term "xylenes" indicated o-xylene, m-xylene, p-xylene; said compounds can also be used under supercritical conditions.

36. The method according to claim 35 wherein the second hydrocarbon fluid comprises one or more compound(s) working as swelling agent selected from those forming hydrogen bonds and those not forming hydrogen bonds, wherein the swelling agents not forming hydrogen bonds are selected from the group consisting of: benzene, toluene, cyclohexane, naphthalene, diphenyl, xylene, tetralin, methylcyclohexane; and wherein the swelling agents forming hydrogen bonds are selected from the group consisting of: pyridine, methanol, ethanol, ethylenediamine, propanol, 1,4-dioxane, acetone, formamide, aniline, tetrahydrofuran, N,N-dimethylaniline, diethylether, dimethylsulphoxide, acetophenone, dimethylformamide, ethyl acetate, methyl acetate, methylethylketone, 1-methyl-2-pyrrolidone, quinoline.

37. The method of claim 1 wherein the introduction of the hydrocarbon based treatment fluid includes the introduction in the petroleum plant of a first hydrocarbon-based fluid in a ratio comprised between 0.1% and 100% with respect to current plant fresh feed and a second hydrocarbon-based fluid in a ratio comprised between 0.01% and 50% with respect to a current plant fresh feed; and wherein the second hydrocarbon fluid comprises one or more compound(s) having a boiling temperature >150° C. selected from the group selected of: anthraquinone, eicosanol, benzalacetophenone, benzanthracene, hydroquinone, dodecylbenzene, hexaethylbenzene, hexamethylbenzene, nonylbenzene, 1,2,3-triaminobenzene, 1,2,3-trihydroxybenzene, 1,3,5-triphenylbenzene, diphenylmethanol, p-benzidine, benzil, 2-benzoylbenzofurane, benzoic anhydride, 2-benzoyl-methyl benzoate, benzyl benzoate, 4-tolyl benzoate, benzophenone, 4,4'-bis(dimethylamino) benzophenone, 2,2'-dihydroxybenzophenone, 2,2'-dimethylbenzophenone, 4,4'-dimethylbenzophenone, methylbenzophenone, 2-amino benzyl alcohol, 3-hydroxy benzyl alcohol, α-1-naphthyl benzyl alcohol, benzyl-ethyl-phenyl-amine, benzylaniline, benzyl ether, phenylacetophenone, 2-acetamide diphenyl, 2-amino diphenyl, 4,4'-bis(dimethylamino) diphenyl, biphenol, butyl-bis(2-hydroxyethyl)amine, butylphenylamine, butylphenylketone, carbazole, diphenylcarbonate, cetyl alcohol, cetylamine, benzylcinnamate, coumarin, lindane, dibenzofuran, dibenzylamine, diethylene glycol dibenzyl ether, diethylene glycol monolaurate, diethylene glycol (2-hydroxypropyl) ether, diethylenetriamine, di-α-naphthylamine, di-β-naphthylamine, dioctylamine, diphenylamine, diphenylmethane, 4,4'-diamino diphenyl, 4,4'-dimethylamino diphenyl, 4-hydroxy diphenyl, diphenylmethanol, diphenylethylamine, di-(α-phenylethyl) amine, di-iso-propanolamine, di-2-tolylamine, eicosanol, 1,1,2 triphenylethane, ethylene glycol 1,2 diphenyl, ethyl-di-benzylamine, ethylene glycol monobenzyl ether, ethylene glycol monophenyl ether, N,N-diphenylformamide, phenylformamide, tolylformamide, 2-benzoylfurane, 2,5 diphenylfurane, and related esters, heptadecylamine, heptadecanol, cetyl alcohol, hexadecanamine, cethylic alcohol, hydroxyethyl-2-tolylamine, triethanolamine, cyclohexanone, imidazole, methylimidazole, phenylimidazole, 5-amino-indane, 5-hexyl-indane, 1-phenyl-1,3,3-trimethyl-indane, 2,3 diphenyl-indene, indole, 2,3 dimethyl-indole, tryptamine, 2-phenyl-indo le, isocoumarin, diethyl-isophthalate, isoquinoline, benzyl laurate, phenyl laurate, lauryl alcohol, lauryl amine, lauryl sulphate, diethyl-benzyl-malonate, melamine, diphenylmethane, triphenylmethane, 4 benzyl-morpholine, 4-phenylmorpholine, 4-(4 tolyl)-morpholine, myristic alcohol, 9,10-dihydro-naphthacene, acetyl-naphthalene, benzyl-naphthalene, butyl-naphthalene, dihydro-naphthalene, dihydroxy-naphthalene, methyl-naphthalene, phenyl-naphthalene, naphthol, naphthylamine, methylnaphthylamine, naphthylphenalamine, α-naphthyl-2-tolyl-Ketone, nonacosanol, octadecanol, octyl-phenyl-ether, pentadecylamine, pentadecanol, 3-hydroxyacetophenone, tyramine, 4-hydroxyphenylacetonitrile, o-phenylenediamine, N-phenyl-phenylenediamine, 4-methyl-phenylenediamine, diphenylether, bis-(2-phenylethyl)amine, phosphine derivatives as phenyl, triphenyl and oxide, triphenylphosphite, dibutyl phthalate, dibenzyl phthalate, diethyl phthalate, dioctyl phthalate, diisoctyl phthalate, didecyl phthalate, diphenyl phthalate, phthalic anhydride, N-benzoylpiperidine, 1,3-diphenoxypropane, N-(2-tolyl)propionamide, 1-methyl-3-phenyl-pyrazoline, pyridine derivatives as 3-acetamido, 3-benzyl, 4-hydroxy, 2-phenyl, phenylsuccinic anhydride, succinimide, N-benzylsuccinimide, N-phenylsuccinimide, o-terphenyl, m-terphenyl, 1,14 tetradecanediol, tetradecanol, tetraethyleneglycol, tetraethylenepentamine, 2,5-diaminotoluene, 3,5-dihydroxytoluene, 4-phenyltoluene, p-toluenesulfonic acid and related methyl and propyl esters, o-toluic acid and related anhydride, N-benzyl-toluidine (o-, m- e p-), tribenzylamine, tributylamine, triethanolamine, triethyleneglycol and related monobutylether, trihepylamine, trioctylamine, triphenylamine, tritane, tritanol, 2-pyrrolidone, xanthene, xanthone, xylidine.

38. Method according to claim 1 further comprising monitoring treatment level and wherein the monitoring is performed with one or more analysis method selected from the group consisting of: viscosity (e.g. ASTM D 445); density (e.g. ASTM D1298); atmospheric or vacuum distillation (e.g.

ASTM D86, D1160); carbon residue (e.g. ASTM D4530, D 189); sediments by hot filtration (e.g. IP 375, 390); sediments by extraction (e.g. ASTM D473); sediments by filtration (e.g. ASTM 4807); ash (e.g. ASTM D482, EN6245); asphaltene (e.g. IP143), color (e.g. ASTM D1500), water and sediments (e.g. ASTM D2709, D1796); or an analysis method of the physical type, selected from the group consisting of: i) evaluation of the fouling factor, defined as the ratio among the heat transfer coefficient of clean equipment and the heat transfer coefficient of the equipment at the time when the value is recorded; ii) evaluation of pressure in various points of the plant; iii) evaluation of temperature in various points of the plant.

39. Method according to claim 1 further comprising the following steps to achieve gas free/safe entry conditions:

a) suspension of feed introduction;
b) optional circulation in a closed or semi-closed loop of the first and/or second hydrocarbon fluid inside the equipment to be treated, for a time of at least 20 minutes, at a temperature comprised between 100° C. and 900° C. and at a pressure comprised between 1 bar and 400 bar;
c) cooling of the equipment/plant;
d) emptying of the equipment/plant from all of the hydrocarbons;
e) introduction of water inside the equipment/plant;
f) implementing a closed circulation loop encompassing the equipment/plant;
g) introduction in the closed circulation loop of one or more chemical washing/cleaning products and their mixtures;
h) setting up the temperature and the pressure inside the closed circulation loop at values comprised between 60° C. and 350° C. and between 1 bar and 50 bar;
i) circulation of the water solution of the chemical product(s) inside the closed circulation loop under conditions of temperature and pressure comprised between 60° C. and 350° C. and between 1 and 50 bar, for a time comprised between 20 minutes and 60 days;
j) cooling (including the eventual introduction of fresh water in the loop) and emptying of the loop from the water solution;
k) optional routing of the water solution to the oily water treatment plant;
l) optional repeating of the steps from e) to k).

40. Method according to claim 39 wherein the steps from e) to k) are replaced by the steps:

m) introduction inside of the apparatus/plant of steam at a pressure comprised between 1.5 bar and 100 bar;
n) introduction in said steam of one or more washing/cleaning chemical product(s) including their mixtures;
o) introduction inside of the equipment/plant of the mixture steam/chemical product(s) according to present invention, for a time of at least 20 minutes,
p) optional circulation of condensed steam, containing a chemical product;
q) emptying of condenses from the equipment/plant;
r) optional routing of condenses to the oily water treatment plant.

41. The method according to claim 40 wherein the chemical product used for washing/cleaning is selected from the group consisting of: non-ionic surfactants, anionic surfactants, terpenes derivatives, emulsifiers, hydrogen sulphide scavengers, mercury scavengers and their mixtures in any proportion, including their aqueous solutions.

42. Method according to claim 41 wherein the anionic and non-ionic surfactants are selected from the group consisting of: alkyl-, aryl-, or alkylaryl-benzensulphonates of general formula $RC_6H_4SO_3M$ wherein R is an hydrocarbyl substituent $C_8$-$C_{20}$ and M is the ion H, Na, Ca, ammonium, triethanolammonium, isopropylammonium; dialkylsulfosuccinates of general formula $RO_2CCH_2CH(SO_3Na)CO_2R$ wherein R is an hydrocarbyl substituent $C_2$-$C_{20}$; alkylsulfates of general formula $ROSO_3M$ wherein R is an hydrocarbyl substituent $C_5$-$C_{20}$ and M is the ion sodium, ammonium, triethanolammonium; ethoxylated and sulphated alcohols of general formula $R—(—OCH_2CH2-)_n-OSO_3M$ wherein R is an hydrocarbyl substituent $C_5$-$C_{20}$, n=1-5 and M is the ion sodium, ammonium, triethanolammonium; ethoxylated and sulphated alkylphenols of general formula $RC_6H_6—(—OCH_2CH_2—)_n—OSO_3M$ wherein R is an hydrocarbyl substituent $C_5$-$C_{20}$, n=1-5 and M is the ion sodium, ammonium, triethanolammonium; ethoxylated alcohols of general formula $R—(—O—CH_2CH_2—)_n—OH$ wherein R is an hydrocarbyl substituent $C_5$-$C_{30}$, n=1-30; ethoxylated alkyl phenols of general formula $RC_6H_4—(—OCH_2CH_2—)_n—OH$ wherein R is an hydrocarbyl substituent $C_5$-$C_{30}$, n=1-40; mono- and di-fatty acids glyceric esters wherein acid contains an hydrocarbyl substituent $C_{10}$-$C_{40}$; mono- and di-polyoxyethylene esters of oils and fatty acids of general formula $RCO—(—OC_2H_4—)_n—OH$ and $RCO—(—OC_2H_4—)_n—OOCR$ wherein the oil is of the "tall oil" or "rosin oil" type, n=1-40 and the acid contains and hydrocarbyl substituent $C_{10}$-$C_{40}$; ethoxylated "castor oils" (castor oil is a triglyceride abundant in ricinoleic esters) containing a number of polyethoxylated ethylene oxide groups variable between 5 and 200; mono- and di-ethanolamides of fatty acids of general formula $RCONHC_2H_4OOCR$ and $RCON(C_2H_4OH)C_2H_4OOCR$ wherein R is an hydrocarbyl substituent $C_{10}$-$C_{40}$; surfactants of poly(oxyethylene-co-oxypropylene), also known as block polymer, having molecular weight of 50-10000; mono-, di- and poly-aliphatic amines derived from fatty acids, such as $RNHCH_2CH_2CH_2NH_2$ wherein R is an hydrocarbyl substituent $C_{10}$-$C_{40}$; N-alkyltrimethylendiamines of general formula

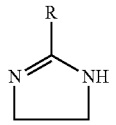

wherein R is an hydrocarbyl substituent C10-C40; 2-alkyl-2-imidazolines of general formula

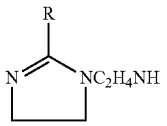

wherein R is an hydrocarbyl substituent C10-C40; amine oxides of general formula RNO(CH3)2 and RNO (C2H4OH)2 wherein R is an hydrocarbyl substituent C1-C20; ethoxylated alkylamines of general formula

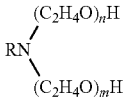

wherein m+n=2-40; 2-alkyl-1-(2-hydroxyethyl)-2-imidazolines of general formula

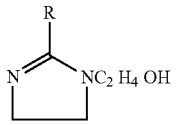

wherein R is an hydrocarbyl substitutent C10-C40: alkoxylated ethylendiamines of general formula

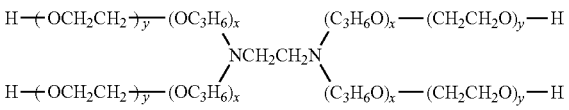

wherein x and y=4-100;

terpenic products derivatives are selected from the group consisting of: limonene, pinene, canfor, menthol, eucalipthol, eugenol, geraniol, thymol; emulsifiers are selected from the group consisting of: Tween 60, Tween 80, nonyl phenol polyethylene glycol ether, oleates, sorbitan oleates, glycerol monostearate, nonyl phenol ethoxylates, iso-propyl palmitate, polyglycerol esters of fatty acids, tridecyl alcohol ethoxylates, fatty alcohol ethoxylates, linear alkyl benzene sulphonic acid, dioctyl phthalate, sodium tripolyphosphate, citric acid, soybean oleic acid, trisodium phosphate, sodium dodecyl sulfate, didecyl dimethyl ammonium chloride, oleic acid diethanolamine, dodecyl dimethyl benzil ammonium chloride, sodium acetate, oleamide, polyethylene glycols, lanolin, ethoxylated (E20) sorbitan monooleate, sorbitan monooleate, sulfosuccinamates; $H_2S$ scavengers are selected from the group consisting of: diethanolamine, monoethanolamine, methyl-diethanolamine, diisopropylamine, formaldehyde, maleimides, amidines, polyamidines, glyoxal, sodium nitrite, reaction products of polyamide-formaldehyde, triazines, carboxamides, alkylcarboxyl-azo compounds, compounds, bisoxazolidines, glycidyl ethers, potassium formate; mercury scavenger are selected from the group consisting of: thiourea, caustic soda, sodium carbonate, trimercapto-s-triazine trisodium salt.

43. The method according to claim 39 wherein the chemical product used for washing/cleaning is selected from the group consisting of: non-ionic surfactants, anionic surfactants, terpenes derivatives, emulsifiers, hydrogen sulphide scavengers, mercury scavengers and their mixtures in any proportion, including their aqueous solutions.

44. Method according to claim 43 wherein the anionic and non-ionic surfactants are selected from the group consisting of: alkyl-, aryl-, or alkylaryl-benzensulphonates of general formula $RC_6H_4SO_3M$ wherein R is an hydrocarbyl substituent $C_8$-$C_{20}$ and M is the ion H, Na, Ca, ammonium, triethanolammonium, isopropylammonium; dialkylsulfosuccinates of general formula $RO_2CCH_2CH(SO_3Na)CO_2R$ wherein R is an hydrocarbyl substituent $C_2$-$C_{20}$; alkylsulfates of general formula $ROSO_3M$ wherein R is an hydrocarbyl substituent $C_5$-$C_{20}$ and M is the ion sodium, ammonium, triethanolammonium; ethoxylated and sulphated alcohols of general formula $R—(—OCH_2CH2-)_n—OSO_3M$ wherein R is an hydrocarbyl substituent $C_5$-$C_{20}$, n=1-5 and M is the ion sodium, ammonium, triethanolammonium; ethoxylated and sulphated alkylphenols of general formula $RC_6H_6—(—OCH_2CH_2—)_n—OSO_3M$ wherein R is an hydrocarbyl substituent $C_5$-$C_{20}$, n=1-5 and M is the ion sodium, ammonium, triethanolammonium; ethoxylated alcohols of general formula $R—(—O—CH_2CH_2—)_n—OH$ wherein R is an hydrocarbyl substituent $C_5$-$C_{30}$, n=1-30; ethoxylated alkyl phenols of general formula $RC_6H_4—(—OCH_2CH_2—)_n—OH$ wherein R is an hydrocarbyl substituent $C_5$-$C_{30}$, n=1-40; mono- and di-fatty acids glyceric esters wherein acid contains an hydrocarbyl substituent $C_{10}$-$C_{40}$; mono- and di-polyoxyethylene esters of oils and fatty acids of general formula $RCO—(—OC_2H_4—)_n—OH$ and $RCO—(—OC_2H_4—)_n—OOCR$ wherein the oil is of the "tall oil" or "rosin oil" type, n=1-40 and the acid contains and hydrocarbyl substituent $C_{10}$-$C_{40}$; ethoxylated "castor oils" (castor oil is a triglyceride abundant in ricinoleic esters) containing a number of polyethoxylated ethylene oxide groups variable between 5 and 200; mono- and di-ethanolamides of fatty acids of general formula $RCONHC_2H_4OOCR$ and $RCON(C_2H_4OH)C_2H_4OOCR$ wherein R is an hydrocarbyl substituent $C_{10}$-$C_{40}$; surfactants of poly(oxyethylene-co-oxypropylene), also known as block polymer, having molecular weight of 50-10000; mono-, di- and poly-aliphatic amines derived from fatty acids, such as $RNHCH_2CH_2CH_2NH_2$ wherein R is an hydrocarbyl substituent $C_{10}$-$C_{40}$; N-alkyltrimethylendiamines of general formula

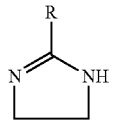

wherein R is an hydrocarbyl substituent C10-C40; 2-alkyl-2-imidazolines of general formula

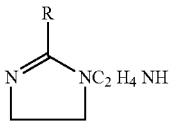

wherein R is an hydrocarbyl substituent C10-C40; amine oxides of general formula RNO(CH3)2 and RNO (C2H4OH)2 wherein R is an hydrocarbyl substituent C1-C20; ethoxylated alkylamines of general formula

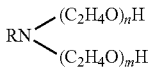

wherein m+n=2-40; 2-alkyl-1-(2-hydroxyethyl)-2-imidazolines of general formula

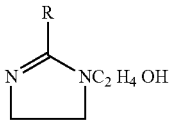

wherein R is an hydrocarbyl substituent C10-C40; alkoxylated ethylendiamines of general formula

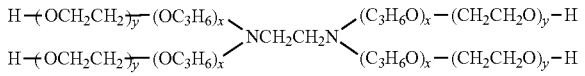

wherein x and y=4-100;

terpenic products derivatives are selected from the group consisting of: limonene, pinene, canfor, menthol, eucalipthol, eugenhol, geraniol, thymol; emulsifiers are selected from the group consisting of: Tween 60, Tween 80, nonyl phenol polyethylene glycol ether, oleates, sorbitan oleates, glycerol monostearate, nonyl phenol ethoxylates, iso-propyl palmitate, polyglycerol esters of fatty acids, tridecyl alcohol ethoxylates, fatty alcohol ethoxylates, linear alkyl benzene sulphonic acid, dioctyl phthalate, sodium tripolyphosphate, citric acid, soybean oleic acid, trisodium phosphate, sodium dodecyl sulfate, didecyl dimethyl ammonium chloride, oleic acid diethanolamine, dodecyl dimethyl benzil ammonium chloride, sodium acetate, oleamide, polyethylene glycols, lanolin, ethoxylated (E20) sorbitan monooleate, sorbitan monooleate, sulfosuccinammates; $H_2S$ scavengers are selected from the group consisting of: diethanolamine, monoethanolamine, methyl-diethanolamine, diisopropylamine, formaldehyde, maleimides, amidines, polyamidines, glyoxal, sodium nitrite, reaction products of polyamide-formaldehyde, triazines, carboxamides, alkylcarboxyl-azo compounds, cumene-peroxide compounds, bisoxazolidines, glycidyl ethers, potassium formate; mercury scavenger are selected from the group consisting of: thiourea, caustic soda, sodium carbonate, trimercapto-s-triazine trisodium salt.

45. A petroleum plant apparatus to perform the method according to claim 1 comprising: i) withdrawal means from one or more point(s) in the petroleum plant of one or more hydrocarbon fluid(s); ii) introduction means of said one or more hydrocarbon fluid(s) as above withdrawn into one or more point(s) of the petroleum plant; iii) distillation means of said one or more hydrocarbon fluid(s) as above introduced into one or more point(s) of the petroleum plant; iv) re-withdrawal and re-introduction means of said one or more hydrocarbon fluid(s) as above distilled to re-withdraw said distilled fluid(s) and re-introduce it (them) into one or more point(s) of the petroleum plant, wherein said re-withdrawal and re-introduction means can be the same withdrawal and introduction means as above; v) connection means in order to form a closed or semi-closed loop, encompassing the equipment to be treated, wherein said one or more hydrocarbon fluid(s) will be continuously distilled, withdrawn and introduced; vi) a discharge system of the hydrocarbon fluid(s), to allow their removal from the closed or semi-closed loop; vii) control means, to control or regulate temperature and/or pressure and/or flowrate; viii) optional filtration means.

46. The apparatus of claim 45 wherein said withdrawal means has the one or more withdrawal points positioned as to withdraw one or more hydrocarbon fluid(s) having the following intervals of boiling points: a) up to 75° C.; b) from 75° C. to 175° C.; c) from 175° C. to 350° C.; d) above 350° C.; and wherein introduction means introduce the one or more withdrawn hydrocarbon fluid(s) in any one or more point(s) of the plant.

47. A petroleum plant apparatus to perform the method according to claim 1 comprising a distillate source wherein a distillate from said distillate source is withdrawn from a point within a closed or semi-closed loop forming at least a portion of said plant, and an entry point wherein there is introduced upstream of equipment to be treated the drawn off distillate and then redistilled to be thereafter re-withdrawn from the same point and re-introduced in the same equipment to be treated for a time necessary to treat said equipment.

48. The apparatus of claim 47 wherein withdrawal means are located in one or more point(s) of the plant that is (are) selected from the group consisting of:

- suction/discharge of a produced gasoline pump;
- suction/discharge of an overhead reflux pump;
- suction/discharge of one or more bottom/middle/top pumparound pump(s);
- suction/discharge of a produced kerosene pump;
- suction/discharge of a produced gas oil pump;
- suction/discharge of any distilled hydrocarbon pump;
- hydrocarbon line exiting any petroleum apparatus;
- suction/discharge of a crude oil booster pump at desalter outlet;
- any combination or sub-combinations for the items listed above;

wherein introduction means are located in one or more point(s) of the plant selected from the group consisting of:

- suction/discharge of a plant feed pump;
- suction/discharge of a crude oil booster pump at desalter outlet;
- suction/discharge of a column bottom pump;
- suction/discharge of a heavy gas oil pump;
- inlet of an preheat train;
- inlet of an equipment to be treated;
- distillation residue line, upstream/downstream of any heat exchanger;
- column bottom;
- in a pump external of the plant, being part of another plant or installed on purpose, in temporary or permanent execution;
- any combination or sub-combinations for the items listed above;
- wherein distillation means are located in one or more point(s) of the petroleum plant selected from the group consisting of:
  - atmospheric distillation column;
  - vacuum distillation column;
  - extractive distillation column;
  - any combination or sub-combinations for the items listed above;

and wherein the withdrawal point(s) and the introduction point(s) of said one or more hydrocarbon fluid(s) are connected to form a closed or semi-closed loop.

49. A method of designing a plant for carrying out the method of claim 1 wherein the equipment subject to treatment is designed such that there is avoided inputting into the equipment an equal to or greater than 20% fouling factor as well as presentment of fouling back up equipment in the plant design.

50. A method of manufacturing of a plant for carrying out the method of claim 1 comprising rendering into a physical plant based on a plant design wherein the equipment subject to treatment is designed such that there is avoided inputting into the equipment an equal to or greater than 20% fouling factor as well as presentment of fouling back up equipment in the plant design.

51. The method of claim 50 wherein the treated equipment has a surface from 0.1% to 100% lower with respect to a non-treated equipment.

52. The method of claim 1 wherein the hydrocarbon-based treatment fluid is utilized and is limited to an internal-to-plant originated distillation product that is circulated and recirculated within the plant to a treatment zone upstream or downstream from the distillation source location of the plant.

53. The method of claim 1, further comprising varying the fresh feed rate to the plant in association with a) and/or b).

54. The method of claim 1 wherein, following distilling said additional source or sources for distillation for the purpose of plant treatment, distillate source or sources used for plant treatment are circulated and recirculated continuously and without interruption within the plant until output from the plant with output plant product.

55. The method of claim 1 wherein said introduction of a hydrocarbon-based treatment fluid includes that which is sourced from a distillation device of the plant; and distilling said additional source or sources for distillation for the purpose of plant treatment is carried out within the distillation device.

56. The method of claim 1 wherein the additional source or sources of distillate is associated with a variation to the fresh feed rate being fed into the plant, and wherein there is a re-introduction of distillate to another point in the plant through a closed or semi-closed loop associated with the plant, and wherein the plant runs continuously and without interruption both during and between production of the additional source or sources and the reintroduction of distillate.

57. The method of claim 1 wherein the process stream involved in the formation of the combination distillate comprises fresh feed of the plant.

58. The method of claim 1 wherein, in the step of passing the diverted stream containing combination distillate to the process stream, the diverted stream containing combination distillate is fed through a closed or semi-closed loop, at least partly formed by said plant, to the process stream of the plant.

59. The method of claim 1 wherein the relative concentration of the distillates forming the combination distillate is the same in each of the continuation stream and the diverted stream after diversion.

60. The method of claim 1 wherein the diverted stream is placed in contact with equipment of the plant positioned in the plant treatment zone and upstream of a distillation unit that forms the combination distillate.

61. The method of claim 1 wherein the combination distillate is formed by a first distillation unit and the combination distillate stream formed by the first distillation unit is directed to a separation unit as to recover some or all of the hydrocarbon-based treatment fluid for the purpose of plant treatment.

62. The method of claim 1 wherein the diverted stream is subjected to a second distillation and then hydrocarbon-based treatment fluid is separated out from the second distilled diverted stream for the purpose of plant treatment.

63. A method for treating a petroleum plant or equipment of the petroleum plant during a running of the petroleum plant, comprising:

maintaining, during a treatment period, the petroleum plant under a production operating condition, typical of the plant itself, which includes providing fresh feed to the petroleum plant;

while maintaining the petroleum plant under the production operating condition, there is carried out one or both of a) and b);

a) introducing in the petroleum plant, during the treatment period, a hydrocarbon-based treatment fluid;

b) varying an established feed rate, present at initiation of the treatment of the petroleum plant or equipment of the petroleum plant, which established feed rate ranges from a maximum operation rate for the petroleum plant, which is inclusive of a design rate for the petroleum plant, to a minimum operation rate which is set at a level for satisfying a minimum production operating state in the petroleum plant;

wherein said introduction of a hydrocarbon-based treatment fluid and/or said variation to the established feed rate generates an additional source or sources for distillation with respect to the amount provided by the established rate present at initiation of treatment; and distilling said additional source or sources for distillation for the purpose of plant treatment, and wherein the petroleum plant runs, relative to a pre-existing fresh feed rate, at an increased fresh feed rate that is below a design fresh feed rate of the plant, or at the design fresh feed rate, or higher than the design fresh feed rate, so as to produce an increased amount of distillates, and, thereafter, varying the fresh feed rate to the plant by progressively reducing the fresh feed rate, such that the increased amount of produced distillates, with respect to the amount of distillates produced with the pre-existing fresh feed rate, is circulated in parts of the plant to be treated.

64. A method for treating a petroleum plant or equipment of the petroleum plant during a running of the petroleum plant, comprising:

maintaining, during a treatment period, the petroleum plant under a production operating condition, typical of the plant itself, while providing fresh feed to the petroleum plant;

while maintaining the petroleum plant under the production operating condition, introducing, during the treatment period, a hydrocarbon-based treatment fluid into a closed or semi-closed loop forming at least part of the petroleum plant with the hydrocarbon-based fluid being derived from either an external source of the hydrocarbon-based fluid, an internal plant source of the hydrocarbon-based fluid or both; and varying a fresh feed rate to the petroleum plant in conjunction with the introduction of the hydrocarbon-based treatment fluid.

65. The method of claim 64 wherein varying a fresh feed rate to the petroleum plant in conjunction with the introduction of the hydrocarbon-based treatment fluid includes an initial reduction in an established feed rate of the plant to a value comprised between 40% and below 100% with respect to the design feed rate, followed by the introduction of the hydrocarbon-based fluid which comprises an introduction of first and/or the second hydrocarbon-based fluid(s) in an amount as to compensate up to the difference among the rate at which the plant is running and its design feed rate, and so as to manage up to the maximum allowable plant distillate flow rate or in any case the distillate flow rate applicable prior to the introduction of the first and/or the second hydrocarbon-based fluid(s), such as to run the plant at the flow rate resulting from the sum: [flow rate of reduced fresh feed]+[flow rate of the first and/or the second hydrocarbon-based fluid(s)], and wherein said flow rate is equal to or higher to the one prior to the reduction in feed rate.

66. The method of claim 64 wherein the internal plant source of the hydrocarbon-based fluid is a distillation column and distillate from the column is sent to a treatment region of the plant upstream or downstream from said distillation column.

67. A method for treating a petroleum plant or equipment of the petroleum plant during a running of the petroleum plant, comprising:

maintaining, during a treatment period, the petroleum plant under a production operating condition, typical of the plant itself, while providing fresh feed to the petroleum plant;

while maintaining the petroleum plant under the production operating condition, introducing in the petroleum plant, during the treatment period, a hydrocarbon-based treatment fluid; and adjusting of the fresh feed by increasing the plant fresh feed rate from an established feed rate to a level above the established feed rate as to generate an additional quantity of distillates relative to a quantity generated at the established feed rate, and drawing off at least some of an overall quantity of distillate generated from the increased plant feed rate and introducing the drawn off distillate into a treatment region of said plant for the purpose of cleaning deposits from one or more pieces of equipment in the treatment region.

68. A petroleum plant apparatus to perform the method according to claim 67, comprising:

one or more withdrawal point(s) of a distillate or mixtures of distillates;

one or more introduction point(s) of a distillate or mixtures of distillates, as previously withdrawn;

one or more introduction point(s) of a first and/or second hydrocarbon fluid;

one or more pump(s) connected to said withdrawal point(s) of distillate(s) and/or of the product(s) exiting the plant, having sufficient characteristics to introduce said distillate(s) and/or said product(s) exiting the plant in the closed or semi-closed circulation loop and/or in one or more selected point(s) of the plant, said pump(s) being already part of said petroleum plant, or installed on purpose, or in mobile and/or temporary execution;

an inlet system of an hydrocarbon fluid or mixtures of hydrocarbon fluids, to allow the introduction of said hydrocarbon fluid(s) in the closed or semi-closed loop;

one or more lines and/or connection systems to close the closed or semi-closed loop comprising the withdrawal point(s) and/or introduction point(s) of the distillate(s), the pump(s) and the equipment, having sufficient characteristics to circulate said distillate(s) and/or said product exiting the plant inside the closed or semi-closed loop and/or in one or more selected point(s) in the plant, said lines and/or connections being already part of said petroleum plant, or installed on purpose, or in mobile and/or temporary execution;

a discharge system of the fluids, to allow their removal from the closed or semi-closed loop;

gauges and/or controllers of temperature, pressure, flow rate; and valves and/or sectioning and/or non-return systems.

69. The method of claim 67 further comprising passing said drawn off distillate through a closed or semi-closed loop forming at least a portion of said plant and extending through the treatment region, and wherein said closed or semi-closed loop of said plant is configured such that drawn off distillate is re-introduced into a distillation device of the plant which is a source of the initially drawn off distillate and drawing off a recirculation output of distillate from said distillation device following receipt of the re-introduced drawn off distillate and passing the recirculation output of distillate to the treatment region.

70. The method of claim 67 wherein the petroleum plant runs, relative to a pre-existing fresh feed rate, at an increased fresh feed rate that is below a design fresh feed rate of the plant, or at the design fresh feed rate, or higher than the design fresh feed rate, so as to produce an increased amount of distillates, thereafter progressively reducing the fresh feed rate, such that the increased amount of produced distillates, with respect to the amount of distillates produced with the pre-existing fresh feed rate, is circulated in parts of the plant to be treated.

71. The method of claim 67 wherein the treatment region is upstream or downstream from a distillation device from which distillate is sourced, and wherein introducing the drawn off distillate into a treatment region of said plant is carried out in a continuously re-circulating manner and removes heavy deposits from one or more pieces of equipment in the treatment region.

* * * * *